US010604916B2

(12) United States Patent
Matsuzaki et al.

(10) Patent No.: US 10,604,916 B2
(45) Date of Patent: Mar. 31, 2020

(54) SHOVEL

(71) Applicant: SUMITOMO HEAVY INDUSTRIES, LTD., Tokyo (JP)

(72) Inventors: Eisuke Matsuzaki, Kanagawa (JP); Hiroshi Ishiyama, Kanagawa (JP); Koichiro Tsukane, Kanagawa (JP); Kazushi Ishida, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 519 days.

(21) Appl. No.: 15/259,233

(22) Filed: Sep. 8, 2016

(65) Prior Publication Data

US 2016/0376770 A1 Dec. 29, 2016

Related U.S. Application Data

(63) Continuation of application No. PCT/JP2015/056990, filed on Mar. 10, 2015.

(30) Foreign Application Priority Data

Mar. 11, 2014 (JP) ..... 2014-048204
Mar. 11, 2014 (JP) ..... 2014-048205
(Continued)

(51) Int. Cl.
*F15B 11/17* (2006.01)
*E02F 9/22* (2006.01)
(Continued)

(52) U.S. Cl.
CPC ..... *E02F 9/2292* (2013.01); *E02F 9/2217* (2013.01); *E02F 9/2242* (2013.01);
(Continued)

(58) Field of Classification Search
CPC . E02F 3/32; E02F 9/123; E02F 9/2217; E02F 9/2239; E02F 9/2242; E02F 9/2271;
(Continued)

(56) References Cited

U.S. PATENT DOCUMENTS 9,598,842 B2 * 3/2017 Imura ..... E02F 9/2095
2004/0211471 A1 * 10/2004 Toji ..... F15B 11/17 137/596
(Continued)

FOREIGN PATENT DOCUMENTS

EP 1895060 3/2008
JP S59-080508 5/1984
(Continued)

OTHER PUBLICATIONS

Machine Translation of JP 2010-084888 A, original Pub. Date Apr. 15, 2010.*
International Search Report dated Jun. 16, 2015.

*Primary Examiner* — Michael Leslie
*Assistant Examiner* — Daniel S Collins
(74) *Attorney, Agent, or Firm* — IPUSA, PLLC

(57) ABSTRACT

A shovel may has a first pump that discharges a first hydraulic oil, a second pump that discharges a second hydraulic oil, a pump/motor that discharges a third hydraulic oil, an arm cylinder that at least the first hydraulic oil can flow into, and a boom cylinder that at least the second hydraulic oil can flow into. When the arm cylinder and the boom cylinder operate simultaneously, the arm cylinder is actuated by the first hydraulic oil or the third hydraulic oil, and the boom cylinder is actuated by the second hydraulic oil.

23 Claims, 21 Drawing Sheets

(30) Foreign Application Priority Data

| | | |
|---|---|---|
| Mar. 11, 2014 | (JP) | 2014-048206 |
| Mar. 11, 2014 | (JP) | 2014-048207 |
| Mar. 11, 2014 | (JP) | 2014-048208 |
| Mar. 11, 2014 | (JP) | 2014-048209 |
| Mar. 11, 2014 | (JP) | 2014-048210 |
| Mar. 11, 2014 | (JP) | 2014-048211 |

(51) Int. Cl.
*F15B 1/04* (2006.01)
*E02F 3/32* (2006.01)

(52) U.S. Cl.
CPC ..... *E02F 9/2271* (2013.01); *E02F 9/2296* (2013.01); *F15B 1/04* (2013.01); *F15B 11/17* (2013.01); *E02F 3/32* (2013.01); *F15B 2211/20576* (2013.01); *F15B 2211/41518* (2013.01); *F15B 2211/7142* (2013.01)

(58) Field of Classification Search
CPC ..... E02F 9/2292; E02F 9/2296; F15B 1/024; F15B 1/04; F15B 11/17; F15B 21/14; F15B 2201/00; F15B 2211/20546; F15B 2211/20569; F15B 2211/20576; F15B 2211/212; F15B 2211/3058; F15B 2211/315; F15B 2211/41518; F15B 2211/6306; F15B 2211/6309; F15B 2211/6313; F15B 2211/6333; F15B 2211/7053; F15B 2211/7058; F15B 2211/7135; F15B 2211/7142; F15B 2211/761; F15B 2211/88
See application file for complete search history.

(56) References Cited

U.S. PATENT DOCUMENTS

| | | | | |
|---|---|---|---|---|
| 2009/0288408 | A1* | 11/2009 | Tozawa | E02F 9/2075 60/435 |
| 2010/0043420 | A1 | 2/2010 | Ikeda et al. | |
| 2012/0055050 | A1 | 3/2012 | Patel et al. | |
| 2013/0098019 | A1 | 4/2013 | Opdenbosch et al. | |
| 2013/0098023 | A1 | 4/2013 | Yoshino | |
| 2013/0276441 | A1* | 10/2013 | Bae | F15B 11/17 60/422 |
| 2014/0044514 | A1 | 2/2014 | Kamimura | |
| 2014/0090369 | A1 | 4/2014 | Nakamura et al. | |
| 2014/0182279 | A1 | 7/2014 | Wu | |
| 2014/0366517 | A1* | 12/2014 | Sohn | E02F 9/2242 60/428 |

FOREIGN PATENT DOCUMENTS

| | | |
|---|---|---|
| JP | H05-287774 | 11/1993 |
| JP | H09-195322 | 7/1997 |
| JP | 2002-322682 | 11/2002 |
| JP | 2004-125094 | 4/2004 |
| JP | 2010-048417 | 3/2010 |
| JP | 2010-084888 | 4/2010 |
| JP | 2010-190261 | 9/2010 |
| JP | 2012-013123 | 1/2012 |
| JP | 2012-233352 | 11/2012 |
| JP | 2012-241803 | 12/2012 |
| JP | 2013-053498 | 3/2013 |
| JP | 2013-091953 | 5/2013 |
| WO | 2012/157705 | 11/2012 |
| WO | 2013-035815 | 3/2013 |

* cited by examiner

SHOVEL

RELATED APPLICATION

This application is a continuation application of International Application No. PCT/JP2015/056990 filed on Mar. 10, 2015 and designated the U.S., which is based upon and claims the benefit of priority of Japanese Patent Application Nos. 2014-048204, 2014-048205, 2014-048206, 2014-048207, 2014-048208, 2014-048209, 2014-048210, and 2014-048211, filed on Mar. 11, 2014, the entire contents of which are incorporated herein by reference.

BACKGROUND

Technical Field

The present invention relates to a shovel that mounts a hydraulic circuit including a plurality of hydraulic pumps and at least one hydraulic device serving as at least either of a hydraulic pump and a hydraulic motor.

Description of Related Art

A hydraulic system for a construction machine is known that is provided with a boom cylinder, an arm cylinder, and a bucket cylinder that may be simultaneously actuated by hydraulic oil supplied from each of three hydraulic pumps.

To increase an actuating speed of a working device comprised of a boom, an arm, and a bucket, this hydraulic system merges the hydraulic oil supplied from each of the three hydraulic pumps together and allows the hydraulic oil to flow into respective corresponding cylinders.

However, the above hydraulic system does not mention difference in load pressure in each of the boom cylinder, the arm cylinder, and the bucket cylinder when they are actuated simultaneously. Thus, it cannot prevent energy loss caused by the difference in load pressure, and far from a system that can effectively actuate the three hydraulic pumps.

SUMMARY

According to an embodiment of the present invention, there is provided a shovel including a first pump configured to discharge a first hydraulic oil, a second pump configured to discharge a second hydraulic oil, a hydraulic rotary drive part configured to discharge a third hydraulic oil, a first hydraulic actuator configured so that at least the first hydraulic oil flows into, and a second hydraulic actuator configured so that at least the second hydraulic oil flow into, wherein when the first hydraulic actuator and the second hydraulic actuator operate simultaneously, the first hydraulic actuator is actuated by the first hydraulic oil or the third hydraulic oil, and the second hydraulic actuator is actuated by the second hydraulic oil.

DETAILED DESCRIPTION

In view of the related art described above, it is desirable to provide a shovel that mounts a hydraulic circuit that can more effectively actuate a plurality of hydraulic pumps and at least one hydraulic device serving as at least either of a hydraulic pump and a hydraulic motor.

Figure 1:
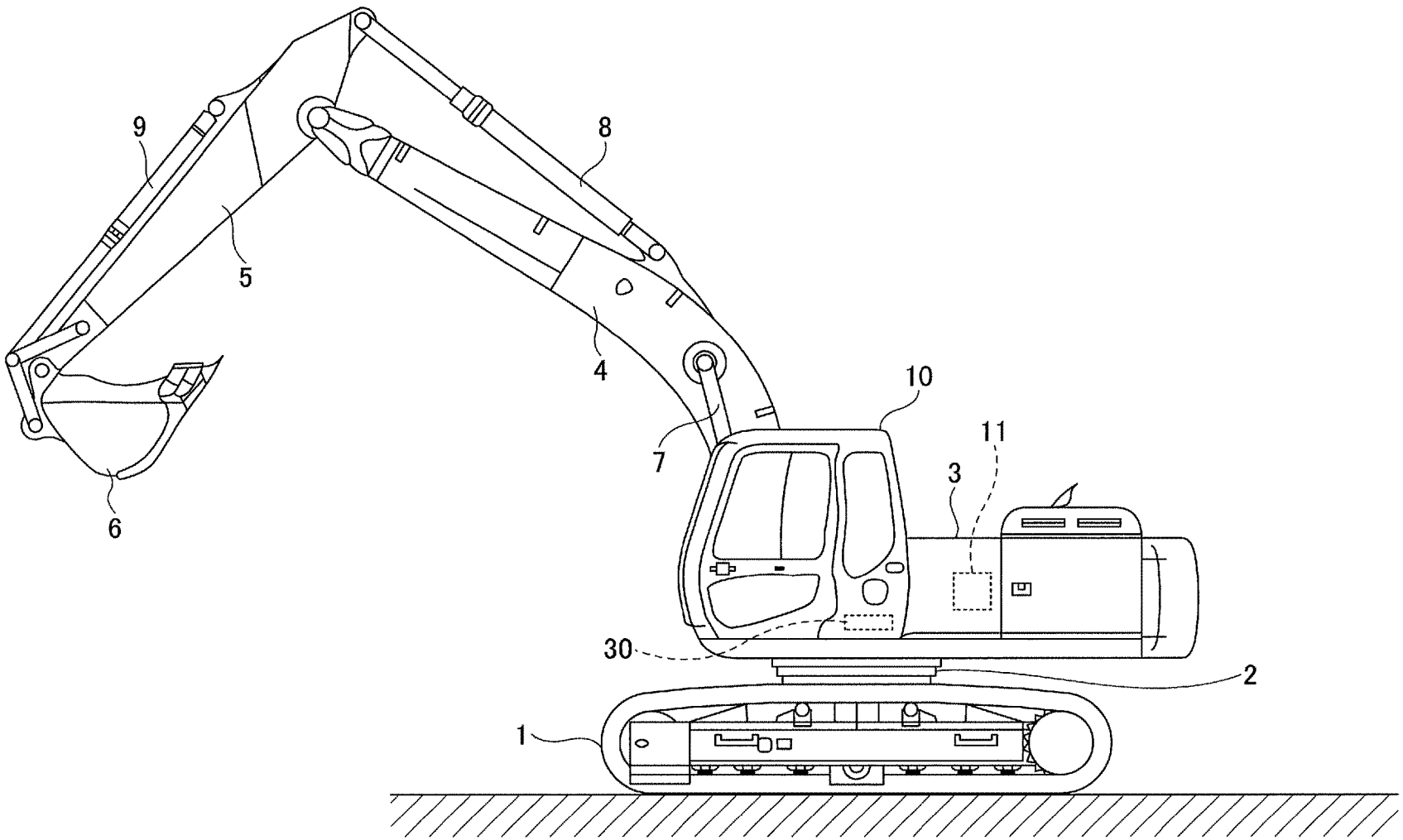
FIG. 1 is a side view of a shovel.

FIG. 1 is a side view of a shovel that the present invention is applied to. An upper swing body 3 is mounted on a lower running body 1 via a swing mechanism 2. A boom 4 is attached to the upper swing body 3. An arm 5 is attached to an end of the boom 4, and a bucket 6 is attached to an end of the arm 5. The boom 4, arm 5 and bucket 6 each as a working element constitutes an excavating attachment as an example of an attachment, and are hydraulically actuated by a boom cylinder 7, an arm cylinder 8 and a bucket cylinder 9, respectively. A cabin 10 is provided on the upper swing body 3, and a power source such as an engine 11 or the like, a controller 30 and the like are mounted on the upper swing body 3.

The controller 30 is a control device as a main control part that executes a drive control of the shovel. In the present embodiment, the controller 30 is comprised of an arithmetic processing unit including a Central Processing Unit (CPU) and an internal memory, and achieves various functions by causing the CPU to execute a program for the drive control stored in the internal memory.

Figure 2:
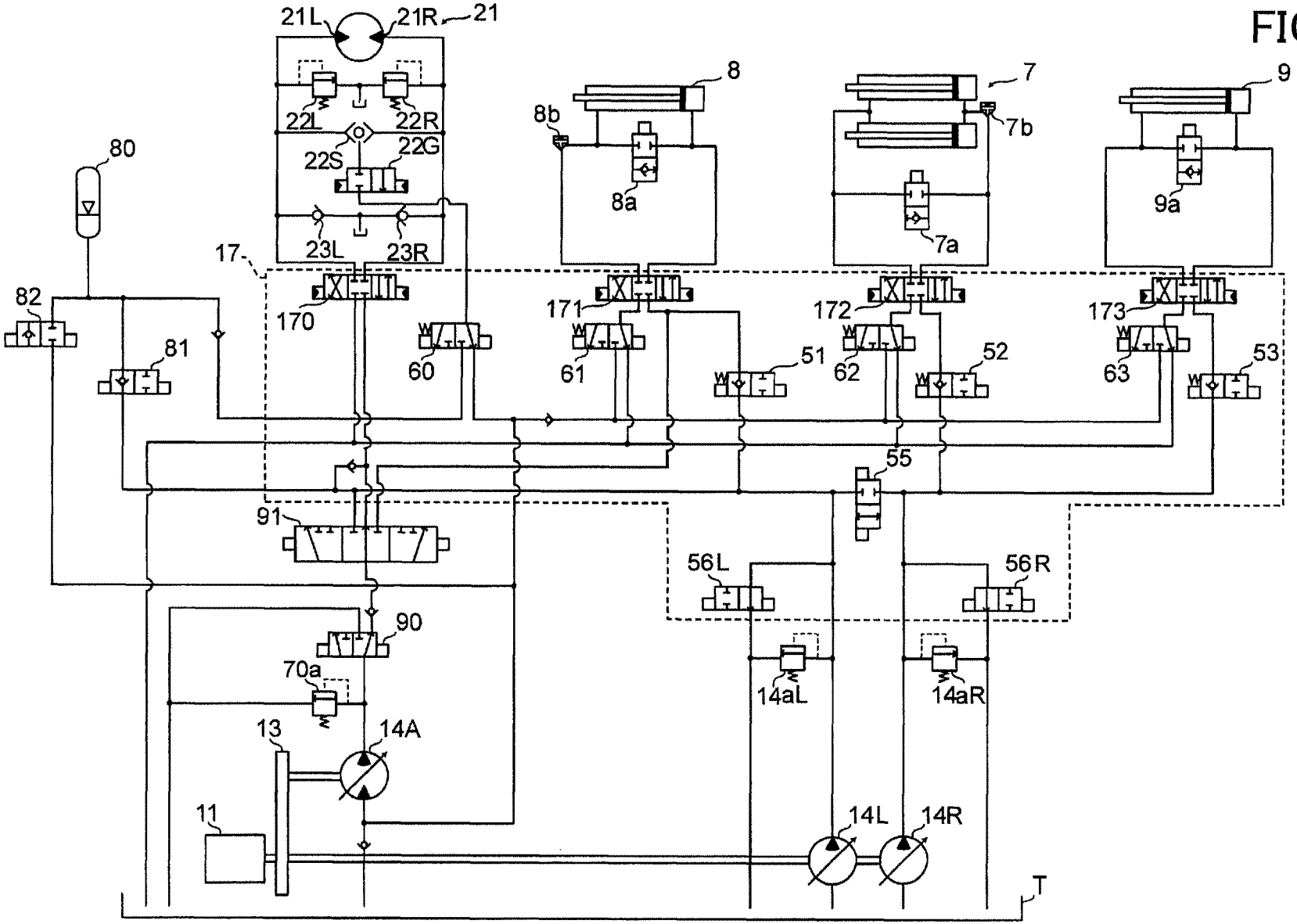
FIG. 2 is a schematic view showing a configuration example of a hydraulic circuit mounted on the shovel in FIG. 1.

FIG. 2 is a schematic view showing a configuration example of a hydraulic circuit mounted on the shovel in FIG. 1. In the present embodiment, the hydraulic circuit mainly includes a first pump 14L, a second pump 14R, a pump/motor 14A, a control valve 17, and hydraulic actuators. The hydraulic actuators mainly includes the boom cylinder 7, the arm cylinder 8, the bucket cylinder 9, a hydraulic swing motor 21, and an accumulator 80.

The boom cylinder 7 is a hydraulic cylinder that lifts or lowers the boom 4. A regeneration valve 7*a* is connected between a bottom side hydraulic chamber and a rod side hydraulic chamber. A holding valve 7*b* is located at the side of the bottom side hydraulic chamber. The arm cylinder 8 is a hydraulic cylinder that opens or closes the arm 5. A regeneration valve 8*a* is connected between a bottom side hydraulic chamber and a rod side hydraulic chamber. A holding valve 8*b* is located at the side of the rod side hydraulic chamber. The bucket cylinder 9 is a hydraulic cylinder that opens or closes the bucket 6. A regeneration valve 9*a* is connected between a bottom side hydraulic chamber and a rod side hydraulic chamber.

The hydraulic swing motor 21 is a hydraulic motor that swings the upper swing body 3. Respective Ports 21L, 21R are connected to a hydraulic oil tank T via relief valves 22L, 22R, connected to a regeneration valve 22G via a shuttle valve 22S, and connected to the hydraulic oil tank T via check valves 23L, 23R.

The relief valve 22L opens when pressure at the side of the port 21L reaches a predetermined relief pressure, and releases the hydraulic oil at the side of the port 21L to the hydraulic oil tank T. Also, the relief valve 22R opens when pressure at the side of the port 21R reaches a predetermined relief pressure, and releases the hydraulic oil at the side of the port 21R to the hydraulic oil tank T.

The shuttle valve 22S supplies hydraulic oil at the side of the port 21L or hydraulic oil at the side of the port 21R, whichever is higher in pressure, to the regeneration valve 22G.

The regeneration valve 22G operates in response to a command from the controller 30. It switches open/close of a communication between the hydraulic swing motor 21 (the shuttle valve 22S) and the pump/motor 14A or the accumulator 80.

The check valve 23L opens when pressure at the side of the port 21L becomes negative, and supplies hydraulic oil from the hydraulic oil tank T to the side of the port 21L. The check valve 23R opens when pressure at the side of the port 21R becomes negative, and supplies hydraulic oil from the hydraulic oil tank T to the side of the port 21R. In this way, the check valves 23L, 23R constitute a replenishing mechanism that supplies hydraulic oil to a suction side port during braking the hydraulic swing motor 21.

The first pump 14L is a hydraulic pump that sucks hydraulic oil from the hydraulic oil tank T and discharges the hydraulic oil. In the present embodiment, the first pump 14L is a swash plate type variable displacement hydraulic pump. The first pump 14L is connected to a regulator. The regulator controls a discharge rate of the first pump 14L by changing a swash plate tilting angle in response to a command from the controller 30. The same goes for the second pump 14R.

A relief valve 14*a*L is located at a discharge side of the first pump 14L. The relief valve 14*a*L opens when pressure at the discharge side of the first pump 14L reaches a predetermined relief pressure, and releases the hydraulic oil at the discharge side to the hydraulic oil tank T. The same goes for a relief valve 14*a*R located at a discharge side of the second pump 14R.

The pump/motor 14A is an example of a hydraulic rotary drive part as a hydraulic device serving as at least either of a hydraulic pump and a hydraulic motor. The hydraulic rotary drive part includes a hydraulic device serving only as a hydraulic pump, a hydraulic device serving only as a hydraulic motor, and a hydraulic device serving as both a hydraulic pump and a hydraulic motor. In the present embodiment, the pump/motor 14A is a swash plate type variable displacement hydraulic pump/motor serving as both a hydraulic pump (a third pump) and a hydraulic motor. However, the pump/motor 14A may be replaced by a hydraulic pump or a hydraulic motor depending on a required function. For example, it may be replaced by a hydraulic pump when only a function as a hydraulic pump is required or by a hydraulic motor when only a function as a hydraulic motor is required. The pump/motor 14A is connected to a regulator as in the first pump 14L and the second pump 14R. The regulator controls a discharge rate of the pump/motor 14A by changing a swash plate tilting angle of the pump/motor 14A in response to a command from the controller 30.

A relief valve 70*a* is located at the discharge side of the pump/motor 14A. The relief valve 70*a* opens when pressure at the discharge side of the pump/motor 14A reaches a predetermined relief pressure, and releases the hydraulic oil at the discharge side to the hydraulic oil tank T.

In the present embodiment, respective drive shafts of the first pump 14L, the second pump 14R, and the pump/motor 14A are mechanically coupled. Specifically, the respective drive shafts are coupled to an output shaft of the engine 11 via a gearbox 13 at a predetermined transmission gear ratio. Thus, as long as an engine rotation speed is constant, respective rotation speeds are constant as well. However, the first pump 14L, the second pump 14R, and the pump/motor 14A may be connected to the engine 11 via a non-stage transmission or the like so as to change their rotation speeds even if the engine rotation speed is constant.

The control valve 17 is a hydraulic control device that controls a hydraulic drive system on a shovel. The control valve 17 mainly includes variable load check valves 51-53, a confluence valve 55, unified bleed-off valves 56L, 56R, selector valves 60-63, and flow rate control valves 170-173.

The flow rate control valves 170-173 control flow direction and flow rate of hydraulic oil flowing into and out of the hydraulic actuators. In the present embodiment, each of the flow rate control valves 170-173 is a 4-port 3-position spool valve that operates by receiving a pilot pressure generated by a corresponding operating device (not shown) such as an operating lever at either a left side pilot port or a right side pilot port. The operating device applies the pilot pressure generated depending on an amount of operation (an angle of operation) onto a pilot port at a side corresponding to a direction of operation.

Specifically, the flow rate control valve 170 is a spool valve that controls flow direction and flow rate of hydraulic oil flowing into and out of the hydraulic swing motor 21. The flow rate control valve 171 is a spool valve that controls flow direction and flow rate of hydraulic oil flowing into and out of the arm cylinder 8.

The flow rate control valve 172 is a spool valve that controls flow direction and flow rate of hydraulic oil flowing into and out of the boom cylinder 7. The flow rate control valve 173 is a spool valve that controls flow direction and flow rate of hydraulic oil flowing into and out of the bucket cylinder 9.

The variable load check valves 51-53 operate in response to a command from the controller 30. In the present embodiment, each of the variable load check valves 51-53 is a 2-port 2-position electromagnetic valve that can switch open/close of a communication between each of the flow rate control valves 170-173 and at least either of the first pump 14L and the second pump 14R. At a first position, the variable load check valves 51-53 have a check valve that blocks a flow of hydraulic oil returning to the pumps. Specifically, the variable load check valve 51 opens a communication between the flow rate control valve 171 and at least either of the first pump 14L and the second pump 14R when it is at the first position, and closes the communication when it is at a second position. The same goes for the variable load check valve 52 and the variable load check valve 53.

The confluence valve 55 is an example of a confluence switching part, and operates in response to a command from the controller 30. In the present embodiment, the confluence valve 55 is a 2-port 2-position electromagnetic valve that can switch whether or not to merge hydraulic oil discharged from the first pump 14L (hereinafter referred to as "first hydraulic oil") and hydraulic oil discharged from the second pump 14R (hereinafter referred to as "second hydraulic oil"). Specifically, the confluence valve 55 merges the first hydraulic oil and the second hydraulic oil when it is at a first position, and does not merge the first hydraulic oil and the second hydraulic oil when it is at a second position.

The unified bleed-off valves 56L, 56R operate in response to a command from the controller 30. In the present embodiment, the unified bleed-off valve 56L is a 2-port 2-position electromagnetic valve that can control outflow rate of the first hydraulic oil to the hydraulic oil tank T. The same goes for the unified bleed-off valve 56R. Due to this configuration, the unified bleed-off valves 56L, 56R can reproduce a synthetic opening of related flow rate control valves out of the flow rate control valves 170-173. Specifically, when the confluence valve 55 is at the second position, the unified bleed-off valve 56L can reproduce a synthetic opening of the flow rate control valve 170 and the flow rate control valve 171, and the unified bleed-off valve 56R can reproduce a synthetic opening of the flow rate control valve 172 and the flow rate control valve 173.

The selector valves 60-63 operate in response to a command from the controller 30. In the present embodiment, the selector valves 60-63 are 3-port 2-position electromagnetic valves that can switch whether or not to supply hydraulic oil flowing out of respective hydraulic actuators to upstream side (supply side) of the pump/motor 14A. Specifically, the selector valve 60 supplies the hydraulic oil flowing out of the hydraulic swing motor 21 to the supply side of the pump/motor 14A via the regeneration valve 22G when it is at a first position, and supplies the hydraulic oil flowing out of the hydraulic swing motor 21 to the accumulator 80 via the regeneration valve 22G when it is at a second position. The selector valve 61 supplies the hydraulic oil flowing out of the arm cylinder 8 to the hydraulic oil tank T when it is at a first position, and supplies the hydraulic oil flowing out of the arm cylinder 8 to the supply side of the pump/motor 14A when it is at a second position. The same goes for the selector valve 62 and the selector valve 63.

The accumulator 80 is a hydraulic device that accumulates pressurized hydraulic oil. In the present embodiment, accumulation/discharge of hydraulic oil into/from the accumulator 80 is controlled by a selector valve 81 and a selector valve 82.

The selector valve 81 operates in response to a command from the controller 30. In the present embodiment, the selector valve 81 is a 2-port 2-position electromagnetic valve that can switch open/close of a communication between the first pump 14L that is a supply source of pressurized hydraulic oil and the accumulator 80. Specifically, the selector valve 81 opens the communication between the first pump 14L and the accumulator 80 when it is at a first position, and closes the communication when it is at a second position. At the first position, the selector valve 81 has a check valve that blocks a flow of hydraulic oil returning to the first pump 14L.

The selector valve 82 operates in response to a command from the controller 30. In the present embodiment, the selector valve 82 is a 2-port 2-position electromagnetic valve that can switch open/close of a communication between the supply side of the pump/motor 14A that is a supply destination of pressurized hydraulic oil and the accumulator 80. Specifically, the selector valve 82 opens the communication between the pump/motor 14A and the accumulator 80 when it is at a first position, and closes the communication when it is at a second position. At the first position, the selector valve 82 has a check valve that blocks a flow of hydraulic oil returning to the accumulator 80.

A selector valve 90 operates in response to a command from the controller 30. In the present embodiment, the selector valve 90 is a 3-port 2-position electromagnetic valve that can switch a supply destination of the hydraulic oil discharged from the pump/motor 14A (hereinafter referred to as "third hydraulic oil"). Specifically, the selector valve 90 supplies the third hydraulic oil to a selector valve 91 when it is at a first position, and supplies the third hydraulic oil to the hydraulic oil tank T when it is at a second position.

The selector valve 91 operates in response to a command from the controller 30. In the present embodiment, the selector valve 91 is a 4-port 3-position electromagnetic valve that can switch a supply destination of the third hydraulic oil. Specifically, the selector valve 91 supplies the third hydraulic oil to the arm cylinder 8 when it is at a first position, supplies the third hydraulic oil to the hydraulic swing motor 21 when it is at a second position, and supplies the third hydraulic oil to the accumulator 80 when it is at a third position.

Figure 3:
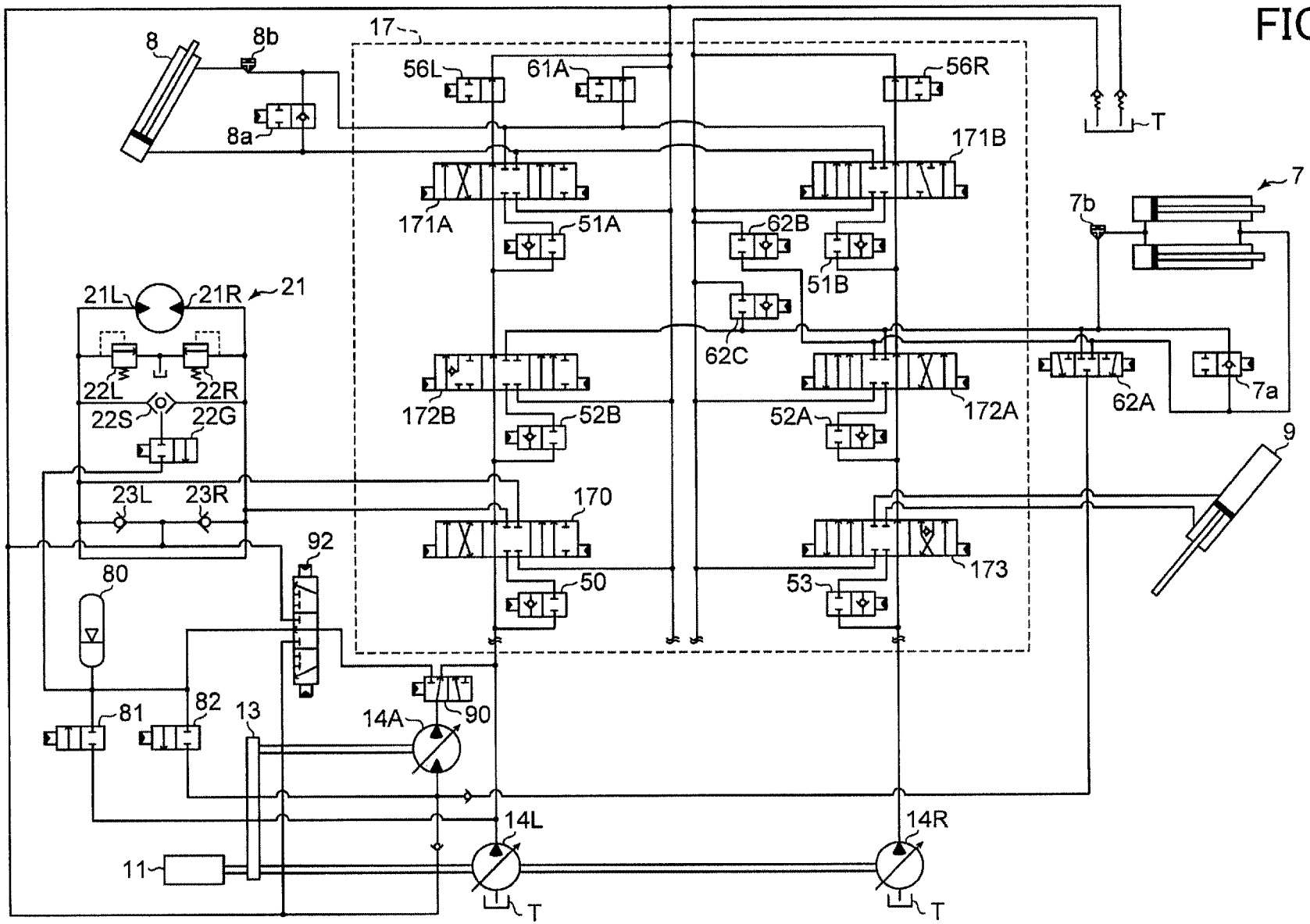
FIG. 3 is schematic view showing another configuration example of a hydraulic circuit mounted on the shovel in FIG. 1.

Next, referring to FIG. 3, another configuration example of a hydraulic circuit is described. FIG. 3 is a schematic view showing another configuration example of a hydraulic circuit mounted on the shovel in FIG. 1. The hydraulic circuit in FIG. 3 is different from the hydraulic circuit in FIG. 2 mainly in that a flow direction and a flow rate of the hydraulic oil flowing into and out of the arm cylinder 8 are controlled by two flow rate control valves 171A, 171B, in that a flow rate of the hydraulic oil flowing into and out of the bottom side hydraulic chamber of the boom cylinder 7 is controlled by two flow rate control valves 172A, 172B, in that a confluence switching part is comprised of not a confluence valve but a variable load check valve (in that a confluence valve is omitted), and in that the hydraulic oil returning from the boom cylinder 7 can be accumulated into the accumulator 80. The other points are in common with the hydraulic circuit in FIG. 2. Thus, the differences are explained in detail while omitting an explanation of the common points.

The flow rate control valves 171A, 172B control a flow direction and a flow rate of the hydraulic oil flowing into and out of the arm cylinder 8, and correspond to the flow rate control valve 171 in FIG. 2. Specifically, the flow rate control valve 171A supplies the first hydraulic oil to the arm cylinder 8, and the flow rate control valve 172B supplies the second hydraulic oil to the arm cylinder 8. Thus, the first hydraulic oil and the second hydraulic oil can simultaneously flow into the arm cylinder 8.

The flow rate control valve 172A controls a flow direction and a flow rate of the hydraulic oil flowing into and out of the boom cylinder 7, and corresponds to the flow rate control valve 172 in FIG. 2.

The flow rate control valve 172B supplies the first hydraulic oil to the bottom side hydraulic chamber of the boom cylinder 7 when a boom lifting operation is carried out. When a boom lowering operation is carried out, it can merge the hydraulic oil flowing out of the bottom side hydraulic chamber of the boom cylinder 7 into the first hydraulic oil.

The flow rate control valve 173 controls a flow direction and a flow rate of the hydraulic oil flowing into and out of the bucket cylinder 9, and corresponds to the flow rate control valve 173 in FIG. 2. The flow rate control valve 173 in FIG. 3 includes a check valve within it in order to regenerate the hydraulic oil flowing out of the rod side hydraulic chamber of the bucket cylinder 9 to the bottom side hydraulic chamber.

Variable load check valves 50, 51A, 51B, 52A, 52B, and 53 are 2-port 2-position valve that can switch open/close a communication between each of the flow rate control valves 170, 171A, 171B, 172A, 172B, and 173 and at least either of the first pump 14L and the second pump 14R. These six variable load check valves operate simultaneously with one another and act as the confluence switching part, and thus can realize a function of the confluence valve 55 in FIG. 2. Therefore, in the hydraulic circuit in FIG. 3, the confluence valve 55 in FIG. 2 is omitted.

Unified bleed-off valves 56L, 56R are 2-port 2-position valve that can control outflow rate of the first, second hydraulic oil to the hydraulic oil tank T, and correspond to the unified bleed-off valves 56L, 56R in FIG. 2.

Any of the six flow rate control valves in FIG. 3 is a 6-port 3-position spool valve, and, different from the flow rate control valves in FIG. 2, it has a center bypass port. Thus, in FIG. 3, the unified bleed-off valve 56L is located downstream of the flow rate control valve 171A, and the unified bleed-off valve 56R is located downstream of the flow rate control valve 171B.

A selector valve 61A is a 2-port 2-position valve that can switch whether or not to supply the hydraulic oil flowing out of the rod side hydraulic chamber of the arm cylinder 8 to upstream side (supply side) of the pump/motor 14A. Specifically, the selector valve 61A opens a communication between the rod side hydraulic chamber of the arm cylinder 8 and the pump/motor 14A when it is at a first position, and closes the communication when it is at a second position.

A selector valve 62A is a 3-port 3-position valve that can switch whether or not to supply the hydraulic oil flowing out of the boom cylinder 7 to upstream side (supply side) of the pump/motor 14A. Specifically, the selector valve 62A opens a communication between the bottom side hydraulic chamber of the boom cylinder 7 and the pump/motor 14A when it is at a first position, opens a communication between the rod side hydraulic chamber of the boom cylinder 7 and the pump/motor 14A when it is at a second position, and closes the communications when it is at a third position (a neutral position).

A selector valve 62B is a 2-port 2-position variable relief valve that can switch whether or not to release the hydraulic oil flowing out of the rod side hydraulic chamber of the boom cylinder 7 to the hydraulic oil tank T. Specifically, the selector valve 62B opens a communication between the rod side hydraulic chamber of the boom cylinder 7 and the hydraulic oil tank T when it is at a first position, and closes the communication when it is at a second position. In the first position, the selector valve 62B has a check valve that blocks a flow of the hydraulic oil from the hydraulic oil tank T.

A selector valve 62C is a 2-port 2-position variable relief valve that can switch whether or not to release the hydraulic oil flowing out of the bottom side hydraulic chamber of the boom cylinder 7 to the hydraulic oil tank T. Specifically, the selector valve 62C opens a communication between the bottom side hydraulic chamber of the boom cylinder 7 and the hydraulic oil tank T when it is at a first position, and closes the communication when it is at a second position. In the first position, the selector valve 62C has a check valve that blocks a flow of the hydraulic oil from the hydraulic oil tank T.

A selector valve 90 is a 3-port 2-position electromagnetic valve that can switch a supply destination of the third hydraulic oil discharged from the pump/motor 14A, and corresponds to the selector valve 90 in FIG. 2. Specifically, the selector valve 90 supplies the third hydraulic oil toward the control valve 17 when it is at a first position, and supplies the third hydraulic oil toward the selector valve 92 when it is at a second position.

A selector valve 92 is a 4-port 3-position electromagnetic valve that can switch a supply destination of the third hydraulic oil. Specifically, the selector valve 92 supplies the third hydraulic oil toward a replenishing mechanism of the hydraulic swing motor 21 when it is at a first position, supplies the third hydraulic oil toward the accumulator 80 when it is at a second position, and supplies the third hydraulic oil toward the hydraulic oil tank T when it is at a third position.

[Excavating Movement]

Figure 4:
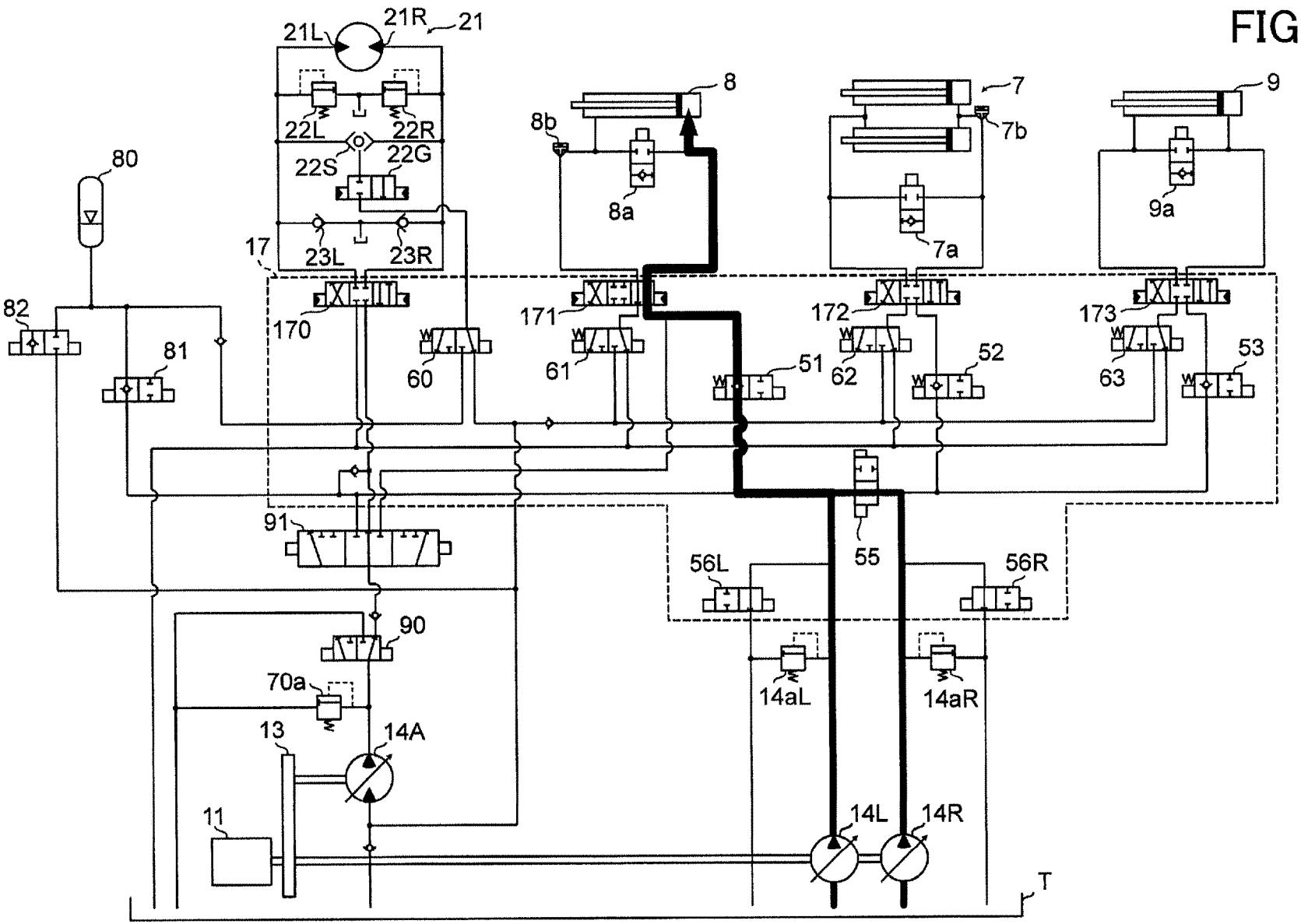
FIG. 4 shows a state of the hydraulic circuit in FIG. 2 when an excavating movement is carried out.
Figure 5:
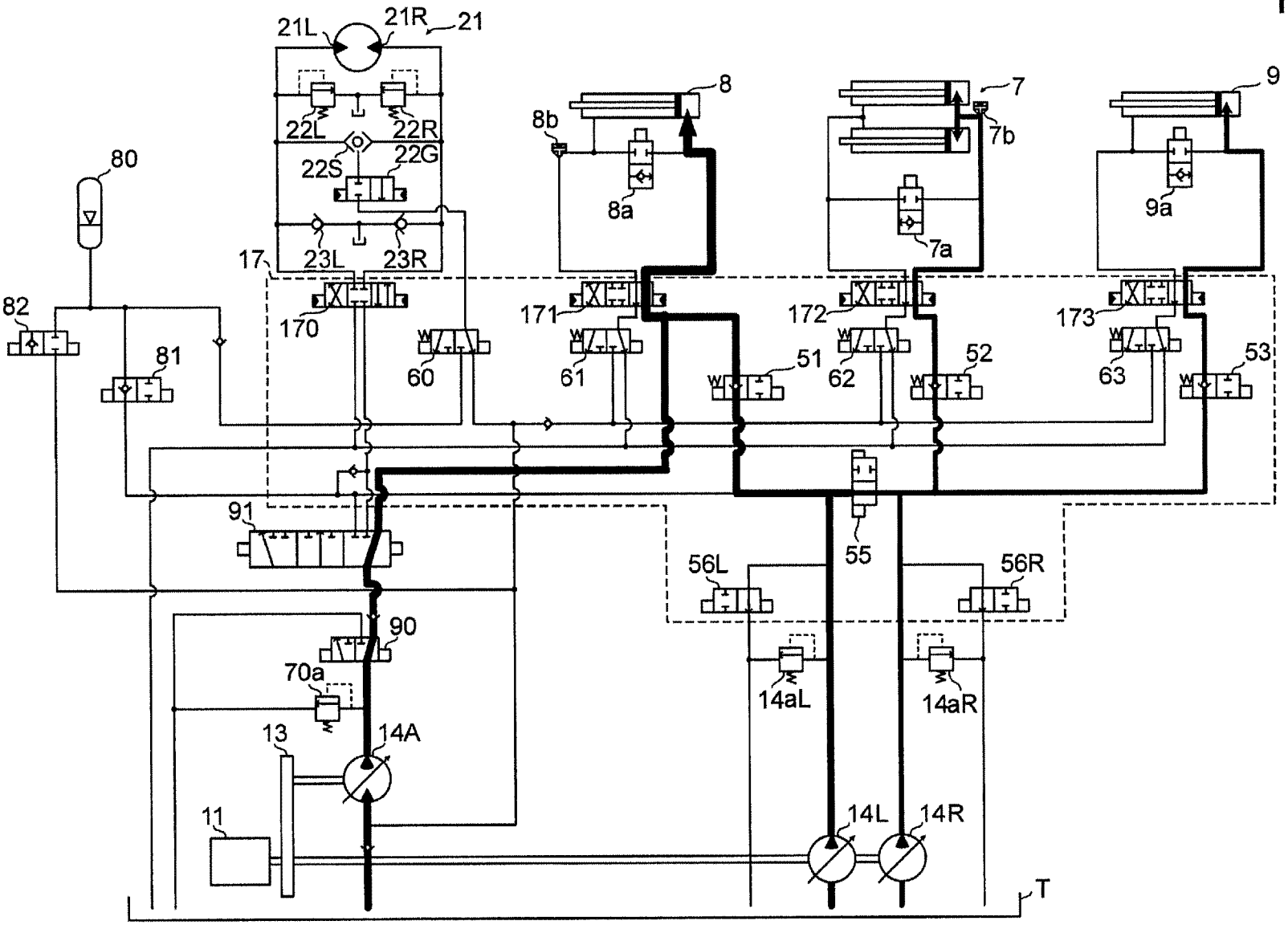
FIG. 5 shows a state of the hydraulic circuit in FIG. 2 when an excavating movement is carried out.
Figure 6:
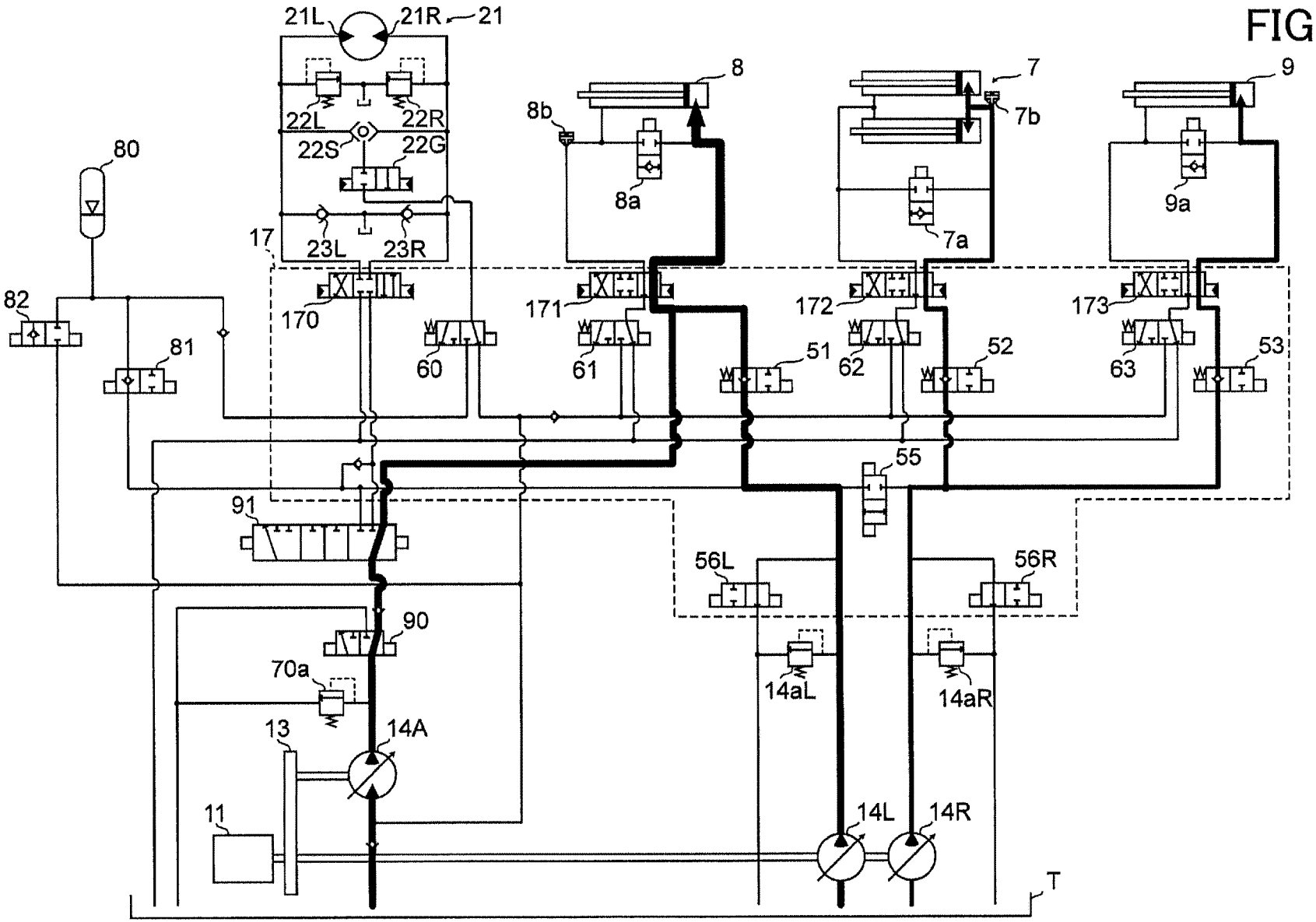
FIG. 6 shows a state of the hydraulic circuit in FIG. 2 when an excavating movement is carried out.

Next, referring to FIGS. 4-6, states of the hydraulic circuit in FIG. 2 when an excavating movement is carried out are explained. FIGS. 4-6 show states of the hydraulic circuit in FIG. 2 when an excavating movement is carried out. Thick solid lines in FIGS. 4-6 depict flows of the hydraulic oil flowing into the hydraulic actuators. A width of the solid line increases with increase in flow rate.

The controller 30 determines a content of operation of the shovel by an operator based on an output of an operation detecting part such as an operating pressure sensor (not shown) that detects a pilot pressure generated by the operating device. The controller 30 also determines an operating state of the shovel based on an output of a load detecting part such as a discharge pressure sensor (not shown) that detects respective discharge pressures of the first pump 14L, the second pump 14R, and the pump/motor 14A, and a load pressure sensor (not shown) that detects respective pressures of the hydraulic actuators. In the present embodiment, the load pressure sensor includes cylinder pressure sensors that detect respective pressures of the bottom side hydraulic chamber and the rod side hydraulic chamber of each of the boom cylinder 7, the arm cylinder 8, and the bucket cylinder 9. The controller 30 also detects a pressure of the hydraulic oil accumulated in the accumulator 80 (hereinafter referred to as "accumulator pressure") based on an output of an accumulator pressure sensor (not shown).

Then, when the controller 30 determines that the arm 5 has been operated, as shown in FIG. 4, the controller 30 moves the confluence valve 55 at the second position toward the first position depending on an amount of operation of an arm operating lever. As a result, the first hydraulic oil and the second hydraulic oil are merged and supplied to the flow rate control valve 171. The flow rate control valve 171 shifts to its right position in FIG. 4 in response to a pilot pressure generated depending on an amount of operation of the arm operating lever, and causes the first hydraulic oil and the second hydraulic oil to flow into the arm cylinder 8.

When the controller 30 determines that the boom 4 and the bucket 6 have been operated, the controller 30 determines which an excavating movement or a floor drilling movement has been carried out based on an output of the load pressure sensor. The floor drilling movement is, for example, a movement to smooth a land surface by the bucket 6. During the floor drilling movement, a pressure in the bottom side hydraulic chamber of the arm cylinder 8 is lower than that during the excavating movement.

When the controller 30 determines that an excavating movement has been carried out, the controller 30 decides a discharge rate command value for the second pump 14R corresponding to an amount of operation of a boom operating lever and an amount of operation of a bucket operating lever, based on a pump discharge rate control such as a negative control, a positive control, a load sensing control, a horsepower control, or the like. Then, the controller 30 controls a corresponding regulator so that a discharge rate of the second pump 14R can meet the command value.

Also, by using the above pump discharge rate control, the controller 30 computes a flow rate difference between the discharge rate command value and a calculated discharge rate in consideration of an amount of operation of the arm operating lever as well as an amount of operation of a boom operating lever and an amount of operation of a bucket operating lever. Then, the controller 30 causes the pump/motor 14A to discharge hydraulic oil corresponding to the flow rate difference. This calculated discharge rate becomes the maximum discharge rate of the second pump 14R when the arm 5 is being operated at full lever as in the excavating movement. The full lever represents an amount of operation greater than or equal to 80%, for example, under the assumption that a neutral state of a lever correspond to 0% and the maximally operated state corresponds to 100%. Specifically, as shown in FIG. 5, the controller 30 actuates the pump/motor 14A as a hydraulic pump and controls a corresponding regulator so that a discharge rate of the pump/motor 14A becomes a flow rate corresponding to the flow rate difference. Then, the controller 30 switches the selector valve 90 to the first position and directs the third hydraulic oil toward the selector valve 91, and switches the selector valve 91 to the first position and directs the third hydraulic oil toward the arm cylinder 8.

The controller 30 also controls an opening area of the confluence valve 55 based on the above flow rate difference, a discharge pressure of the first pump 14L, a discharge pressure of the second pump 14R, and the like. In the examples of FIG. 4-6, the controller 30 decides the opening area of the confluence valve 55 by reference to a predefined opening map, and outputs a command corresponding to the opening area to the confluence valve 55. The controller 30 may decide the opening area of the confluence valve 55 by using a predetermined function instead of the opening map.

For example, when a flow rate of the third hydraulic oil discharged from the pump/motor 14A reaches a flow rate corresponding to the above flow rate difference, as shown in FIG. 6, the controller 30 switches the confluence valve 55 to the second position and stops merging of the first hydraulic oil and the second hydraulic oil.

Also, when the controller 30 determines that a floor drilling movement has been carried out, as shown in FIG. 6, the controller 30 closes the confluence valve 55 as soon as possible, as long as a movement of the shovel does not become unstable. This is to enhance operability of the boom 4 and the bucket 6 by causing only the second hydraulic oil to flow into the boom cylinder 7 and the bucket cylinder 9.

In the examples of FIGS. 4-6, the maximum discharge rate of the pump/motor 14A is less than the maximum discharge rate of the second pump 14R. Thus, when the above flow rate difference is greater than the maximum discharge rate of the pump/motor 14A, the controller 30 actuates the first pump 14L and the pump/motor 14A acting as a hydraulic pump at their maximum discharge rate, and then increases a discharge rate of the second pump 14R so that a difference between the maximum discharge rate of the second pump 14R and an actual increased discharge rate of the second pump 14R may become lower than or equal to the maximum discharge rate of the pump/motor 14A. This is to prevent an actuating speed of the arm 5 from being less than the actuating speed of the arm 5 when using the first hydraulic oil and the second hydraulic oil.

However, when the maximum discharge rate of the pump/motor 14A is greater than or equal to the maximum discharge rate of the second pump 14R, as shown in FIG. 6, the controller 30 can maintain the confluence valve 55 in a closed state (the second position) during the excavating movement. This is because the actuating speed of the arm 5 when using the first hydraulic oil and the third hydraulic oil does not become lower than the actuating speed of the arm 5 when using the first hydraulic oil and the second hydraulic oil. In this case, whenever during the excavating movement, the controller 30 causes only the first hydraulic oil and the third hydraulic oil to flow into the arm cylinder 8, and causes only the second hydraulic oil to flow into the boom cylinder 7 and the bucket cylinder 9. As a result, it can completely separate the hydraulic oil for actuating the arm 5 from the hydraulic oil for actuating the boom 4 and the bucket 6, and can enhance the operability of each of them.

Figure 7:
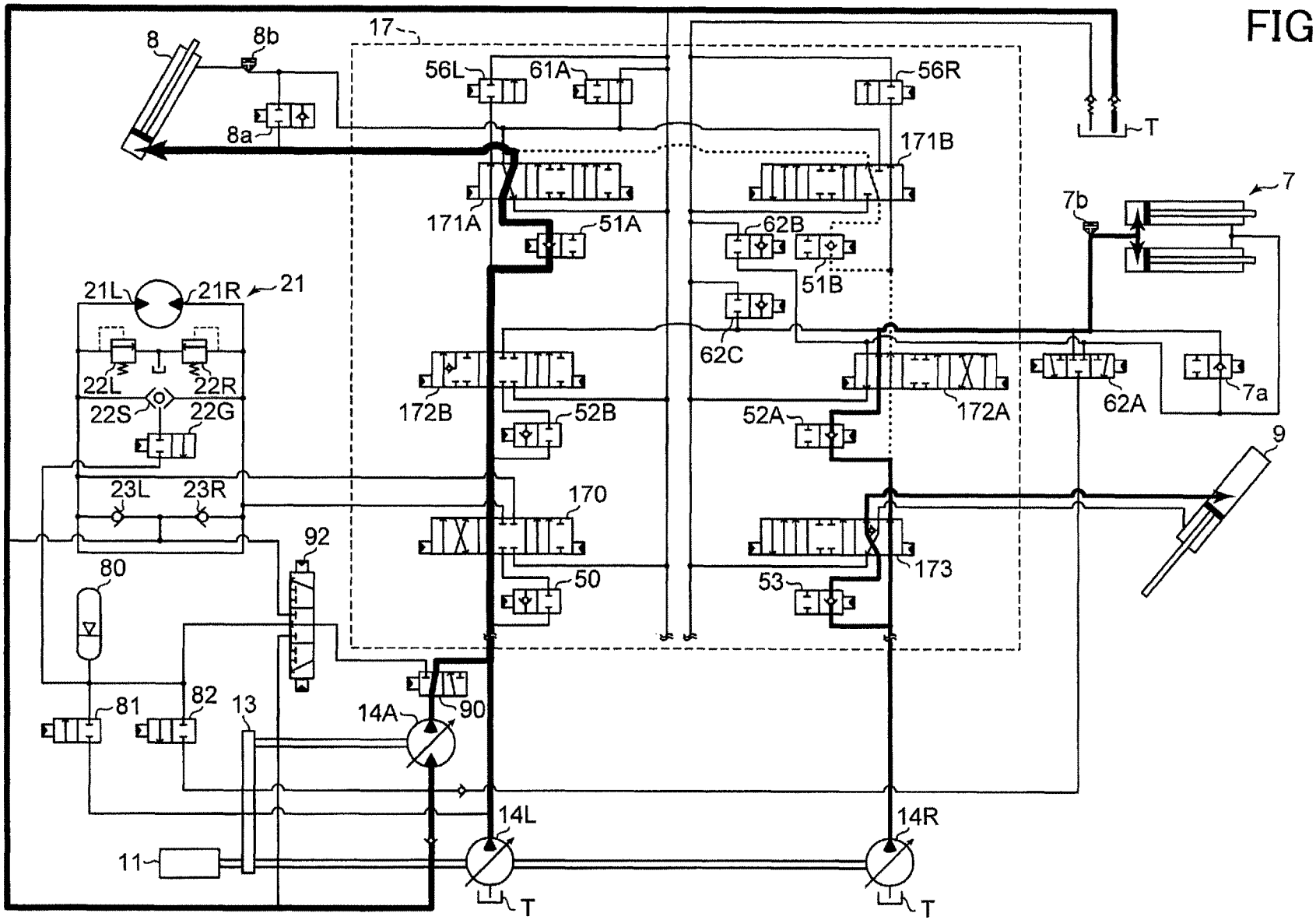
FIG. 7 shows a state of the hydraulic circuit in FIG. 3 when an excavating movement is carried out.

Next, referring to FIG. 7, a state of the hydraulic circuit in FIG. 3 when an excavating movement is carried out is explained. FIG. 7 shows a state of the hydraulic circuit in FIG. 3 when an excavating movement is carried out. Thick solid lines and dotted lines in FIG. 7 depict flows of the hydraulic oil flowing into the hydraulic actuators. A width of the solid line increases with increase in flow rate. The dotted lines in FIG. 7 additionally depict that flows of the hydraulic oil may decrease or disappear.

As in the case of the hydraulic circuit in FIG. 2, the controller 30 determines a content of operation of the shovel by an operator based on an output of an operation detecting part, and determines an operating state of the shovel based on an output of a load detecting part.

When the arm 5 is operated, the flow rate control valve 171A shifts to its left position in FIG. 7 in response to a pilot pressure generated depending on an amount of operation of the arm operating lever, and the flow rate control valve 171B shifts to its right position in FIG. 7 in response to a pilot pressure generated depending on an amount of operation of the arm operating lever.

Then, when the controller 30 determines that the arm 5 has been operated, the controller 30 switches the variable load check valve 51A to the first position so that the first hydraulic oil may reach the flow rate control valve 171A through the variable load check valve 51A. The controller 30 also switches the variable load check valve 51B to the first position so that the second hydraulic oil may reach the flow rate control valve 171B through the variable load check valve 51B. The first hydraulic oil passing through the flow rate control valve 171A merges with the second hydraulic oil passing through the flow rate control valve 171B, and flows into the bottom side hydraulic chamber of the arm cylinder 8.

Then, when the controller 30 determines that the boom 4 and the bucket 6 have been operated, the controller 30 determines which an excavating movement or a floor drilling movement has been carried out based on an output of the load pressure sensor. Then, when the controller 30 determines that an excavating movement has been carried out, the controller 30 decides a discharge rate command value of the second pump 14R corresponding to an amount of operation of the boom operating lever and an amount of operation of the bucket operating lever. Then, the controller 30 controls a corresponding regulator so that a discharge rate of the second pump 14R can meet the command value.

In this case, the flow rate control valve 172A shifts to its left position in FIG. 7 in response to a pilot pressure generated depending on an amount of operation of the boom operating lever. The flow rate control valve 173 shifts to its right position in FIG. 7 in response to a pilot pressure generated depending on an amount of operation of the bucket operating lever. Then, the controller 30 switches the variable load check valve 52A to the first position so that the second hydraulic oil may reach the flow rate control valve 172A through the variable load check valve 52A. Similarly, the controller 30 switches the variable load check valve 53 to the first position so that the second hydraulic oil may reach the flow rate control valve 173 through the variable load check valve 53. Then, the second hydraulic oil passing through the flow rate control valve 172A flows into the bottom side hydraulic chamber of the boom cylinder 7, and the second hydraulic oil passing through the flow rate control valve 173 flows into the bottom side hydraulic chamber of the bucket cylinder 9.

The controller 30 computes a flow rate difference between the maximum discharge rate of the second pump 14R and the discharge rate command value, and causes the pump/motor 14A to discharge hydraulic oil corresponding to the flow rate difference. Specifically, as shown in FIG. 7, the controller 30 actuates the pump/motor 14A as a hydraulic pump, and controls a corresponding regulator so that a discharge rate of the pump/motor 14A may become a discharge rate corresponding to the discharge rate difference. Then, the controller 30 switches the selector valve 90 to the first position and directs the third hydraulic oil toward the control valve 17.

The controller 30 also controls an opening area of the variable load check valve 51B based on the above flow rate difference, a discharge pressure of the first pump 14L, a discharge pressure of the second pump 14R, and the like. In the example of FIG. 7, the controller 30 decides an opening area of the variable load check valve 51B in reference to a predefined opening map, and outputs a command corresponding to the opening area to the variable load check valve 51B. As a result, the second hydraulic oil flowing into the bottom side hydraulic chamber of the arm cylinder 8 decreases or disappears. The dotted lines in FIG. 7 depict that the second hydraulic oil flowing into the bottom side hydraulic chamber of the arm cylinder 8 decreases or disappears with increase in a flow rate of the third hydraulic oil discharged from the pump/motor 14A.

As described above, the controller 30 actuates the pump/motor 14A as a hydraulic pump when an excavating movement including a boom lifting, an arm closing, and a bucket closing has been carried out. Then, the controller 30 causes the third hydraulic oil discharged from the pump/motor 14A to flow into a hydraulic actuator (the arm cylinder 8) having high load pressure. When the controller 30 can actuate the hydraulic actuator having high load pressure at a desired speed by using the first hydraulic oil and the third hydraulic oil, the controller 30 stops merging of the first hydraulic oil and the second hydraulic oil. As a result, in the shovel according to an embodiment of the present invention can actuate a hydraulic actuator (the arm cylinder 8) having high load pressure by using the first hydraulic oil, and can actuate a hydraulic actuator (the boom cylinder 7 and the bucket cylinder 9) having low load pressure by using the second hydraulic oil whose pressure is lower than that of the first hydraulic oil. Specifically, there is no need to actuate the hydraulic actuator having low load pressure by using the second hydraulic oil that is pressurized to the same pressure as the first hydraulic oil for merging with the first hydraulic oil. That is, there is no need to meter a flow rate of the second hydraulic oil by a metering valve in order to actuate the hydraulic actuator having low load pressure at a desired speed by using the pressurized second hydraulic oil. As a result, the shovel can reduce or prevent generation of pressure loss at the metering valve, and can reduce or prevent energy loss.

The controller 30 may increase a discharge rate of the first pump 14L by individual flow control, instead of causing the pump/motor 14A to discharge the third hydraulic oil. Specifically, after stopping the merging of the first hydraulic oil and the second hydraulic oil, the controller 30 may increase the maximum discharge rate of the first pump 14L (the maximum swash plate tilting angle) by a decreased amount of the discharge rate of the second pump 14R.

[Excavating Movement Along with an Engine-Assist by a Back-Pressure Regeneration]

Figure 8:
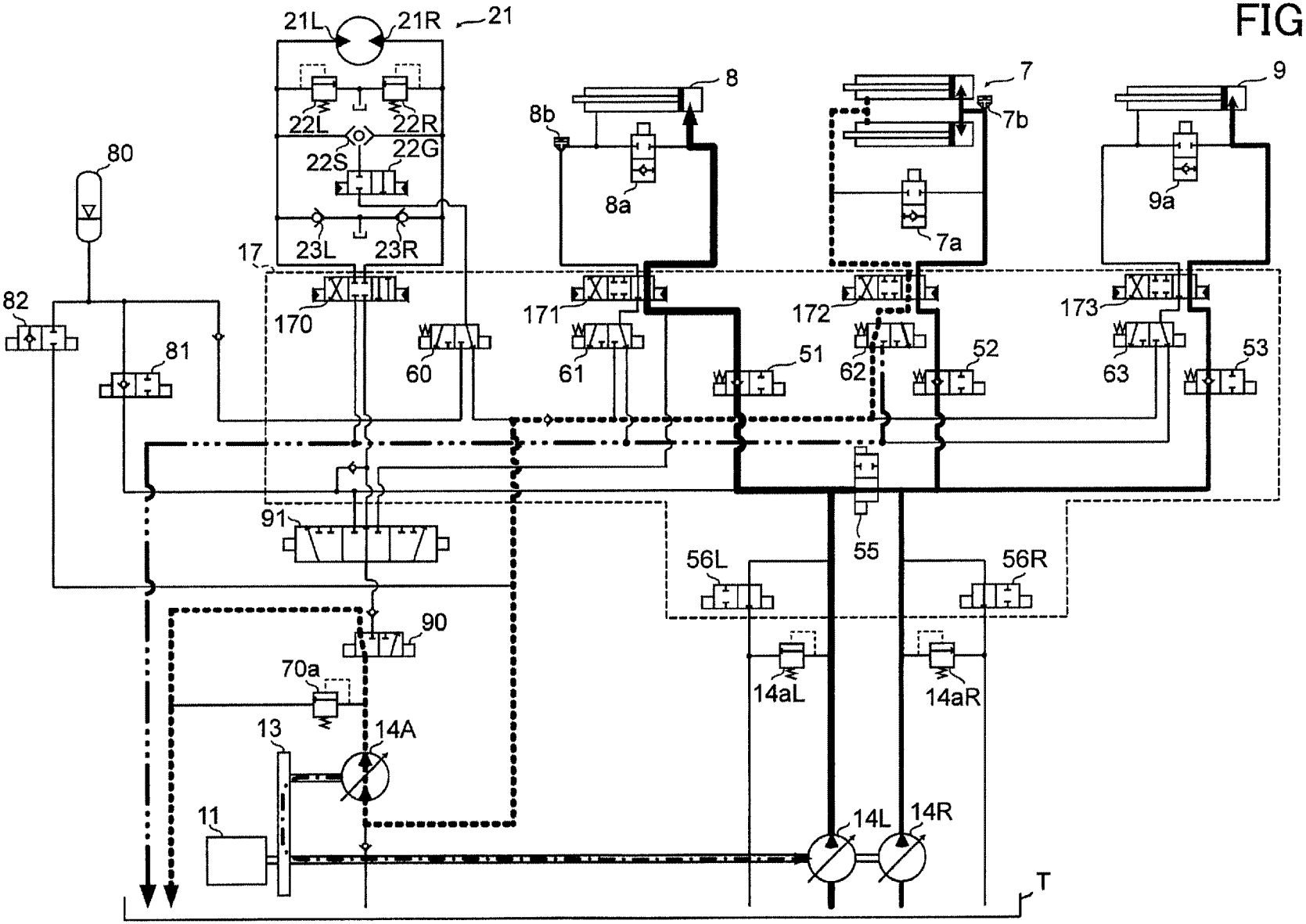
FIG. 8 shows a state of the hydraulic circuit in FIG. 2 when an excavating movement is carried out along with an engine-assist by a back-pressure regeneration.

Next, referring to FIG. 8, a state of the hydraulic circuit in FIG. 2 when an excavating movement is carried out along with an assist of the engine 11 by a back-pressure regeneration is explained. FIG. 8 shows a state of the hydraulic circuit in FIG. 2 when an excavating movement is carried out along with an assist of the engine 11 by a back-pressure regeneration. Thick solid lines in FIG. 8 depict flows of the hydraulic oil flowing into the hydraulic actuators. A width of the solid line increases with increase in flow rate. Thick dashed-three dotted lines in FIG. 8 depict flows of the hydraulic oil flowing out of the hydraulic actuators.

A back-pressure regeneration is a procedure carried out when a plurality of the hydraulic actuators are simultaneously actuated and when respective load pressure of the plurality of hydraulic actuators differ. For example, when a combined excavating movement by the boom lifting operation and the arm closing operation is carried out, a load pressure of the arm cylinder 8 (a pressure in the bottom side hydraulic chamber of the arm cylinder 8) becomes higher than a load pressure of the boom cylinder 7 (a pressure in the bottom side hydraulic chamber of the boom cylinder 7). This is because, the bucket 6 is in contact with the ground during excavation, and respective weights of the boom 4, arm 5, and bucket 6 are supported by the ground. This is also because the boom 4 bears an excavation reaction force related to an excavating movement (closing movement) of the arm 5.

Thus, when the combined excavating movement is carried out, the controller 30 increases a system pressure of the hydraulic circuit (discharge pressures of the first pump 14L and the second pump 14R) to deal with a relatively high load pressure of the arm cylinder 8. At the same time, the controller 30 controls a flow rate of the hydraulic oil flowing into the bottom side hydraulic chamber of the boom cylinder 7 in order to control an actuating speed of the boom cylinder 7 actuated by a load pressure lower than the system pressure. In this case, it results in pressure loss (energy loss) if the controller 30 controls the flow rate by metering the flow rate control valve 172. Therefore, the controller 30 realizes a control of the actuating speed of the boom cylinder 7 while preventing pressure loss at the flow rate control valve 172 by increasing a pressure (a back-pressure) in the rod side hydraulic chamber of the boom cylinder 7. At the same time, the controller 30 supplies the hydraulic oil flowing out of the rod side hydraulic chamber of the boom cylinder 7 to the pump/motor 14A and actuates the pump/motor 14A as a hydraulic (regenerative) motor in order to increase a pressure (a back-pressure) in the rod side hydraulic chamber of the boom cylinder 7. When the controller 30 executes this back-pressure regeneration, the controller 30 causes the flow rate control valve 172 to shift largely to its right position in FIG. 8 independently of an amount of operation of the boom operating lever. This is to minimize pressure loss by maximizing an opening area of the flow rate control valve 172. For example, the controller 30 assists a shift of the flow rate control valve 172 by increasing a pilot pressure acting on the pilot port of the flow rate control valve 172 by using a decompression valve (not shown).

Specifically, the controller 30 determines a content of operation of the shovel by an operator based on an output of the operation detecting part, and determines an operating state of the shovel based on an output of a load detecting part.

When the controller 30 determines that the combined excavating movement by the boom lifting operation, the arm closing operation, and the bucket closing operation is being carried out, it determines which load pressure of hydraulic actuators is minimum. Specifically, the controller 30 determines in which hydraulic actuators the energy loss (the pressure loss) becomes maximum on the condition that the controller 30 had supposedly controlled a flow rate of the hydraulic oil flowing into each of the hydraulic actuators by metering flow rate control valves.

When the controller 30 determines that a pressure (a load pressure) in the bottom side hydraulic chamber of the boom cylinder 7 is minimum, the controller 30 switches the selector valve 62 to the second position and directs the hydraulic oil flowing out of the rod side hydraulic chamber of the boom cylinder 7 to the supply side of the pump/motor 14A as shown by the thick dotted lines. Also, the controller 30 causes an opening area of the flow rate control valve 172 to become maximum by increasing a pilot pressure acting on the right side pilot port of the flow rate control valve 172 by using a decompression valve independently of an amount of operation of the boom operating lever, and reduces the pressure loss at the flow rate control valve 172. Also, the controller 30 switches the selector valve 63 to the first position and directs the hydraulic oil flowing out of the rod side hydraulic chamber of the bucket cylinder 9 to the hydraulic oil tank T.

Then, the controller 30 controls a suction amount of the hydraulic oil (a displacement volume) by the pump/motor 14A as a hydraulic motor so that an actuating speed of the boom cylinder 7 may become a speed corresponding to an amount of operation of the boom operating lever. Specifically, the controller 30 controls a displacement volume by adjusting a swash plate tilting angle of the pump/motor 14A by using the regulator. For example, when the controller 30 rotates the pump/motor 14A at a constant speed, the controller 30 can decrease a flow rate of the hydraulic oil flowing out of the rod side hydraulic chamber of the boom cylinder 7 with a decrease in the displacement volume, and can increase a pressure (a back-pressure) in the rod side hydraulic chamber of the boom cylinder 7 with a decrease in the displacement volume. By using this relationship, the controller 30 can control the back-pressure so that the back-pressure may become a level that matches a desired load pressure in the boom cylinder 7 (a desired pressure in the bottom side hydraulic chamber).

The hydraulic oil flowing out of the rod side hydraulic chamber of the boom cylinder 7 generates rotary torque by rotating the pump/motor 14A. This rotary torque is transmitted to the rotation axis of the engine 11 via the gearbox 13, and may be used as driving force for the first pump 14L and the second pump 14R. That is, the rotary torque generated by the pump/motor 14A is used for assisting rotation of the engine 11, and brings about an effect that it can reduce the load of the engine 11 and thus an amount of fuel injection. A dashed-dotted line arrow in FIG. 8 depicts that the rotary torque is transmitted to the rotation axis of the engine 11 via the gearbox 13 and can be used as driving force for the first pump 14L and the second pump 14R. As for an output control of the engine 11, a control that a transient load control (a torque based control) is applied to may preferably be used.

If the controller 30 cannot adjust an actuating speed of the boom cylinder 7 to a level corresponding to an amount of operation of the boom operating lever only by controlling the displacement volume of the pump/motor 14A, the controller 30 directs at least part of the hydraulic oil flowing out of the rod side hydraulic chamber of the boom cylinder 7 to the hydraulic oil tank T. Specifically, the controller 30 causes at least part of the hydraulic oil flowing out of the rod side hydraulic chamber of the boom cylinder 7 to flow to the hydraulic oil tank T by shifting the selector valve 62 to an intermediate position between the first position and the second position, or by completely switching the selector valve 62 to the first position. The same goes for a case where a Cylinder-to-Tank (CT) opening of the flow rate control valve 172 is large (where an amount of the boom lifting operation is large and where an operator's intention to rapidly lift the boom 4 can be inferred), or a case where a load is applied to the boom cylinder 7 and therefore there becomes no need to generate the back-pressure. The thick dashed-three dotted line in FIG. 8 depicts that the hydraulic oil flowing out of the rod side hydraulic chamber of the boom cylinder 7 flows to the hydraulic tank T when the selector valve 62 is switched to the first position.

Although the above description explains the case where it is determined that a pressure (a load pressure) in the bottom side hydraulic cylinder of the boom cylinder 7 is minimum, a similar explanation may be applied to a case where it is determined that a pressure (a load pressure) in the bottom side hydraulic chamber of the bucket cylinder 9 is minimum. Specifically, when the controller 30 determines that a pressure (a load pressure) in the bottom side hydraulic chamber of the bucket cylinder 9 is minimum, the controller 30 switches the selector valve 63 to the second position and directs the hydraulic oil flowing out of the rod side hydraulic chamber of the bucket cylinder 9 to the supply side of the pump/motor 14A. Also, the controller 30 causes an opening area of the flow rate control valve 173 to become maximum by increasing a pilot pressure acting on the right side pilot port of the flow rate control valve 173 by using a decompression valve independently of an amount of operation of the bucket operating lever, and therefore reduces pressure loss at the flow rate control valve 173. Also, the controller 30 directs the hydraulic oil flowing out of the respective rod side hydraulic chambers of the boom cylinder 7 and the arm cylinder 8 to the hydraulic oil tank T by switching each of the selector valve 61 and the selector valve 62 to the first position. An actuating speed of the bucket cylinder 9 is also controlled as in the above descriptions.

When the controller 30 determines that a pressure (a load pressure) in the bottom side hydraulic chamber of the arm cylinder 8 is minimum, the controller 30 switches the selector valve 61 to the second position and directs the hydraulic oil flowing out of the rod side hydraulic chamber of the arm cylinder 8 to the supply side of the pump/motor 14A. Also, the controller 30 causes an opening area of the flow rate control valve 171 to become maximum by increasing a pilot pressure acting on the right side pilot port of the flow rate control valve 171 by using a decompression valve independently of an amount of operation of the arm operating lever, and therefore reduces pressure loss at the flow rate control valve 171. Also, the controller 30 directs the hydraulic oil flowing out of the respective rod side hydraulic chambers of the boom cylinder 7 and the bucket cylinder 9 to the hydraulic oil tank T by switching each of the selector valve 62 and the selector valve 63 to the first position. An actuating speed of the arm cylinder 8 is also controlled as in the above descriptions.

Figure 9:
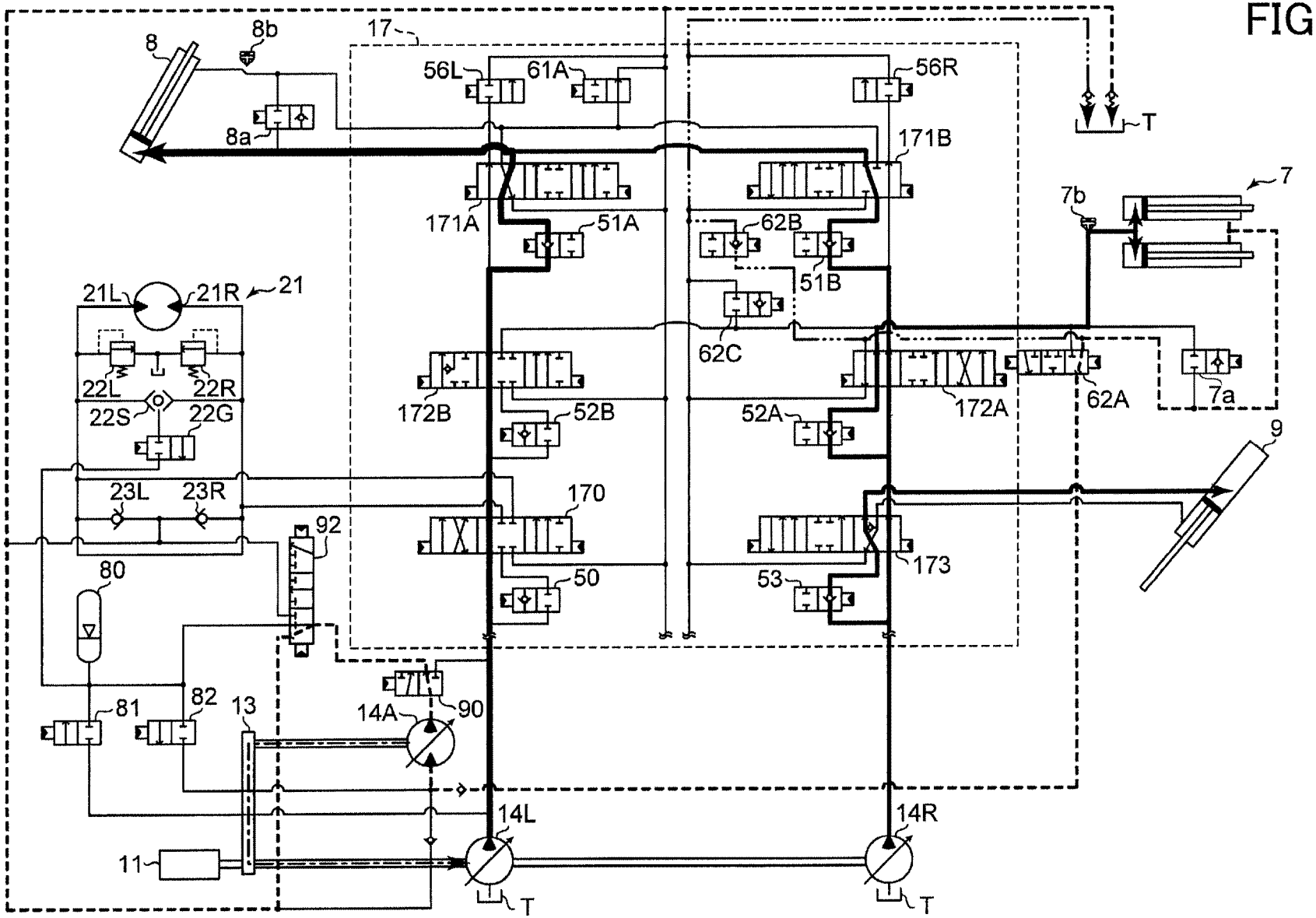
FIG. 9 shows a state of the hydraulic circuit in FIG. 3 when an excavating movement is carried out along with an engine-assist by a back-pressure regeneration.

Next, referring to FIG. 9, a state of the hydraulic circuit in FIG. 3 when an excavating movement is carried out along with an assist of the engine 11 by a back-pressure regeneration is explained. FIG. 9 shows a state of the hydraulic circuit in FIG. 3 when an excavating movement is carried out along with an assist of the engine 11 by a back-pressure regeneration. Thick solid lines in FIG. 9 depict flows of the hydraulic oil flowing into the hydraulic actuators. A width of the solid line increases with increase in flow rate. Thick dashed lines in FIG. 9 depict flows of the hydraulic oil flowing out of hydraulic actuators.

Specifically, when the controller 30 determines that the combined excavating movement by the boom lifting operation, arm closing operation, and bucket closing operation is being carried out, the controller 30 switches the selector valve 62A to the second position and directs the hydraulic oil flowing out of the rod side hydraulic chamber of the boom cylinder 7 to the supply side of the pump/motor 14A as shown by the thick dashed line. Also, the controller 30 causes an opening area of the flow rate control valve 172A to become maximum by increasing a pilot pressure acting on the left side pilot port of the flow rate control valve 172A by using a decompression valve independently of an amount of operation of the boom operating lever, and therefore reduces pressure loss at the flow rate control valve 172A. Also, the controller 30 causes the hydraulic oil flowing out of the rod side hydraulic chamber of the bucket cylinder 9 to flow to the hydraulic oil tank T through the flow rate control valve 173.

Then, the controller 30 controls a suction amount of the hydraulic oil (a displacement volume) by the pump/motor 14A as a hydraulic motor so that an actuating speed of the boom cylinder 7 may become a speed corresponding to an amount of operation of the boom operating lever.

If the controller 30 cannot adjust an actuating speed of the boom cylinder 7 to a level corresponding to an amount of operation of the boom operating lever, for example, only by controlling the displacement volume of the pump/motor 14A, the controller 30 directs at least part of the hydraulic oil flowing out of the rod side hydraulic chamber of the boom cylinder 7 to the hydraulic oil tank T. Specifically, the controller 30 causes at least part of the hydraulic oil flowing out of the rod side hydraulic chamber of the boom cylinder 7 to flow to the hydraulic oil tank T by shifting the selector valve 62B to an intermediate position between the first position and the second position, or by completely switching the selector valve 62B to the first position. The controller 30 may close the communication between the rod side hydraulic chamber of the boom cylinder 7 and the pump/motor 14A by switching the selector valve 62A to the third position (neutral position) as needed. The thick dashed-three dotted lines in FIG. 9 depict that the hydraulic oil flowing out of the rod side hydraulic chamber of the boom cylinder 7 flows to the hydraulic tank T when the selector valve 62B is switched to the first position.

As described above, the controller 30 additionally brings about following effects in addition to the effects described at [Excavating movement].

Specifically, when the boom lifting operation is carried out, the controller 30 generates a back-pressure by rotating the pump/motor 14A with the hydraulic oil flowing out of the rod side hydraulic chamber of the boom cylinder 7. Thus, the shovel according to an embodiment of the present invention can use a rotary torque obtained during generation of the back-pressure for assisting the engine 11. As a result, it can realize saving of energy by decreasing an engine power by an amount of power assisted, or faster movement and decreased cycle time by increasing a hydraulic pump power by adding an amount of power assisted to the engine power, or the like. A dashed-dotted line arrow in FIG. 9 depicts that the rotary torque is transmitted to the rotation axis of the engine 11 via the gearbox 13 and may be used as a driving force for the first pump 14L and the second pump 14R.

Also, the controller 30 does not have to meter a flow of the hydraulic oil flowing out of the rod side hydraulic chamber of the boom cylinder 7 by a metering valve in order to generate a back-pressure by rotating the pump/motor 14A, and therefore does not result in pressure loss at a metering valve, either. Thus, it reduces or prevents hydraulic energy in the hydraulic oil flowing out of the rod side hydraulic chamber of the boom cylinder 7 from being wasted as heat energy, and therefore reduces or prevents energy loss.

[Excavating Movement Along with an Accumulator-Assist]

Figure 10:
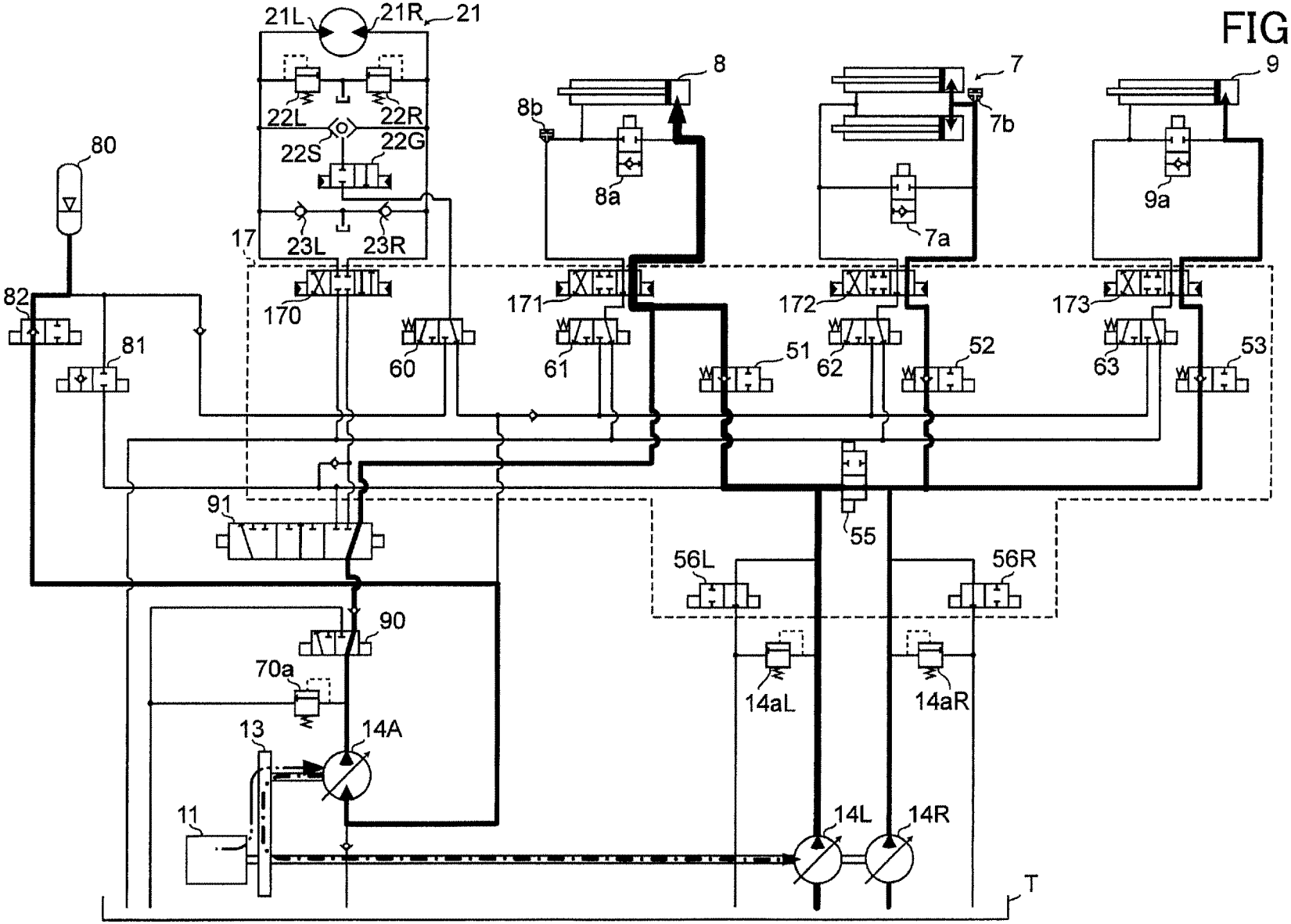
FIG. 10 shows a state of the hydraulic circuit in FIG. 2 when an excavating movement is carried out along with an accumulator-assist.

Next, referring to FIG. 10, a state of the hydraulic circuit in FIG. 2 when an excavating movement is carried out along with an accumulator-assist is explained. FIG. 10 shows a state of the hydraulic circuit in FIG. 2 when an excavating movement is carried out along with an accumulator-assist. Thick solid lines in FIG. 10 depict flows of the hydraulic oil flowing into the hydraulic actuators. A width of the solid line increases with increase in flow rate.

An accumulator assist is a procedure for assisting a movement of a hydraulic actuator by using hydraulic oil accumulated in the accumulator 80, including a case where the hydraulic actuator is actuated by using only the hydraulic oil accumulated in the accumulator 80.

Specifically, as shown in FIG. 10, when the controller 30 determines that the arm 5 has been operated, it shifts the confluence valve 55 at the second position toward the first position depending on an amount of operation of the arm operating lever. Then, it merges the first hydraulic oil and the second hydraulic oil, and supplies the first hydraulic oil and the second hydraulic oil to the flow rate control valve 171. The flow rate control valve 171 shifts to the right side position in FIG. 10 in response to a pilot pressure corresponding to an amount of operation of the arm operating lever, causes the first hydraulic oil and the second hydraulic oil to flow into the arm cylinder 8.

Then, when the controller 30 determines that the boom 4 and the bucket 6 have been operated, it determines which an excavating movement or a floor drilling movement has been carried out based on an output of the load pressure sensor.

When the controller 30 determines that an excavating movement has been carried out, the controller 30 decides a discharge rate command value for the second pump 14R corresponding to an amount of operation of the boom operating lever and an amount of operation of the bucket operating lever, based on a pump discharge rate control such as a negative control, a positive control, a load sensing control, a horsepower control, or the like. Then, the controller 30 controls a corresponding regulator so that a discharge rate of the second pump 14R can meet the command value.

Also, the controller 30 computes a flow rate difference between the maximum discharge rate of the second pump 14R and the discharge rate command value, and causes the pump/motor 14A to discharge a hydraulic oil corresponding to the flow rate difference. Specifically, the controller 30 opens the communication between the accumulator 80 and the pump/motor 14A by switching the selector valve 82 to the first position, and causes the accumulator 80 to discharge the accumulated hydraulic oil toward the pump/motor 14A.

Then, when a load pressure of the arm cylinder 8 (a pressure in the bottom side hydraulic chamber) is higher than the accumulator pressure, the controller 30 actuates the pump/motor 14A as a hydraulic pump to increase a pressure of the hydraulic oil at the supply side (accumulator pressure) up to the load pressure, and controls the corresponding regulator so that a discharge rate of the pump/motor 14A may become a level corresponding to the flow rate difference. The pump/motor 14A acting as a hydraulic pump can discharge hydraulic oil with a pump load lower than that of a case where it pumps hydraulic oil from the hydraulic oil tank T. As a result, it can reduce a load of the engine 11 and can realize saving of energy.

Also, when a load pressure of the arm cylinder 8 (a pressure in the bottom side hydraulic chamber) is lower than or equal to the accumulator pressure, the controller 30 actuates the pump/motor 14A as a hydraulic motor to decrease a pressure of the hydraulic oil at the supply side (accumulator pressure) down to the load pressure, and controls the corresponding regulator so that a discharge rate of the pump/motor 14A may become a level corresponding to the flow rate difference. The pump/motor 14A acting as a hydraulic motor can assist the engine 11 and can supply a part of a driving force for rotating the first pump 14L. As a result, the controller 30 can increase a horsepower consumed by the first pump 14L, or can reduce a load of the engine 11 and thus an amount of fuel injection when it does not increase the horsepower consumed by the first pump 14L.

A dashed-dotted line arrow in FIG. 10 depicts that a rotary torque generated by the pump/motor 14A acting as a hydraulic motor is transmitted to the rotation axis of the engine 11 via the gearbox 13, and may be used as a driving force for the first pump 14L and the second pump 14R. A dashed-two dotted line arrow depicts that the pump/motor 14A acting as a hydraulic pump uses a part of the output of the engine 11.

Then, the controller 30 switches the selector valve 90 to the first position and directs the third hydraulic oil to the selector valve 91, and switches the selector valve 91 to the first position and directs the third hydraulic oil to the arm cylinder 8.

Also, the controller 30 controls an opening area of the confluence valve 55 based on the above flow rate difference, a discharge pressure of the first pump 14L, a discharge pressure of the second pump 14R, and the like. In the example of FIG. 10, the controller 30 decides the opening area of the confluence valve 55 by reference to a predefined opening map, and outputs a command corresponding to the opening area to the confluence valve 55. The controller 30 may decide the opening area of the confluence valve 55 by using a predetermined function instead of the opening map.

When the controller 30 determines that a floor drilling movement has been carried out, the controller 30 closes the confluence valve 55 as soon as possible, as long as a movement of the shovel does not become unstable. This is to enhance operability of the boom 4 and the bucket 6 by causing only the second hydraulic oil to flow into the boom cylinder 7 and the bucket cylinder 9.

In the example of FIG. 10, the maximum discharge rate of the pump/motor 14A is less than the maximum discharge rate of the second pump 14R. Thus, when the above discharge rate difference is greater than the maximum discharge rate of the pump/motor 14A, the controller 30 actuates the pump/motor 14A acting as a hydraulic pump and the first pump 14L at the maximum discharge rate and then increases a discharge rate of the second pump 14R. This is so that a difference between the maximum discharge rate of the second pump 14R and an actual increased discharge rate may become lower than or equal to the maximum discharge rate of the pump/motor 14A, and so that an actuating speed of the arm 5 does not become lower than an actuating speed of the arm 5 when using the first hydraulic oil and the second hydraulic oil.

However, when the maximum discharge rate of the pump/motor 14A is greater than or equal to the maximum discharge rate of the second pump 14R, the controller 30 can maintain the confluence valve 55 in a closed state (the second position) during the excavating movement. This is because the actuating speed of the arm 5 when using the first hydraulic oil and the third hydraulic oil does not become lower than the actuating speed of the arm 5 when using the first hydraulic oil and the second hydraulic oil. In this case, whenever during the excavating movement, the controller 30 causes only the first hydraulic oil and the third hydraulic oil to flow into the arm cylinder 8, and causes only the second hydraulic oil to flow into the boom cylinder 7 and the bucket cylinder 9. As a result, it can completely separate the hydraulic oil for actuating the arm 5 from the hydraulic oil for actuating the boom 4 and the bucket 6, and can enhance the operability of each of them.

Figure 11:
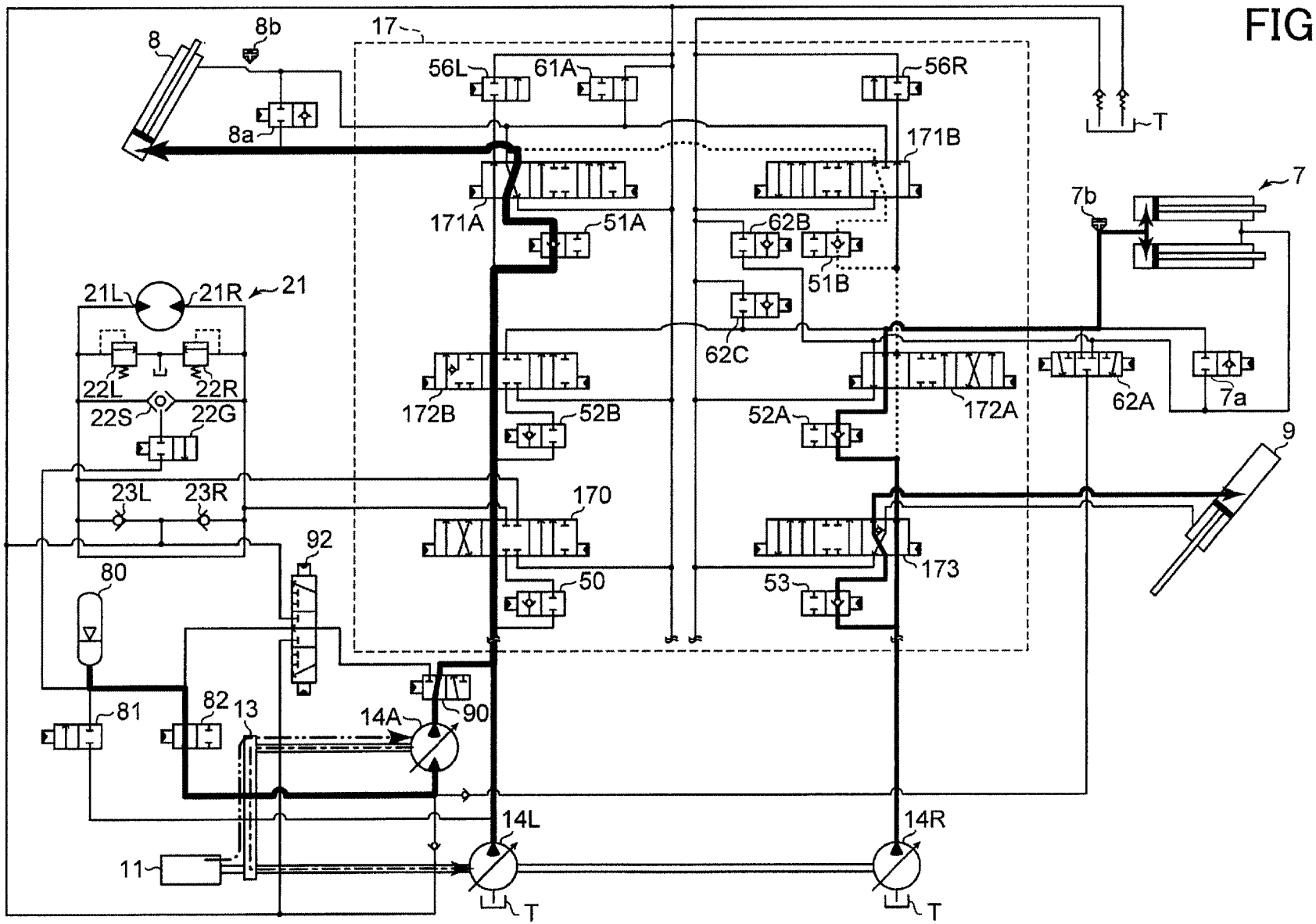
FIG. 11 shows a state of the hydraulic circuit in FIG. 3 when an excavating movement is carried out along with an accumulator-assist.

Next, referring to FIG. 11, a state of the hydraulic circuit in FIG. 3 when an excavating movement is carried out along with an accumulator assist is explained. FIG. 11 shows a state of the hydraulic circuit in FIG. 3 when an excavating movement is carried out along with an accumulator assist. Thick solid lines and dotted lines in FIG. 11 depict flows of the hydraulic oil flowing into the hydraulic actuators. A width of the solid line increases with increase in flow rate.

The dotted lines in FIG. 11 additionally depict that flows of the hydraulic oil may decrease or disappear.

Similar to the case of the hydraulic circuit in FIG. 10, the controller 30 determines a content of operation of the shovel by an operator based on an output of the operation detecting part, and determines an operating state of the shovel based on an output of the load detecting part.

When the arm 5 is operated, the flow rate control valve 171A shifts to the left side position in FIG. 11 in response to a pilot pressure generated depending on an amount of operation of the arm operating lever, and the flow rate control valve 171B shifts to the right side position in FIG. 11 in response to a pilot pressure generated depending on an amount of operation of the arm operating lever.

Then, when the controller 30 determines that the arm 5 has been operated, the controller 30 switches the variable load check valve 51A to the first position so that the first hydraulic oil may reach the flow rate control valve 171A through the variable load check valve 51A. The controller 30 also switches the variable load check valve 51B to the first position so that the second hydraulic oil may reach the flow rate control valve 171B through the variable load check valve 51B. The first hydraulic oil passing through the flow rate control valve 171A merges with the second hydraulic oil passing through the flow rate control valve 171B, and flows into the bottom side hydraulic chamber of the arm cylinder 8.

Then, when the controller 30 determines that the boom 4 and the bucket 6 have been operated, the controller 30 determines which an excavating movement or a floor drilling movement has been carried out based on an output of the load pressure sensor. Then, when the controller 30 determines that an excavating movement has been carried out, the controller 30 decides a discharge rate command value of the second pump 14R corresponding to an amount of operation of the boom operating lever and an amount of operation of the bucket operating lever. Then, the controller 30 controls a corresponding regulator so that a discharge rate of the second pump 14R can meet the command value.

In this case, the flow rate control valve 172A shifts to its left position in FIG. 11 in response to a pilot pressure generated depending on an amount of operation of the boom operating lever. The flow rate control valve 173 shifts to its right position in FIG. 11 in response to a pilot pressure generated depending on an amount of operation of the bucket operating lever. Then, the controller 30 switches the variable load check valve 52A to the first position so that the second hydraulic oil may reach the flow rate control valve 172A through the variable load check valve 52A. Similarly, the controller 30 switches the variable load check valve 53 to the first position so that the second hydraulic oil may reach the flow rate control valve 173 through the variable load check valve 53. Then, the second hydraulic oil passing through the flow rate control valve 172A flows into the bottom side hydraulic chamber of the boom cylinder 7, and the second hydraulic oil passing through the flow rate control valve 173 flows into the bottom side hydraulic chamber of the bucket cylinder 9.

The controller 30 computes a flow rate difference between the maximum discharge rate of the second pump 14R and the discharge rate command value, and causes the pump/motor 14A to discharge a hydraulic oil corresponding to the flow rate difference. Specifically, the controller 30 switches the selector valve 82 to the first position to open the communication between the accumulator 80 and the pump/motor 14A, and causes the accumulator 80 to discharge the accumulated hydraulic oil toward the pump/motor 14A.

Then, when a load pressure of the arm cylinder 8 (a pressure in the bottom side hydraulic chamber) is higher than the accumulator pressure, the controller 30 actuates the pump/motor 14A as a hydraulic pump to increase a pressure of the hydraulic oil at the supply side (accumulator pressure) up to the load pressure, and controls the corresponding regulator so that a discharge rate of the pump/motor 14A may become a level corresponding to the flow rate difference. The pump/motor 14A acting as a hydraulic pump can discharge hydraulic oil with a pump load lower than that of a case where it pumps hydraulic oil from the hydraulic oil tank T. As a result, it can reduce a load of the engine 11 and can realize saving of energy.

Also, when a load pressure of the arm cylinder 8 (a pressure in the bottom side hydraulic chamber) is lower than or equal to the accumulator pressure, the controller 30 actuates the pump/motor 14A as a hydraulic motor to decrease a pressure of the hydraulic oil at the supply side (accumulator pressure) down to the load pressure, and controls the corresponding regulator so that a discharge rate of the pump/motor 14A may become a level corresponding to the flow rate difference. The pump/motor 14A acting as a hydraulic motor can assist the engine 11 and can supply a part of a driving force for rotating the first pump 14L. As a result, the controller 30 can increase a horsepower consumed by the first pump 14L, or can reduce a load of the engine 11 and thus an amount of fuel injection when it does not increase the horsepower consumed by the first pump 14L.

A dashed-dotted line arrow in FIG. 11 depicts that the rotary torque generated by the pump/motor 14A acting as a hydraulic motor is transmitted to the rotation axis of the engine 11 via the gearbox 13 and can be used as driving force for the first pump 14L and the second pump 14R. A dashed-two dotted line arrow depicts that the pump/motor 14A acting as a hydraulic pump uses a part of the output of the engine 11.

Also, the controller 30 controls an opening area of the variable load check valve 51B based on the above flow rate difference, a discharge pressure of the first pump 14L, a discharge pressure of the second pump 14R, and the like. In the example of FIG. 11, the controller 30 decides the opening area of the variable load check valve 51B by reference to a predefined opening map, and outputs a command corresponding to the opening area to the variable load check valve 51B. As a result, the second hydraulic oil flowing into the bottom side hydraulic chamber of the arm cylinder 8 decreases or disappears. The dotted lines in FIG. 11 depict that the second hydraulic oil flowing into the bottom side hydraulic chamber of the arm cylinder 8 decreases or disappears with increase in a flow rate of the third hydraulic oil discharged from the pump/motor 14A.

As described above, the controller 30 additionally brings about following effects in addition to the effects described at [Excavating movement] and [Excavating movement along with an engine-assist by a back-pressure regeneration].

Specifically, when an excavating movement is carried out, the controller 30 supplies the hydraulic oil accumulated in the accumulator 80 to the pump/motor 14A. Then, it decides whether to actuate the pump/motor 14A as a hydraulic pump or as a hydraulic motor, and varies a discharge pressure of the third hydraulic oil discharged from the pump/motor 14A by adjusting the displacement volume of the pump/motor 14A. Thus, independently of magnitude relationship between a load pressure of a hydraulic actuator as a supply destination of the third hydraulic oil and the accumulator pressure, it can cause the third hydraulic oil to flow into the hydraulic actuator. As a result, it can flexibly control a flow rate balance of the first hydraulic oil and the third hydraulic oil, and can allow hydraulic energy accumulated in the accumulator 80 to be effectively reused.

[Excavating Movement Along with an Assist of a Hydraulic Actuator by a Back-Pressure Regeneration]

Figure 12:
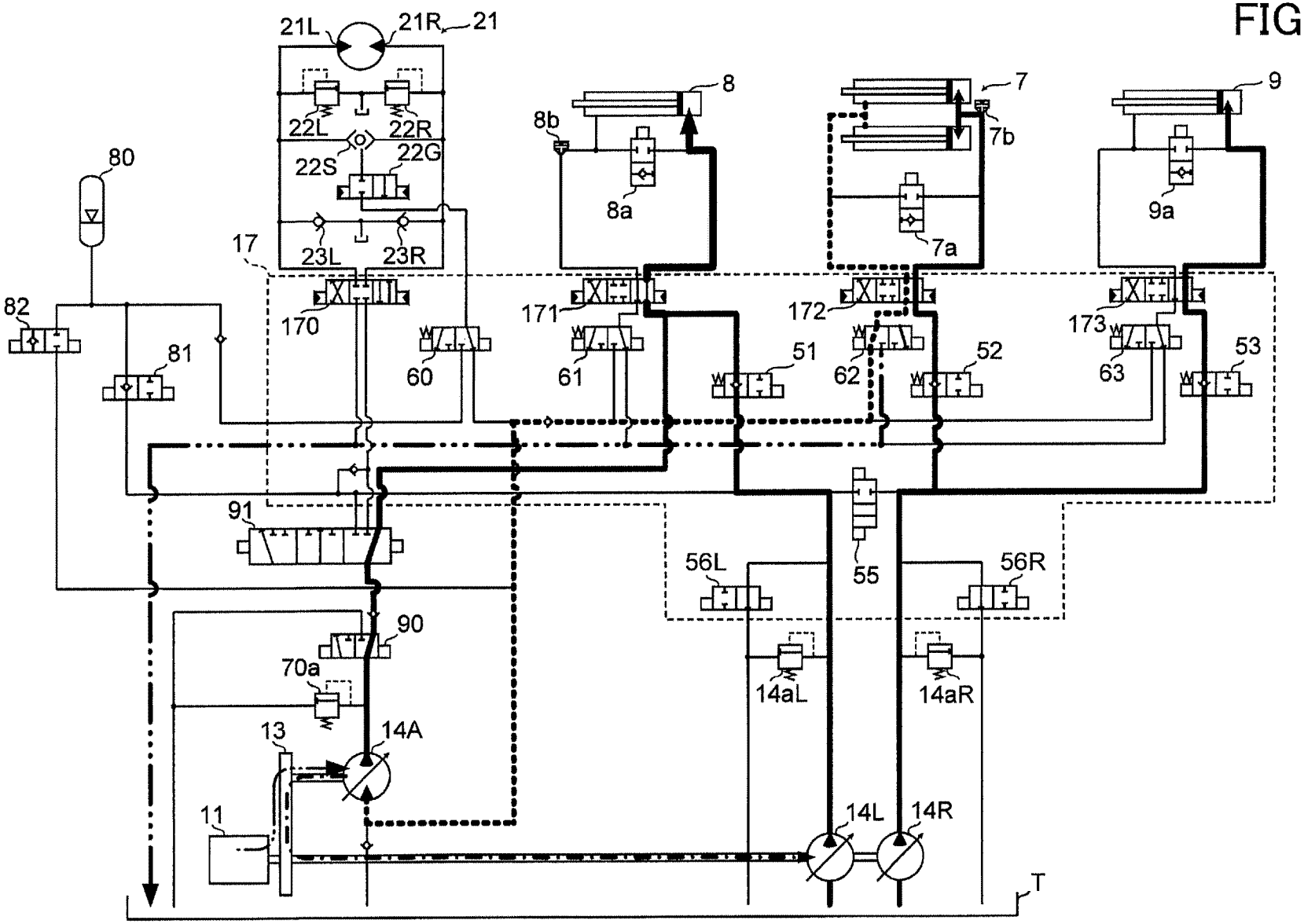
FIG. 12 shows a state of the hydraulic circuit in FIG. 2 when an excavating movement is carried out along with a hydraulic-actuator-assist by a back-pressure regeneration.

Next, referring to FIG. 12, a state of the hydraulic circuit in FIG. 2 when an excavating movement is carried out along with an assist of a hydraulic actuator by a back-pressure regeneration is explained. FIG. 12 shows a state of the hydraulic circuit in FIG. 2 when an excavating movement is carried out along with an assist of a hydraulic actuator (the arm cylinder 8) by a back-pressure regeneration. Thick solid lines in FIG. 12 depict flows of the hydraulic oil flowing into the hydraulic actuators. A width of the solid line increases with increase in flow rate. Thick dotted lines and thick dashed-three dotted lines in FIG. 12 depict flows of the hydraulic oil flowing out of the hydraulic actuators.

Specifically, when the controller 30 determines that the combined excavating movement by the boom lifting operation, the arm closing operation, and the bucket closing operation is being carried out, it determines which load pressure of hydraulic actuators is minimum. When the controller 30 determines that a pressure (a load pressure) of the bottom side hydraulic chamber of the boom cylinder 7 is minimum, it switches the selector valve 62 to the second position and directs the hydraulic oil flowing out of the rod side hydraulic chamber of the boom cylinder 7 to the supply side of the pump/motor 14A as shown by the thick dotted lines. Also, the controller 30 causes an opening area of the flow rate control valve 172 to become maximum by increasing a pilot pressure acting on the right side pilot port of the flow rate control valve 172 by using a decompression valve independently of an amount of operation of the boom operating lever, and reduces the pressure loss at the flow rate control valve 172. Also, the controller 30 switches the selector valve 63 to the first position and directs the hydraulic oil flowing out of the rod side hydraulic chamber of the bucket cylinder 9 to the hydraulic oil tank T.

Then, the controller 30 controls a suction amount of the hydraulic oil (a displacement volume) by the pump/motor 14A so that an actuating speed of the boom cylinder 7 may become a speed corresponding to an amount of operation of the boom operating lever. Specifically, when a load pressure of the arm cylinder 8 (a pressure in the bottom side hydraulic chamber) is higher than a desired back-pressure of the boom cylinder 7 (a pressure in the rod side hydraulic chamber), the controller 30 actuates the pump/motor 14A as a hydraulic pump to increase a pressure of the hydraulic oil at the supply side (a pressure in the rod side hydraulic chamber of the boom cylinder 7) up to the load pressure of the arm cylinder 8. Also, when a load pressure of the arm cylinder 8 (a pressure in the bottom side hydraulic chamber) is lower than or equal to a desired back-pressure of the boom cylinder 7, the controller 30 actuates the pump/motor 14A as a hydraulic motor to decrease a pressure of the hydraulic oil at the supply side (a pressure in the rod side hydraulic chamber of the boom cylinder 7) down to the load pressure. Then, the controller 30 controls a displacement volume of the pump/motor 14A by adjusting a swash plate tilting angle of the pump/motor 14A by using a regulator. For example, when the controller 30 rotates the pump/motor 14A at a constant speed, the controller 30 can decrease a flow rate of the hydraulic oil flowing out of the rod side hydraulic chamber of the boom cylinder 7 with a decrease in the displacement volume, and can increase a pressure (a back-pressure) in the rod side hydraulic chamber of the boom cylinder 7 with a decrease in the displacement volume. By using this relationship, the controller 30 can control the back-pressure so that the back-pressure may become a level that matches a desired load pressure in the boom cylinder 7 (a pressure in the bottom side hydraulic chamber).

The hydraulic oil flowing out of the rod side hydraulic chamber of the boom cylinder 7 generates rotary torque by rotating the pump/motor 14A acting as a hydraulic motor. This rotary torque is transmitted to the rotation axis of the engine 11 via the gearbox 13, and may be used as driving force for the first pump 14L and the second pump 14R. That is, the rotary torque generated by the pump/motor 14A is used for assisting rotation of the engine 11, and brings about an effect that it can reduce the load of the engine 11 and thus an amount of fuel injection. As for an output control of the engine 11, a control that a torque based control is applied to may preferably be used.

The pump/motor 14A acting as a hydraulic pump can discharge hydraulic oil with a pump load lower than that of a case where it pumps hydraulic oil from the hydraulic oil tank T by pumping the hydraulic oil flowing out of the rod side hydraulic chamber of the boom cylinder 7. As a result, it can reduce a load of the engine 11 and can realize saving of energy.

A dashed-dotted line arrow in FIG. 12 depicts that a rotary torque generated by the pump/motor 14A acting as a hydraulic motor is transmitted to the rotation axis of the engine 11 via the gearbox 13, and may be used as a driving force for the first pump 14L and the second pump 14R. A dashed-two dotted line arrow depicts that the pump/motor 14A acting as a hydraulic pump uses a part of the output of the engine 11.

If the controller 30 cannot adjust an actuating speed of the boom cylinder 7 to a level corresponding to an amount of operation of the boom operating lever only by controlling the displacement volume of the pump/motor 14A, the controller 30 directs at least part of the hydraulic oil flowing out of the rod side hydraulic chamber of the boom cylinder 7 to the hydraulic oil tank T. Specifically, the controller 30 causes at least part of the hydraulic oil flowing out of the rod side hydraulic chamber of the boom cylinder 7 to flow to the hydraulic oil tank T by shifting the selector valve 62 to an intermediate position between the first position and the second position, or by completely switching the selector valve 62 to the first position. The same goes for a case where a CT opening of the flow rate control valve 172 is large or a case where a load is applied to the boom cylinder 7 and therefore there becomes no need to generate the back-pressure. The thick dashed-three dotted line in FIG. 12 depicts that the hydraulic oil flowing out of the rod side hydraulic chamber of the boom cylinder 7 flows to the hydraulic tank T when the selector valve 62 is switched to the first position.

If the controller 30 cannot adjust an actuating speed of the arm cylinder 8 to a level corresponding to an amount of operation of the arm operating lever only by controlling the displacement volume of the pump/motor 14A, the controller 30 causes the second hydraulic oil discharged from the second pump 14R to flow into the arm cylinder 8 by switching the confluence valve 55 to the first position.

Although the above description explains the case where it is determined that a pressure (a load pressure) in the bottom side hydraulic cylinder of the boom cylinder 7 is minimum, a similar explanation may be applied to a case where it is determined that a pressure (a load pressure) in the bottom side hydraulic chamber of the bucket cylinder 9 is minimum. Specifically, when the controller 30 determines that a pressure (a load pressure) in the bottom side hydraulic chamber of the bucket cylinder 9 is minimum, the controller 30 switches the selector valve 63 to the second position and directs the hydraulic oil flowing out of the rod side hydraulic chamber of the bucket cylinder 9 to the supply side of the pump/motor 14A. Also, the controller 30 causes an opening area of the flow rate control valve 173 to become maximum by increasing a pilot pressure acting on the right side pilot port of the flow rate control valve 173 by using a decompression valve independently of an amount of operation of the bucket operating lever, and therefore reduces pressure loss at the flow rate control valve 173. Also, the controller 30 directs the hydraulic oil flowing out of the respective rod side hydraulic chambers of the boom cylinder 7 and the arm cylinder 8 to the hydraulic oil tank T by switching each of the selector valve 61 and the selector valve 62 to the first position. An actuating speed of the bucket cylinder 9 is also controlled as in the above descriptions.

When the controller 30 determines that a pressure (a load pressure) in the bottom side hydraulic chamber of the arm cylinder 8 is minimum, the controller 30 switches the selector valve 61 to the second position and directs the hydraulic oil flowing out of the rod side hydraulic chamber of the arm cylinder 8 to the supply side of the pump/motor 14A. Also, the controller 30 causes an opening area of the flow rate control valve 171 to become maximum by increasing a pilot pressure acting on the right side pilot port of the flow rate control valve 171 by using a decompression valve independently of an amount of operation of the arm operating lever, and therefore reduces pressure loss at the flow rate control valve 171. Also, the controller 30 directs the hydraulic oil flowing out of the respective rod side hydraulic chambers of the boom cylinder 7 and the bucket cylinder 9 to the hydraulic oil tank T by switching each of the selector valve 62 and the selector valve 63 to the first position. An actuating speed of the arm cylinder 8 is also controlled as in the above descriptions.

Figure 13:
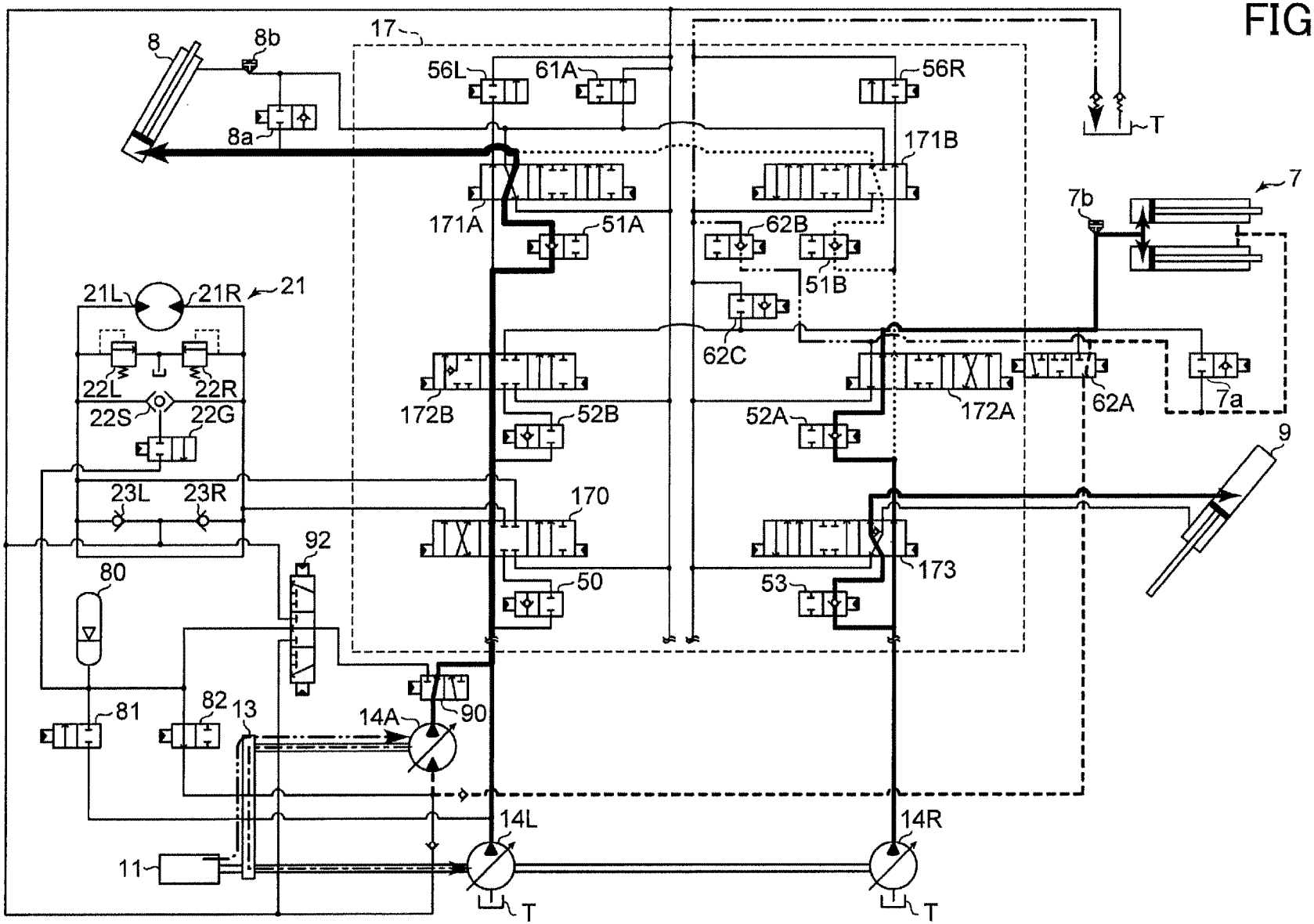
FIG. 13 shows a state of the hydraulic circuit in FIG. 3 when an excavating movement is carried out along with a hydraulic-actuator-assist by a back-pressure regeneration.

Next, referring to FIG. 13, a state of the hydraulic circuit in FIG. 3 when an excavating movement is carried out along with an assist of a hydraulic actuator by a back-pressure regeneration is explained. FIG. 13 shows a state of the hydraulic circuit in FIG. 3 when an excavating movement is carried out along with an assist of a hydraulic actuator (the arm cylinder 8) by a back-pressure regeneration. Thick solid lines and dotted lines in FIG. 13 depict flows of the hydraulic oil flowing into the hydraulic actuators. A width of the solid line increases with increase in flow rate. Thick dashed lines and thick dashed-three dotted lines in FIG. 13 depict flows of the hydraulic oil flowing out of the hydraulic actuators. The thick dashed-three dotted lines and the dotted lines in FIG. 13 additionally depict that flows of the hydraulic oil may decrease or disappear.

Specifically, when the controller 30 determines that the combined excavating movement by the boom lifting operation, the arm closing operation, and the bucket closing operation is being carried out, the controller 30 switches the selector valve 62A to the second position and directs the hydraulic oil flowing out of the rod side hydraulic chamber of the boom cylinder 7 to the supply side of the pump/motor 14A as shown by the thick dashed line. Also, the controller 30 causes an opening area of the flow rate control valve 172A to become maximum by increasing a pilot pressure acting on the left side pilot port of the flow rate control valve 172A by using a decompression valve independently of an amount of operation of the boom operating lever, and therefore reduces pressure loss at the flow rate control valve 172A. Also, the controller 30 causes the hydraulic oil flowing out of the rod side hydraulic chamber of the bucket cylinder 9 to flow to the hydraulic oil tank T through the flow rate control valve 173.

Then, the controller 30 controls a suction amount of the hydraulic oil (a displacement volume) by the pump/motor 14A so that an actuating speed of the boom cylinder 7 may become a speed corresponding to an amount of operation of the boom operating lever. Specifically, when a load pressure of the arm cylinder 8 (a pressure in the bottom side hydraulic chamber) is higher than a desired back-pressure of the boom cylinder 7 (a pressure in the rod side hydraulic chamber), the controller 30 actuates the pump/motor 14A as a hydraulic pump to increase a pressure of the hydraulic oil at the supply side (a pressure in the rod side hydraulic chamber of the boom cylinder 7) up to the load pressure of the arm cylinder 8. Also, when a load pressure of the arm cylinder 8 (a pressure in the bottom side hydraulic chamber) is lower than or equal to a desired back-pressure of the boom cylinder 7, the controller 30 actuates the pump/motor 14A as a hydraulic motor to decrease a pressure of the hydraulic oil at the supply side (a pressure in the rod side hydraulic chamber of the boom cylinder 7) down to the load pressure. Then, the controller 30 controls a displacement volume of the pump/motor 14A by adjusting a swash plate tilting angle of the pump/motor 14A by using a regulator.

A dashed-dotted line arrow in FIG. 13 depicts that a rotary torque generated by the pump/motor 14A acting as a hydraulic motor is transmitted to the rotation axis of the engine 11 via the gearbox 13, and may be used as a driving force for the first pump 14L and the second pump 14R. A dashed-two dotted line arrow depicts that the pump/motor 14A acting as a hydraulic pump uses a part of the output of the engine 11.

If the controller 30 cannot adjust an actuating speed of the boom cylinder 7 to a level corresponding to an amount of operation of the boom operating lever, for example, only by controlling the displacement volume of the pump/motor 14A, the controller 30 directs at least part of the hydraulic oil flowing out of the rod side hydraulic chamber of the boom cylinder 7 to the hydraulic oil tank T. Specifically, the controller 30 causes at least part of the hydraulic oil flowing out of the rod side hydraulic chamber of the boom cylinder 7 to flow to the hydraulic oil tank T by shifting the selector valve 62B to an intermediate position between the first position and the second position, or by completely switching the selector valve 62B to the first position. The controller 30 may close the communication between the rod side hydraulic chamber of the boom cylinder 7 and the pump/motor 14A by switching the selector valve 62A to the third position (neutral position) as needed. The thick dashed-three dotted lines in FIG. 13 depict that the hydraulic oil flowing out of the rod side hydraulic chamber of the boom cylinder 7 flows to the hydraulic tank T when the selector valve 62B is switched to the first position.

Also, in a case where it is possible to control an actuating speed of the arm cylinder 8 to a level corresponding to an amount of operation of the arm operating lever by controlling a displacement volume of the pump/motor 14A, the controller 30 may block the second hydraulic oil from flowing into the arm cylinder 8 by switching the variable load check valve 51B to the second position. The thick dotted line in FIG. 13 depicts that the second hydraulic oil is blocked from flowing into the arm cylinder 8 when the variable load check valve 51B is switched to the second position.

As described above, the controller 30 additionally brings about following effects in addition to the effects described at

[Excavating movement] and [Excavating movement along with an engine-assist by a back-pressure regeneration].

Specifically, when an excavating movement is carried out, the controller 30 supplies the hydraulic oil flowing out of the rod side hydraulic chamber of the boom cylinder 7 to the pump/motor 14A. Then, it decides whether to actuate the pump/motor 14A as a hydraulic pump or as a hydraulic motor, and varies a discharge pressure of the third hydraulic oil discharged from the pump/motor 14A by adjusting the displacement volume of the pump/motor 14A. Thus, independently of magnitude relationship between a load pressure of a hydraulic actuator as a supply destination of the third hydraulic oil and a desired back-pressure in the rod side hydraulic chamber of the boom cylinder 7, it can cause the third hydraulic oil to flow into the hydraulic actuator. As a result, it can flexibly control a flow rate balance of the first hydraulic oil and the third hydraulic oil, and can allow regenerated energy to be effectively reused.

[Earth Removing Movement Along with an Engine-Assist by a Back-Pressure Regeneration]

Figure 14:
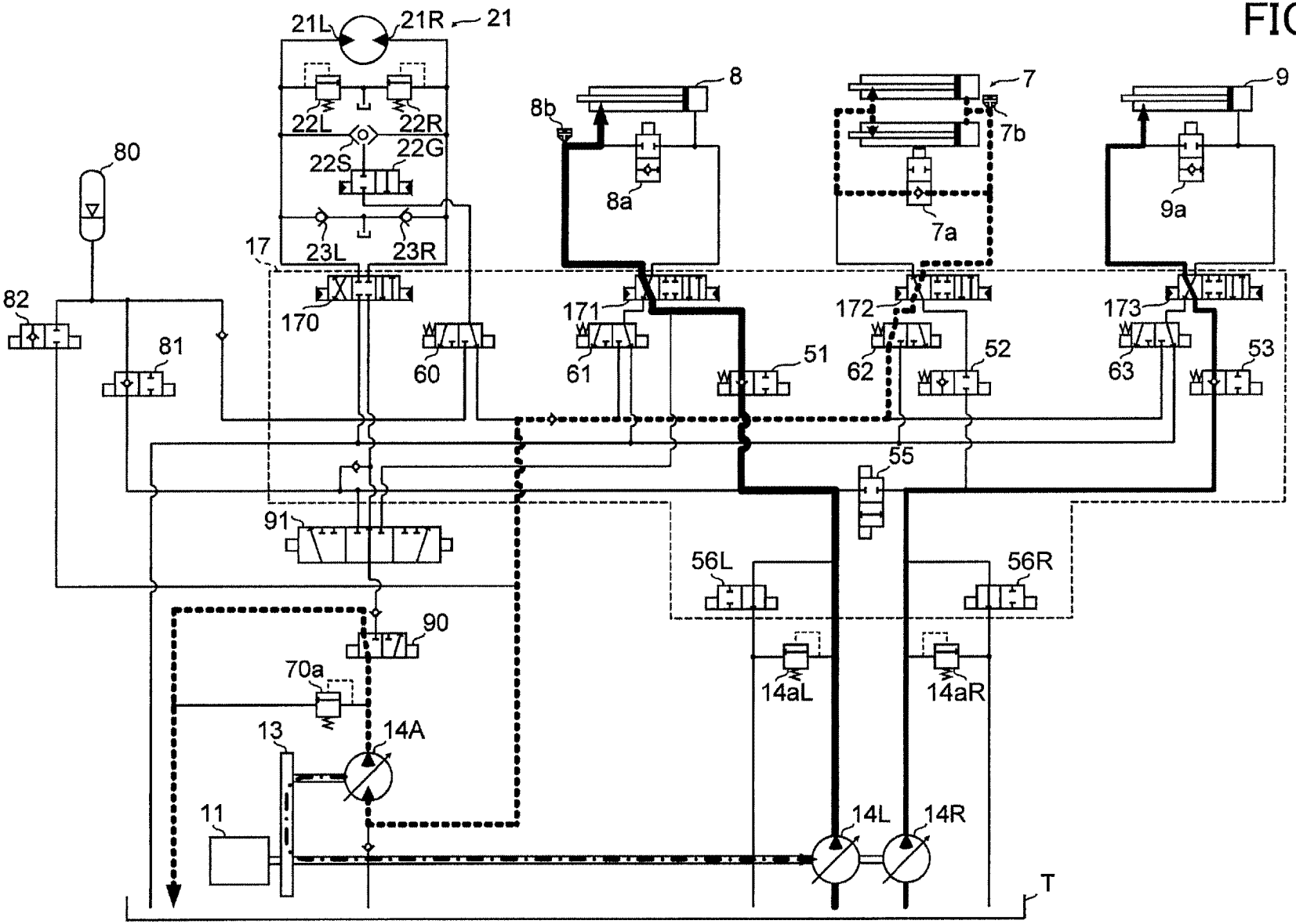
FIG. 14 shows a state of the hydraulic circuit in FIG. 2 when an earth removing movement is carried out along with an engine-assist by a back-pressure regeneration.

Next, referring to FIG. 14, a state of the hydraulic circuit in FIG. 2 when an earth removing movement is carried out along with an assist of the engine 11 by a back-pressure regeneration is explained. FIG. 14 shows a state of the hydraulic circuit in FIG. 2 when an earth removing movement is carried out along with an assist of the engine 11 by a back-pressure regeneration. Thick solid lines in FIG. 14 depict flows of the hydraulic oil flowing into the hydraulic actuators. A width of the solid line increases with increase in flow rate. Thick dotted lines in FIG. 14 depict flows of the hydraulic oil flowing out of the hydraulic actuators.

An earth removing movement is a movement including a boom lowering, an arm opening, and a bucket opening. The boom 4 lowers under its own weight. A lowering speed of the boom 4 is controlled by adjusting a flow rate of the hydraulic oil flowing out of the bottom side hydraulic chamber of the boom cylinder 7. Specifically, the lowering speed of the boom 4 increases with increase in a flow rate of the hydraulic oil flowing out of the bottom side hydraulic chamber.

When the boom lowering operation is carried out, the flow rate control valve 172 shifts to the left position in FIG. 14 in response to a pilot pressure generated depending on an amount of operation of the boom operating lever. Also, when the arm opening operation is carried out, the flow rate control valve 171 shifts to the left position in FIG. 14 in response to a pilot pressure generated depending on an amount of operation of the arm operating lever, and when the bucket opening operation is carried out, the flow rate control valve 173 shifts to the left position in FIG. 14 in response to a pilot pressure generated depending on an amount of operation of the bucket operating lever.

Then, when the controller 30 determines that the boom lowering operation has been carried out, the controller 30 causes the hydraulic oil flowing out of the bottom side hydraulic chamber of the boom cylinder 7 to flow into the rod side hydraulic chamber of the boom cylinder 7 by maximizing an opening area of the regeneration valve 7*a* as shown in FIG. 14.

When the opening area of the regeneration valve 7*a* becomes maximum, a pressure in the bottom side hydraulic chamber of the boom cylinder 7 is directly applied to the rod side hydraulic chamber. Thus, the pressure in the bottom side hydraulic chamber further increases and may exceed the relief pressure of the relief valve located in the control valve 17. Therefore, when the pressure in the bottom side hydraulic chamber of the boom cylinder 7 has come close to the relief pressure, the controller 30 decreases an opening area of the regeneration valve 7*a* so that the pressure in the bottom side hydraulic chamber may not exceed the relief pressure.

Also, the controller 30 switches the selector valve 62 to the second position, and directs the hydraulic oil flowing out of the bottom side hydraulic chamber of the boom cylinder 7 to the supply side of the pump/motor 14A as shown by the thick dotted line. Also, the controller 30 causes an opening area of the flow rate control valve 172 to become maximum by increasing a pilot pressure acting on the left side pilot port of the flow rate control valve 172 by using a decompression valve independently of an amount of operation of the boom operating lever, and reduces the pressure loss at the flow rate control valve 172. Also, the controller 30 switches the variable load check valve 52 to the second position and closes the communication between the second pump 14R and the flow rate control valve 172.

Also, the controller 30 controls a discharge rate of the pump/motor 14A depending on an amount of operation of the boom operating lever and an opening area of the regeneration valve 7*a*. Specifically, the controller 30 actuates the pump/motor 14A as a hydraulic motor and controls a displacement volume of the pump/motor 14A by controlling a corresponding regulator so that a pressure in the bottom side hydraulic chamber of the boom cylinder 7 may not change suddenly or not exceed the relief pressure. Then, the controller 30 causes the third hydraulic oil discharged from the pump/motor 14A to flow to the hydraulic oil tank T by switching the selector valve 90 to the second position.

Also, the controller 30 maintains the confluence valve 55 in the state of the second position so that the first hydraulic oil and the second hydraulic oil may not merge and thus so that respective movements of the arm cylinder 8 and the bucket cylinder 9 are independently controlled by separate hydraulic oil. In this case, a flow rate of the hydraulic oil flowing into the rod side hydraulic chamber of the arm cylinder 8 can be directly controlled by the first pump 14L. Thus, the flow rate does not need to be controlled by an aperture at the flow rate control valve 171. Similarly, a flow rate of the hydraulic oil flowing into the rod side hydraulic chamber of the bucket cylinder 9 can be directly controlled by the second pump 14R. Thus, the flow rate does not need to be controlled by an aperture at the flow rate control valve 173. Therefore, as in the case of the flow rate control valve 172 corresponding to the boom cylinder 7, the controller 30 may cause opening areas of the flow rate control valves 171, 173 to become maximum by increasing pilot pressures acting on the left side pilot ports of the flow rate control valves 171, 173 by using decompression valves, and thus may reduce the pressure loss at the flow rate control valves 171, 173. When an earth removing movement with the arm opening operation and the bucket opening operation is carried out, the arm operating lever and the bucket operating lever are typically operated at full lever (for example, an amount of operation greater than or equal to 80% under the assumption that a neutral state of a lever correspond to 0% and the maximally operated state corresponds to 100%). Thus, both opening areas of the flow rate control valves 171, 173 become maximum.

Also, the hydraulic oil flowing out of the bottom side hydraulic chamber of the boom cylinder 7 generates a rotary torque by rotating the pump/motor 14A. As shown by the dashed-dotted line arrow in FIG. 14, this rotary torque is transmitted to the rotation axis of the engine 11 via the gearbox 13, and may be used as driving force for the first pump 14L and the second pump 14R. That is, the rotary torque generated by the pump/motor 14A is used for assisting rotation of the engine 11, and brings about an effect that it can reduce the load of the engine 11 and thus an amount of fuel injection.

If the controller 30 cannot adjust an actuating speed of the boom cylinder 7 to a level corresponding to an amount of operation of the boom operating lever only by controlling the displacement volume of the pump/motor 14A, the controller 30 directs at least part of the hydraulic oil flowing out of the bottom side hydraulic chamber of the boom cylinder 7 to the hydraulic oil tank T. Specifically, the controller 30 causes at least part of the hydraulic oil flowing out of the bottom side hydraulic chamber of the boom cylinder 7 to flow to the hydraulic oil tank T by shifting the selector valve 62 to an intermediate position between the first position and the second position, or by completely switching the selector valve 62 to the first position.

Figure 15:
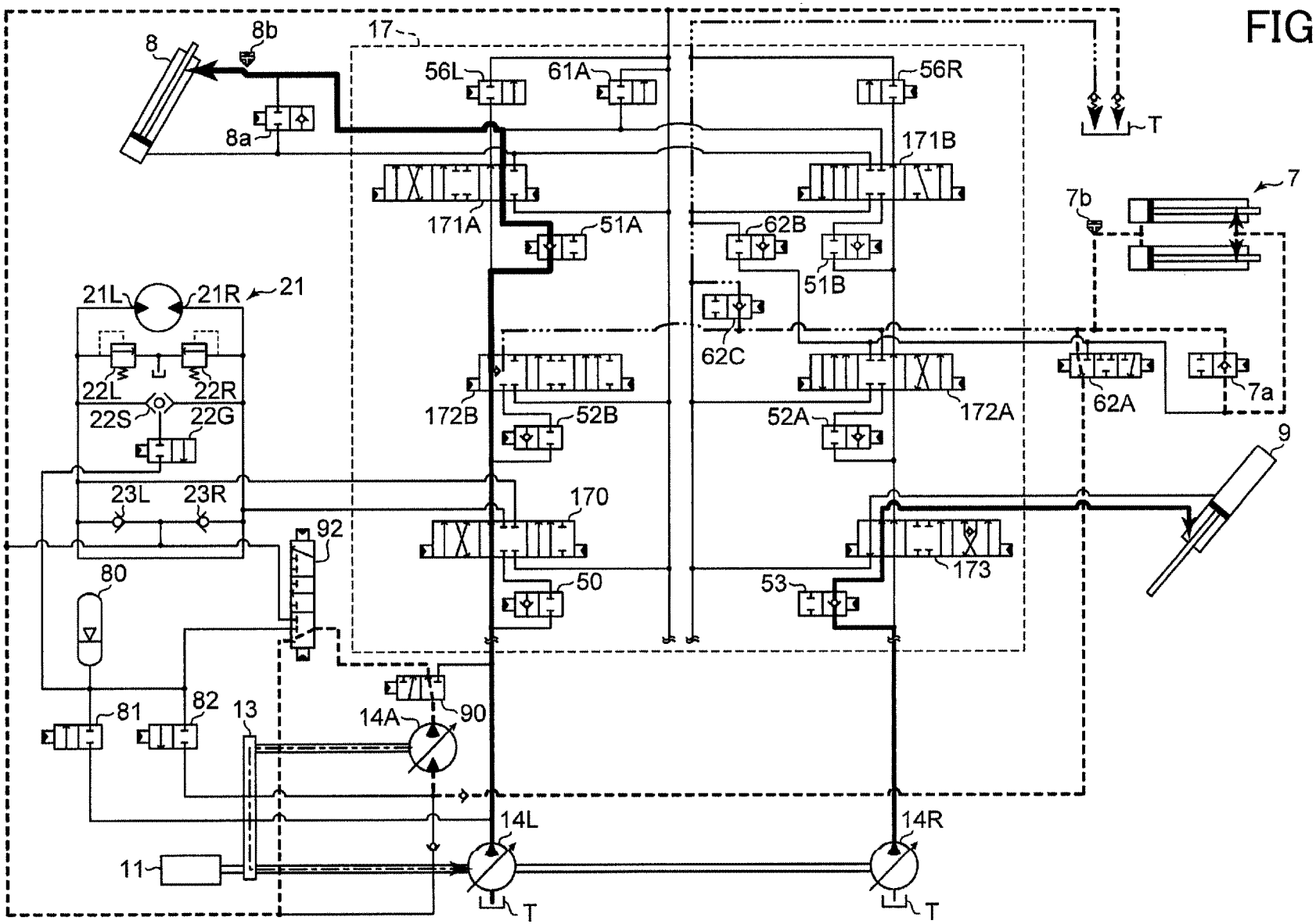
FIG. 15 shows a state of the hydraulic circuit in FIG. 3 when an earth removing movement is carried out along with an engine-assist by a back-pressure regeneration.

Next, referring to FIG. 15, a state of the hydraulic circuit in FIG. 3 when an earth removing movement is carried out along with an assist of the engine 11 by a back-pressure regeneration is explained. FIG. 15 shows a state of the hydraulic circuit in FIG. 3 when an earth removing movement is carried out along with an assist of the engine 11 by a back-pressure regeneration. Thick solid lines in FIG. 15 depict flows of the hydraulic oil flowing into the hydraulic actuators. A width of the solid line increases with increase in flow rate. Thick dashed lines and thick dashed-three dotted lines in FIG. 15 depict flows of the hydraulic oil flowing out of the hydraulic actuators.

Specifically, when the controller determines that the boom lowering operation has been carried out, the controller 30 causes the hydraulic oil flowing out of the bottom side hydraulic chamber of the boom cylinder 7 to flow into the rod side hydraulic chamber of the boom cylinder 7 by maximizing an opening area of the regeneration valve 7*a*. Also, the controller 30 switches the selector valve 62A to the first position and directs the hydraulic oil flowing out of the bottom side hydraulic chamber of the boom cylinder 7 to the supply side of the pump/motor 14A. Also, the controller 30 shifts the flow rate control valve 172A to its neutral position by decreasing a pilot pressure acting on the right side pilot port of the flow rate control valve 172A by using a decompression valve independently of an amount of operation of the boom operating lever and thus blocks a flow of the hydraulic oil flowing from the bottom side hydraulic chamber of the boom cylinder 7 through the flow rate control valve 172A toward the hydraulic oil tank T. Also, the controller 30 switches the variable load check valve 52A to the second position and closes the communication between the second pump 14R and the flow rate control valve 172A.

Also, when the arm opening operation is carried out, the flow rate control valve 171A shifts to the right position in FIG. 15 in response to a pilot pressure generated depending on an amount of operation of the arm operating lever. Also, when the bucket opening operation is carried out, the flow rate control valve 173 shifts to the left position in FIG. 15 in response to a pilot pressure generated depending on an amount of operation of the bucket operating lever.

Also, when the controller 30 determines that the arm opening operation has been carried out, the controller 30 switches the variable load check valve 51A to the first position and opens the communication between the first pump 14L and the flow rate control valve 171A. Also, when the controller 30 determines that the bucket opening operation has been carried out, the controller 30 switches the variable load check valve 53 to the first position and opens the communication between the second pump 14R and the flow rate control valve 173.

Also, the controller 30 controls a discharge rate of the pump/motor 14A depending on an amount of operation of the boom operating lever and an opening area of the regeneration valve 7*a*. Specifically, the controller 30 actuates the pump/motor 14A as a hydraulic motor and controls a displacement volume of the pump/motor 14A by controlling a corresponding regulator so that a pressure in the bottom side hydraulic chamber of the boom cylinder 7 may not change suddenly. Then, the controller 30 causes the third hydraulic oil discharged from the pump/motor 14A to flow to the hydraulic oil tank T by switching the selector valve 90 to the second position and by switching the selector valve 92 to the third position.

Also, the controller 30 maintains the variable load check valve 51B in the state of the second position so that the first hydraulic oil and the second hydraulic oil may not merge and thus so that respective movements of the arm cylinder 8 and the bucket cylinder 9 are independently controlled by separate hydraulic oil. In this case, a flow rate of the hydraulic oil flowing into the rod side hydraulic chamber of the arm cylinder 8 can be directly controlled by the first pump 14L. Thus, the flow rate does not need to be controlled by an aperture at the flow rate control valve 171A. Similarly, a flow rate of the hydraulic oil flowing into the rod side hydraulic chamber of the bucket cylinder 9 can be directly controlled by the second pump 14R. Thus, the flow rate does not need to be controlled by an aperture at the flow rate control valve 173. Therefore, as in the case of the flow rate control valve 172A corresponding to the boom cylinder 7, the controller 30 may cause an opening area of the flow rate control valves 171A to become maximum by increasing a pilot pressure acting on the right side pilot port of the flow rate control valve 171A by using a decompression valve, may cause an opening area of the flow rate control valves 173 to become maximum by increasing a pilot pressure acting on the left side pilot port of the flow rate control valve 173 by using a decompression valve, and thus may reduce the pressure loss at the flow rate control valves 171A, 173.

Also, the hydraulic oil flowing out of the bottom side hydraulic chamber of the boom cylinder 7 generates a rotary torque by rotating the pump/motor 14A. As shown by the dashed-dotted line arrow in FIG. 15, this rotary torque is transmitted to the rotation axis of the engine 11 via the gearbox 13, and may be used as driving force for the first pump 14L and the second pump 14R. That is, the rotary torque generated by the pump/motor 14A is used for assisting rotation of the engine 11, and brings about an effect that it can reduce the load of the engine 11 and thus an amount of fuel injection.

If the controller 30 cannot adjust an actuating speed of the boom cylinder 7 to a level corresponding to an amount of operation of the boom operating lever only by controlling the displacement volume of the pump/motor 14A, the controller 30 directs at least part of the hydraulic oil flowing out of the bottom side hydraulic chamber of the boom cylinder 7 to the hydraulic oil tank T. Specifically, the controller 30 causes at least part of the hydraulic oil flowing out of the bottom side hydraulic chamber of the boom cylinder 7 to flow to the hydraulic oil tank T by shifting the selector valve 62C to an intermediate position between the first position and the second position, or by completely switching the selector valve 62C to the first position.

Also, the controller 30 may shift the flow rate control valve 172B to the left position in FIG. 15 by increasing a pilot pressure acting on the left side pilot port of the flow rate control valve 172B by using a decompression valve independently of an amount of operation of the boom operating lever, and thus may merge the hydraulic oil flowing out of the bottom side hydraulic chamber of the boom cylinder 7 into the first hydraulic oil.

Thick dashed-three dotted lines in FIG. 15 depict that the hydraulic oil flowing out of the bottom side hydraulic chamber of the boom cylinder 7 is discharged into the hydraulic oil tank T when the selector valve 62C is shifted toward the first position, and that the hydraulic oil flowing out of the bottom side hydraulic chamber of the boom cylinder 7 merges into the first hydraulic oil at the flow rate control valve 172B when the flow rate control valve 172B is shifted to the left position.

As described above, when the boom lowering operation has been carried out, the controller 30 generates a back-pressure by rotating the pump/motor 14A with the hydraulic oil flowing out of the bottom side hydraulic chamber of the boom cylinder 7. Thus, the shovel according to an embodiment of the present invention can use hydraulic energy obtained during generation of the back-pressure for assisting the engine 11. As a result, it can realize saving of energy by decreasing an engine power by an amount of power assisted, or faster movement and decreased cycle time by increasing a hydraulic pump power by adding an amount of power assisted to the engine power, or the like.

Also, the controller 30 generates the back-pressure by rotating the pump/motor 14A. Thus, there is no need to meter a flow of the hydraulic oil flowing out of the bottom side hydraulic chamber of the boom cylinder 7 by a metering valve, and thus the controller 30 does not generate pressure loss at a metering valve. Thus, it reduces or prevents potential energy of the boom 4 from being wasted as heat energy, and therefore reduces or prevents energy loss.

Also, even if the boom lowering operation, the arm opening operation, and the bucket opening operation have been carried out simultaneously, the controller 30 independently controls respective movements of the arm cylinder 8 and the bucket cylinder 9 by separate hydraulic oil without merging of the first hydraulic oil and the second hydraulic oil. Thus, one of the flow rate of the first hydraulic oil required to activate the arm cylinder 8 and the flow rate of the second hydraulic oil required to activate the bucket cylinder 9 is not affected by the other. As a result, it can prevent a hydraulic pump from discharging excessive hydraulic oil.

[Earth Removing Movement Along with a Hydraulic-Actuator-Assist by a Back-Pressure Regeneration]

Figure 16:
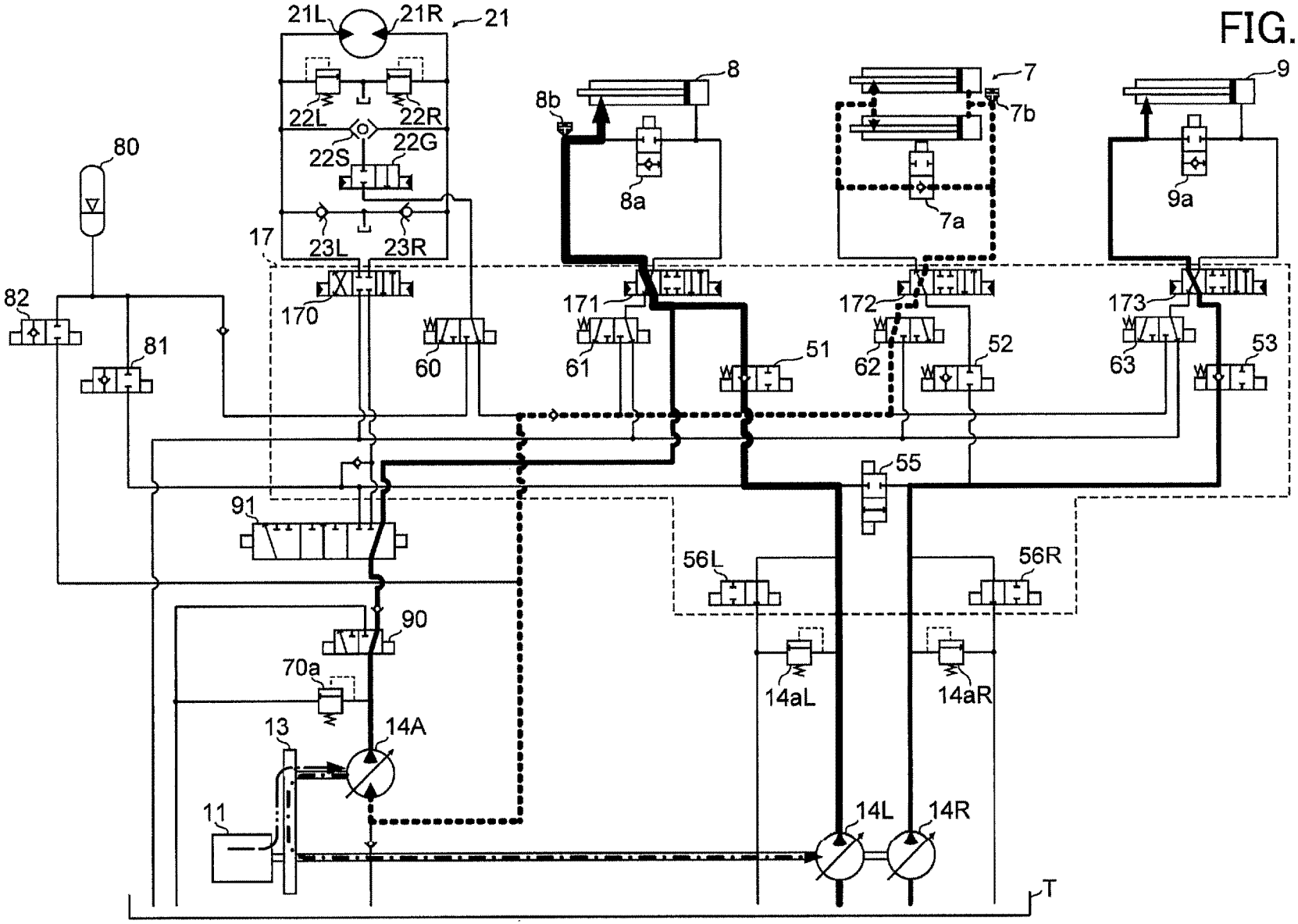
FIG. 16 shows a state of the hydraulic circuit in FIG. 2 when an earth removing movement is carried out along with a hydraulic-actuator-assist by a back-pressure regeneration.

Next, referring to FIG. 16, a state of the hydraulic circuit in FIG. 2 when an earth removing movement is carried out along with a hydraulic-actuator-assist by a back-pressure regeneration is explained. FIG. 16 shows a state of the hydraulic circuit in FIG. 2 when an earth removing movement is carried out along with an assist of a hydraulic actuator (the arm cylinder 8) by a back-pressure regeneration. Thick solid lines in FIG. 16 depict flows of the hydraulic oil flowing into the hydraulic actuators. A width of the solid line increases with increase in flow rate. Thick dotted lines in FIG. 16 depict a flow of the hydraulic oil flowing out of the hydraulic actuator.

When the boom lowering operation is carried out, the flow rate control valve 172 shifts to the left position in FIG. 16 in response to a pilot pressure generated depending on an amount of operation of the boom operating lever. Also, when the arm opening operation is carried out, the flow rate control valve 171 shifts to the left position in FIG. 16 in response to a pilot pressure generated depending on an amount of operation of the arm operating lever, and when the bucket opening operation is carried out, the flow rate control valve 173 shifts to the left position in FIG. 16 in response to a pilot pressure generated depending on an amount of operation of the bucket operating lever.

Then, when the controller 30 determines that the boom lowering operation has been carried out, the controller 30 causes the hydraulic oil flowing out of the bottom side hydraulic chamber of the boom cylinder 7 to flow into the rod side hydraulic chamber of the boom cylinder 7 by maximizing an opening area of the regeneration valve 7*a* as shown by the thick dotted line.

Also, the controller 30 switches the selector valve 62 to the second position, and directs the hydraulic oil flowing out of the bottom side hydraulic chamber of the boom cylinder 7 to the supply side of the pump/motor 14A as shown by the thick dotted line. Also, the controller 30 causes an opening area of the flow rate control valve 172 to become maximum by increasing a pilot pressure acting on the left side pilot port of the flow rate control valve 172 by using a decompression valve independently of an amount of operation of the boom operating lever, and thus reduces the pressure loss at the flow rate control valve 172. Also, the controller 30 switches the variable load check valve 52 to the second position and closes the communication between the second pump 14R and the flow rate control valve 172.

Also, the controller 30 controls a discharge rate of the pump/motor 14A depending on an amount of operation of the boom operating lever and an opening area of the regeneration valve 7*a*. Specifically, when a load pressure of the arm cylinder 8 (a pressure in the rod side hydraulic chamber) is higher than a desired back-pressure of the boom cylinder 7 (a pressure in the bottom side hydraulic chamber), the controller 30 actuates the pump/motor 14A as a hydraulic pump to increase a pressure of the hydraulic oil at the supply side (a pressure in the bottom side hydraulic chamber of the boom cylinder 7) up to the load pressure of the arm cylinder 8. Also, when a load pressure of the arm cylinder 8 (a pressure in the bottom side hydraulic chamber) is lower than or equal to a desired back-pressure of the boom cylinder 7, the controller 30 actuates the pump/motor 14A as a hydraulic motor to decrease a pressure of the hydraulic oil at the supply side (a pressure in the rod side hydraulic chamber of the boom cylinder 7) down to the load pressure. Then, the controller 30 controls a displacement volume of the pump/motor 14A by adjusting a swash plate tilting angle of the pump/motor 14A by using a corresponding regulator so that a pressure in the bottom side hydraulic chamber of the boom cylinder 7 may not change suddenly. For example, when the controller 30 rotates the pump/motor 14A at a constant speed, the controller 30 can decrease a flow rate of the hydraulic oil flowing out of the bottom side hydraulic chamber of the boom cylinder 7 with a decrease in the displacement volume, and can increase a pressure (a back-pressure) in the bottom side hydraulic chamber of the boom cylinder 7 with a decrease in the displacement volume. By using this relationship, the controller 30 can control the pump/motor 14A so that a pressure of the hydraulic oil at the discharge side of the pump/motor 14A may become the load pressure of the arm cylinder 8 and so that a pressure of the hydraulic oil at the supply side of the pump/motor 14A may become the desired back-pressure. The controller 30 may control the pump/motor 14A according to a split flow control by using a metering valve, instead of adjusting a swash plate tilting angle and a rotation speed of the pump/motor 14A, so that a pressure of the hydraulic oil at the discharge side of the pump/motor 14A may become the load pressure of the arm cylinder 8 and so that a pressure of the hydraulic oil at the supply side of the pump/motor 14A may become the desired back-pressure. In this case, the swash plate tilting angle of the pump/motor 14A may be fixed.

The pump/motor 14A acting as a hydraulic pump can discharge hydraulic oil with a pump load lower than that of a case where it pumps hydraulic oil from the hydraulic oil tank T. As a result, it can reduce a load of the engine 11 and can realize saving of energy. Also, the controller 30 decreases a discharge rate of the first hydraulic oil discharged from the first pump 14L by a discharge rate of the third hydraulic oil discharged from the pump/motor 14A. As a result, it can reduce a load of the engine 11 and can realize saving of energy, without changing a flow rate of the hydraulic oil flowing into the rod side hydraulic chamber of the arm cylinder 8.

Also, the pump/motor 14A acting as a hydraulic motor can assist the engine 11 and can supply a part of a driving force for rotating the first pump 14L. As a result, the controller 30 can increase a horsepower consumed by the first pump 14L, or can reduce a load of the engine 11 and thus an amount of fuel injection when it does not increase the horsepower consumed by the first pump 14L. A dashed-two dotted line arrow in FIG. 16 depicts that the pump/motor 14A acting as a hydraulic pump uses a part of the output of the engine 11. A dashed-dotted line arrow in FIG. 16 depicts that the pump/motor 14A acting as a hydraulic motor assists the engine 11 and supplies a part of a driving force for the first pump 14L.

Then, the controller 30 switches the selector valve 90 to the first position and directs the third hydraulic oil discharged from the pump/motor 14A toward the selector valve 91, and switches the selector valve 91 to the first position and directs the third hydraulic oil toward the arm cylinder 8.

Also, the controller 30 maintains the confluence valve 55 in the state of the second position so that the first hydraulic oil and the second hydraulic oil may not merge and thus so that respective movements of the arm cylinder 8 and the bucket cylinder 9 are independently controlled by separate hydraulic oil. In this case, a flow rate of the hydraulic oil flowing into the rod side hydraulic chamber of the arm cylinder 8 can be directly controlled by the first pump 14L. Thus, the flow rate does not need to be controlled by an aperture at the flow rate control valve 171. Similarly, a flow rate of the hydraulic oil flowing into the rod side hydraulic chamber of the bucket cylinder 9 can be directly controlled by the second pump 14R. Thus, the flow rate does not need to be controlled by an aperture at the flow rate control valve 173. Therefore, as in the case of the flow rate control valve 172 corresponding to the boom cylinder 7, the controller 30 may cause opening areas of the flow rate control valves 171, 173 to become maximum by increasing pilot pressures acting on the left side pilot ports of the flow rate control valves 171, 173 by using decompression valves, and thus may reduce the pressure loss at the flow rate control valves 171, 173.

Also, if the controller 30 cannot adjust an actuating speed of the boom cylinder 7 to a level corresponding to an amount of operation of the boom operating lever only by controlling the displacement volume of the pump/motor 14A, the controller 30 directs at least part of the hydraulic oil flowing out of the bottom side hydraulic chamber of the boom cylinder 7 toward the hydraulic oil tank T. Specifically, the controller 30 causes at least part of the hydraulic oil flowing out of the bottom side hydraulic chamber of the boom cylinder 7 to flow to the hydraulic oil tank T by shifting the selector valve 62 to an intermediate position between the first position and the second position, or by completely switching the selector valve 62 to the first position.

Figure 17:
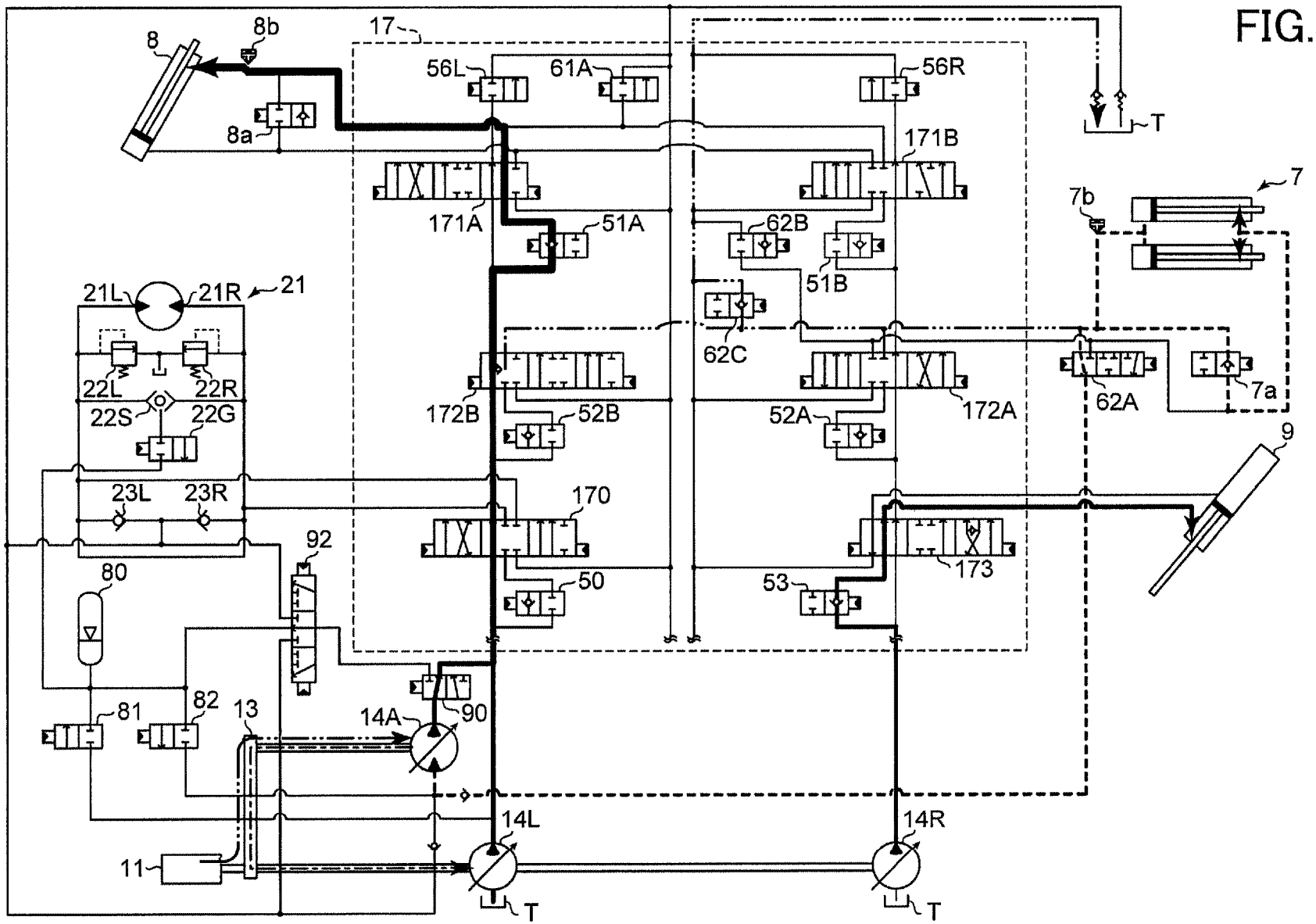
FIG. 17 shows a state of the hydraulic circuit in FIG. 3 when an earth removing movement is carried out along with a hydraulic-actuator-assist by a back-pressure regeneration.

Next, referring to FIG. 17, a state of the hydraulic circuit in FIG. 3 when an earth removing movement is carried out along with a hydraulic-actuator-assist by a back-pressure regeneration is explained. FIG. 17 shows a state of the hydraulic circuit in FIG. 3 when an earth removing movement is carried out along with an assist of a hydraulic actuator (the arm cylinder 8) by a back-pressure regeneration. Thick solid lines in FIG. 17 depict flows of the hydraulic oil flowing into the hydraulic actuators. A width of the solid line increases with increase in flow rate. Thick dashed lines and thick dashed-three dotted lines in FIG. 17 depict flows of the hydraulic oil flowing out of the hydraulic actuators.

Specifically, when the controller 30 determines that the boom lowering operation has been carried out, the controller 30 causes the hydraulic oil flowing out of the bottom side hydraulic chamber of the boom cylinder 7 to flow into the rod side hydraulic chamber of the boom cylinder 7 by maximizing an opening area of the regeneration valve 7*a*.

Also, the controller 30 switches the selector valve 62A to the first position and directs the hydraulic oil flowing out of the bottom side hydraulic chamber of the boom cylinder 7 to the supply side of the pump/motor 14A. Also, the controller 30 shifts the flow rate control valve 172A to its neutral position by decreasing a pilot pressure acting on the right side pilot port of the flow rate control valve 172A by using a decompression valve independently of an amount of operation of the boom operating lever and thus blocks a flow of the hydraulic oil flowing from the bottom side hydraulic chamber of the boom cylinder 7 through the flow rate control valve 172A toward the hydraulic oil tank T. Also, the controller 30 switches the variable load check valve 52A to the second position and closes the communication between the second pump 14R and the flow rate control valve 172A.

Also, when the arm opening operation is carried out, the flow rate control valve 171A shifts to the right position in FIG. 17 in response to a pilot pressure generated depending on an amount of operation of the arm operating lever. Also, when the bucket opening operation is carried out, the flow rate control valve 173 shifts to the left position in FIG. 17 in response to a pilot pressure generated depending on an amount of operation of the bucket operating lever.

Also, when the controller 30 determines that the arm opening operation has been carried out, the controller 30 switches the variable load check valve 51A to the first position and opens the communication between the first pump 14L and the flow rate control valve 171A. Also, when the controller 30 determines that the bucket opening operation has been carried out, the controller 30 switches the variable load check valve 53 to the first position and opens the communication between the second pump 14R and the flow rate control valve 173.

Also, the controller 30 controls a discharge rate of the pump/motor 14A depending on an amount of operation of the boom operating lever and an opening area of the regeneration valve 7*a*. Specifically, when a load pressure of the arm cylinder 8 (a pressure in the rod side hydraulic chamber) is higher than a desired back-pressure of the boom cylinder 7 (a pressure in the bottom side hydraulic chamber), the controller 30 actuates the pump/motor 14A as a hydraulic pump to increase a pressure of the hydraulic oil at the supply side (a pressure in the bottom side hydraulic chamber of the boom cylinder 7) up to the load pressure of the arm cylinder 8. Also, when a load pressure of the arm cylinder 8 (a pressure in the rod side hydraulic chamber) is lower than or equal to a desired back-pressure of the boom cylinder 7, the controller 30 actuates the pump/motor 14A as a hydraulic motor to decrease a pressure of the hydraulic oil at the supply side (a pressure in the rod side hydraulic chamber of the boom cylinder 7) down to the load pressure. Then, the controller 30 controls a displacement volume of the pump/motor 14A by adjusting a swash plate tilting angle of the pump/motor 14A by using a corresponding regulator so that a pressure in the bottom side hydraulic chamber of the boom cylinder 7 may not change suddenly. For example, when the controller 30 rotates the pump/motor 14A at a constant speed, the controller 30 can decrease a flow rate of the hydraulic oil flowing out of the bottom side hydraulic chamber of the boom cylinder 7 with a decrease in the displacement volume, and can increase a pressure (a back-pressure) in the bottom side hydraulic chamber of the boom cylinder 7 with a decrease in the displacement volume. By using this relationship, the controller 30 can control the pump/motor 14A so that a pressure of the hydraulic oil at the discharge side of the pump/motor 14A may become the load pressure of the arm cylinder 8 and so that a pressure of the hydraulic oil at the supply side of the pump/motor 14A may become the desired back-pressure.

The pump/motor 14A acting as a hydraulic pump can discharge hydraulic oil with a pump load lower than that of a case where it pumps hydraulic oil from the hydraulic oil tank T. As a result, it can reduce a load of the engine 11 and can realize saving of energy. Also, the controller 30 decreases a discharge rate of the first hydraulic oil discharged from the first pump 14L by a discharge rate of the third hydraulic oil discharged from the pump/motor 14A. As a result, it can reduce a load of the engine 11 and can realize saving of energy, without changing a flow rate of the hydraulic oil flowing into the rod side hydraulic chamber of the arm cylinder 8.

Also, the pump/motor 14A acting as a hydraulic motor can assist the engine 11 and can supply a part of a driving force for rotating the first pump 14L. As a result, the controller 30 can increase a horsepower consumed by the first pump 14L, or can reduce a load of the engine 11 and thus an amount of fuel injection when it does not increase the horsepower consumed by the first pump 14L. A dashed-two dotted line arrow in FIG. 17 depicts that the pump/motor 14A acting as a hydraulic pump uses a part of the output of the engine 11. A dashed-dotted line arrow in FIG. 17 depicts that the pump/motor 14A acting as a hydraulic motor assists the engine 11 and supplies a part of a driving force for the first pump 14L.

Also, the controller 30 maintains the variable load check valve 51B in the state of the second position so that the first hydraulic oil and the second hydraulic oil may not merge and thus so that respective movements of the arm cylinder 8 and the bucket cylinder 9 are independently controlled by separate hydraulic oil. In this case, a flow rate of the hydraulic oil flowing into the rod side hydraulic chamber of the arm cylinder 8 can be directly controlled by the first pump 14L. Thus, the flow rate does not need to be controlled by an aperture at the flow rate control valve 171A. Similarly, a flow rate of the hydraulic oil flowing into the rod side hydraulic chamber of the bucket cylinder 9 can be directly controlled by the second pump 14R. Thus, the flow rate does not need to be controlled by an aperture at the flow rate control valve 173. Therefore, as in the case of the flow rate control valve 172A corresponding to the boom cylinder 7, the controller 30 may cause an opening area of the flow rate control valves 171A to become maximum by increasing a pilot pressure acting on the right side pilot port of the flow rate control valve 171A by using a decompression valve, may cause an opening area of the flow, rate control valves 173 to become maximum by increasing a pilot pressure acting on the left side pilot port of the flow rate control valve 173 by using a decompression valve, and thus may reduce the pressure loss at the flow rate control valves 171A, 173.

If the controller 30 cannot adjust an actuating speed of the boom cylinder 7 to a level corresponding to an amount of operation of the boom operating lever only by controlling the displacement volume of the pump/motor 14A, the controller 30 directs at least part of the hydraulic oil flowing out of the bottom side hydraulic chamber of the boom cylinder 7 to the hydraulic oil tank T. Specifically, the controller 30 causes at least part of the hydraulic oil flowing out of the bottom side hydraulic chamber of the boom cylinder 7 to flow to the hydraulic oil tank T by shifting the selector valve 62C to an intermediate position between the first position and the second position, or by completely switching the selector valve 62C to the first position.

Also, the controller 30 may shift the flow rate control valve 172B to the left position in FIG. 17 by increasing a pilot pressure acting on the left side pilot port of the flow rate control valve 172B by using a decompression valve independently of an amount of operation of the boom operating lever, and thus may merge the hydraulic oil flowing out of the bottom side hydraulic chamber of the boom cylinder 7 into the first hydraulic oil.

Thick dashed-three dotted lines in FIG. 17 depict that the hydraulic oil flowing out of the bottom side hydraulic chamber of the boom cylinder 7 is discharged into the hydraulic oil tank T when the selector valve 62C is shifted toward the first position, and that the hydraulic oil flowing out of the bottom side hydraulic chamber of the boom cylinder 7 merges into the first hydraulic oil at the flow rate control valve 172B when the flow rate control valve 172B is shifted to the left position.

As described above, the controller 30 additionally brings about following effects in addition to the effects described at [Earth removing movement along with an engine-assist by a back-pressure regeneration].

Specifically, the controller 30 decides whether to actuate the pump/motor 14A as a hydraulic pump or as a hydraulic motor, and varies a discharge pressure of the third hydraulic oil discharged from the pump/motor 14A by adjusting the displacement volume of the pump/motor 14A. Thus, independently of magnitude relationship between a load pressure of a hydraulic actuator as a supply destination of the third hydraulic oil and a desired back-pressure of the boom cylinder 7, it can cause the third hydraulic oil to flow into the hydraulic actuator. As a result, it can flexibly control a flow rate balance of the first hydraulic oil and the third hydraulic oil, and can allow regenerated energy to be effectively reused.

[Earth Removing Movement Along with an Accumulation to an Accumulator by a Back-Pressure Regeneration]

Figure 18:
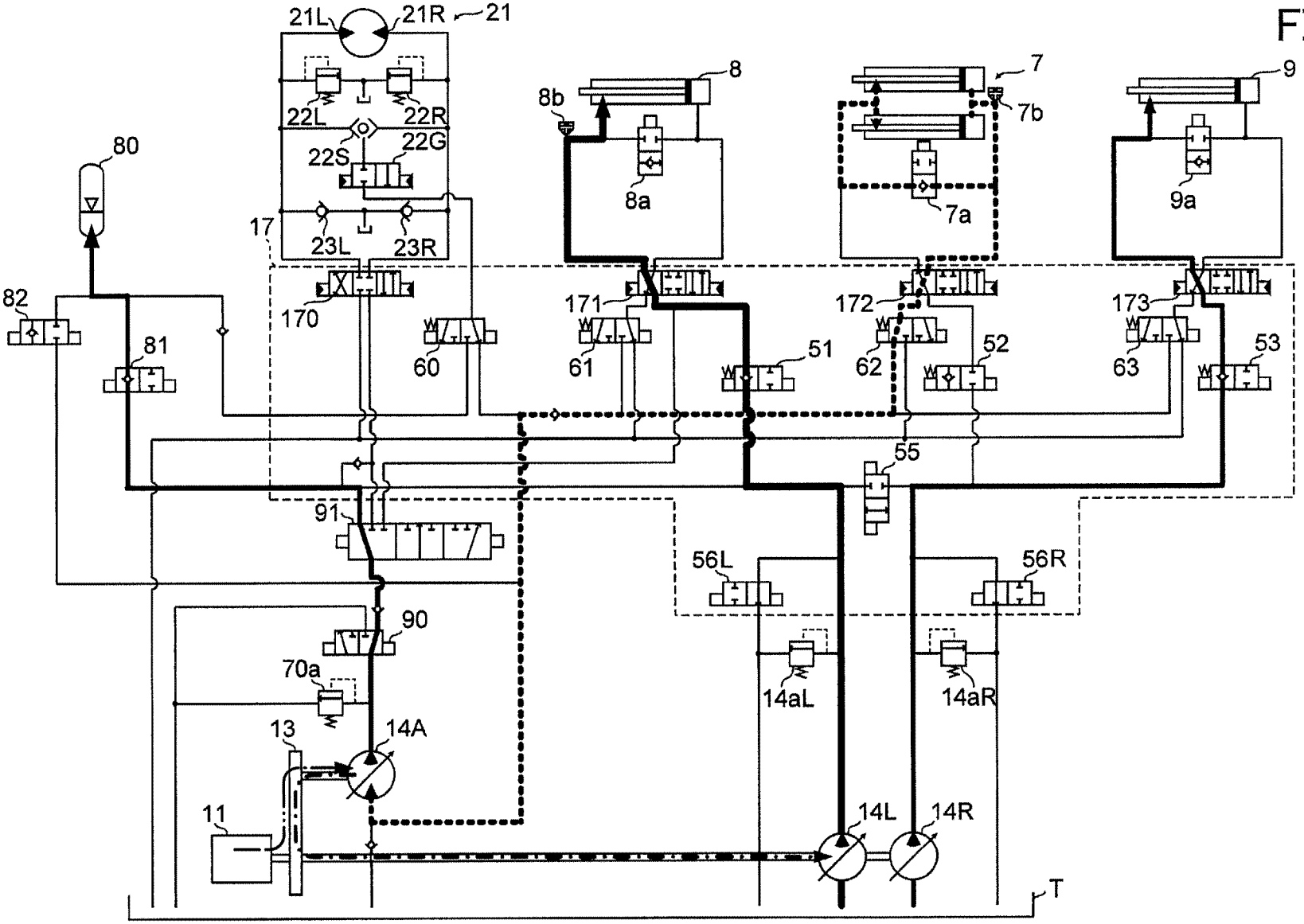
FIG. 18 shows a state of the hydraulic circuit in FIG. 2 when an earth removing movement is carried out along with an accumulation to an accumulator by a back-pressure regeneration.

Next, referring to FIG. 18, a state of the hydraulic circuit in FIG. 2 when an earth removing movement is carried out along with an accumulation to the accumulator 80 by a back-pressure regeneration is explained. FIG. 18 shows a state of the hydraulic circuit in FIG. 2 when an earth removing movement is carried out along with an accumulation to the accumulator 80 by a back-pressure regeneration. Thick solid lines in FIG. 18 depict flows of the hydraulic oil flowing into the hydraulic actuators. A width of the solid line increases with increase in flow rate. Thick dotted lines in FIG. 18 depict a flow of the hydraulic oil flowing out of the hydraulic actuator.

When the boom lowering operation is carried out, the flow rate control valve 172 shifts to the left position in FIG. 18 in response to a pilot pressure generated depending on an amount of operation of the boom operating lever. Also, when the arm opening operation is carried out, the flow rate control valve 171 shifts to the left position in FIG. 18 in response to a pilot pressure generated depending on an amount of operation of the arm operating lever, and when the bucket opening operation is carried out, the flow rate control valve 173 shifts to the left position in FIG. 18 in response to a pilot pressure generated depending on an amount of operation of the bucket operating lever.

Then, when the controller 30 determines that the boom lowering operation has been carried out, the controller 30 causes the hydraulic oil flowing out of the bottom side hydraulic chamber of the boom cylinder 7 to flow into the rod side hydraulic chamber of the boom cylinder 7 by maximizing an opening area of the regeneration valve 7*a* as shown by the thick dotted line.

Also, the controller 30 switches the selector valve 62 to the second position, and directs the hydraulic oil flowing out of the bottom side hydraulic chamber of the boom cylinder 7 to the supply side of the pump/motor 14A as shown by the thick dotted line. Also, the controller 30 causes an opening area of the flow rate control valve 172 to become maximum by increasing a pilot pressure acting on the left side pilot port of the flow rate control valve 172 by using a decompression valve independently of an amount of operation of the boom operating lever, and reduces the pressure loss at the flow rate control valve 172. Also, the controller 30 switches the variable load check valve 52 to the second position and closes the communication between the second pump 14R and the flow rate control valve 172.

Also, the controller 30 controls a discharge rate of the pump/motor 14A depending on an amount of operation of the boom operating lever and an opening area of the regeneration valve 7*a*. Specifically, when the accumulator pressure is higher than a desired back-pressure of the boom cylinder 7 (a pressure in the bottom side hydraulic chamber), the controller 30 actuates the pump/motor 14A as a hydraulic pump to increase a pressure of the hydraulic oil at the supply side (a pressure in the bottom side hydraulic chamber of the boom cylinder 7) up to the accumulator pressure. Also, when the accumulator pressure is lower than or equal to a desired back-pressure of the boom cylinder 7, the controller 30 actuates the pump/motor 14A as a hydraulic motor to decrease a pressure of the hydraulic oil at the supply side (a pressure in the rod side hydraulic chamber of the boom cylinder 7) down to the accumulator pressure. Then, the controller 30 controls a displacement volume of the pump/motor 14A by adjusting a swash plate tilting angle of the pump/motor 14A by using a corresponding regulator so that a pressure in the bottom side hydraulic chamber of the boom cylinder 7 may not change suddenly. For example, when the controller 30 rotates the pump/motor 14A at a constant speed, the controller 30 can decrease a flow rate of the hydraulic oil flowing out of the bottom side hydraulic chamber of the boom cylinder 7 with a decrease in the displacement volume, and can increase a pressure (a back-pressure) in the bottom side hydraulic chamber of the boom cylinder 7 with a decrease in the displacement volume. By using this relationship, the controller 30 can control a pressure of the hydraulic oil so that a pressure of the hydraulic oil at the discharge side of the pump/motor 14A may become the accumulator pressure and so that a pressure of the hydraulic oil at the supply side of the pump/motor 14A may become the desired back-pressure.

The pump/motor 14A acting as a hydraulic pump can accumulate hydraulic oil into the accumulator 80 with a pump load lower than that of a case where it pumps hydraulic oil from the hydraulic oil tank T and accumulates it into the accumulator 80. As a result, it can reduce a load of the engine 11 and can realize saving of energy. Also, the pump/motor 14A acting as a hydraulic motor can assist the engine 11 and can supply a part of a driving force for rotating the first pump 14L. As a result, the controller 30 can increase a horsepower consumed by the first pump 14L, or can reduce a load of the engine 11 and thus an amount of fuel injection when it does not increase the horsepower consumed by the first pump 14L. A dashed-two dotted line arrow in FIG. 18 depicts that the pump/motor 14A acting as a hydraulic pump uses a part of the output of the engine 11. A dashed-dotted line arrow in FIG. 18 depicts that the pump/motor 14A acting as a hydraulic motor assists the engine 11 and supplies a part of a driving force for the first pump 14L.

Then, the controller 30 switches the selector valve 90 to the first position and directs the third hydraulic oil discharged from the pump/motor 14A toward the selector valve 91, and switches the selector valve 91 to the third position and directs the third hydraulic oil toward the accumulator 80. Also, the controller 30 switches the selector valve 81 to the first position and opens the communication between the first pump 14L and the accumulator 80.

Also, the controller 30 maintains the confluence valve 55 in the state of the second position so that the first hydraulic oil and the second hydraulic oil may not merge and thus so that respective movements of the arm cylinder 8 and the bucket cylinder 9 are independently controlled by separate hydraulic oil. In this case, a flow rate of the hydraulic oil flowing into the rod side hydraulic chamber of the arm cylinder 8 can be directly controlled by the first pump 14L. Thus, the flow rate does not need to be controlled by an aperture at the flow rate control valve 171. Similarly, a flow rate of the hydraulic oil flowing into the rod side hydraulic chamber of the bucket cylinder 9 can be directly controlled by the second pump 14R. Thus, the flow rate does not need to be controlled by an aperture at the flow rate control valve 173. Therefore, as in the case of the flow rate control valve 172 corresponding to the boom cylinder 7, the controller 30 may cause opening areas of the flow rate control valves 171, 173 to become maximum by increasing pilot pressures acting on the left side pilot ports of the flow rate control valves 171, 173 by using decompression valves, and thus may reduce the pressure loss at the flow rate control valves 171, 173.

If the controller 30 cannot adjust an actuating speed of the boom cylinder 7 to a level corresponding to an amount of operation of the boom operating lever only by controlling the displacement volume of the pump/motor 14A, the controller 30 directs at least part of the hydraulic oil flowing out of the bottom side hydraulic chamber of the boom cylinder 7 to the hydraulic oil tank T. Specifically, the controller 30 causes at least part of the hydraulic oil flowing out of the bottom side hydraulic chamber of the boom cylinder 7 to flow to the hydraulic oil tank T by shifting the selector valve 62 to an intermediate position between the first position and the second position, or by completely switching the selector valve 62 to the first position.

Figure 19:
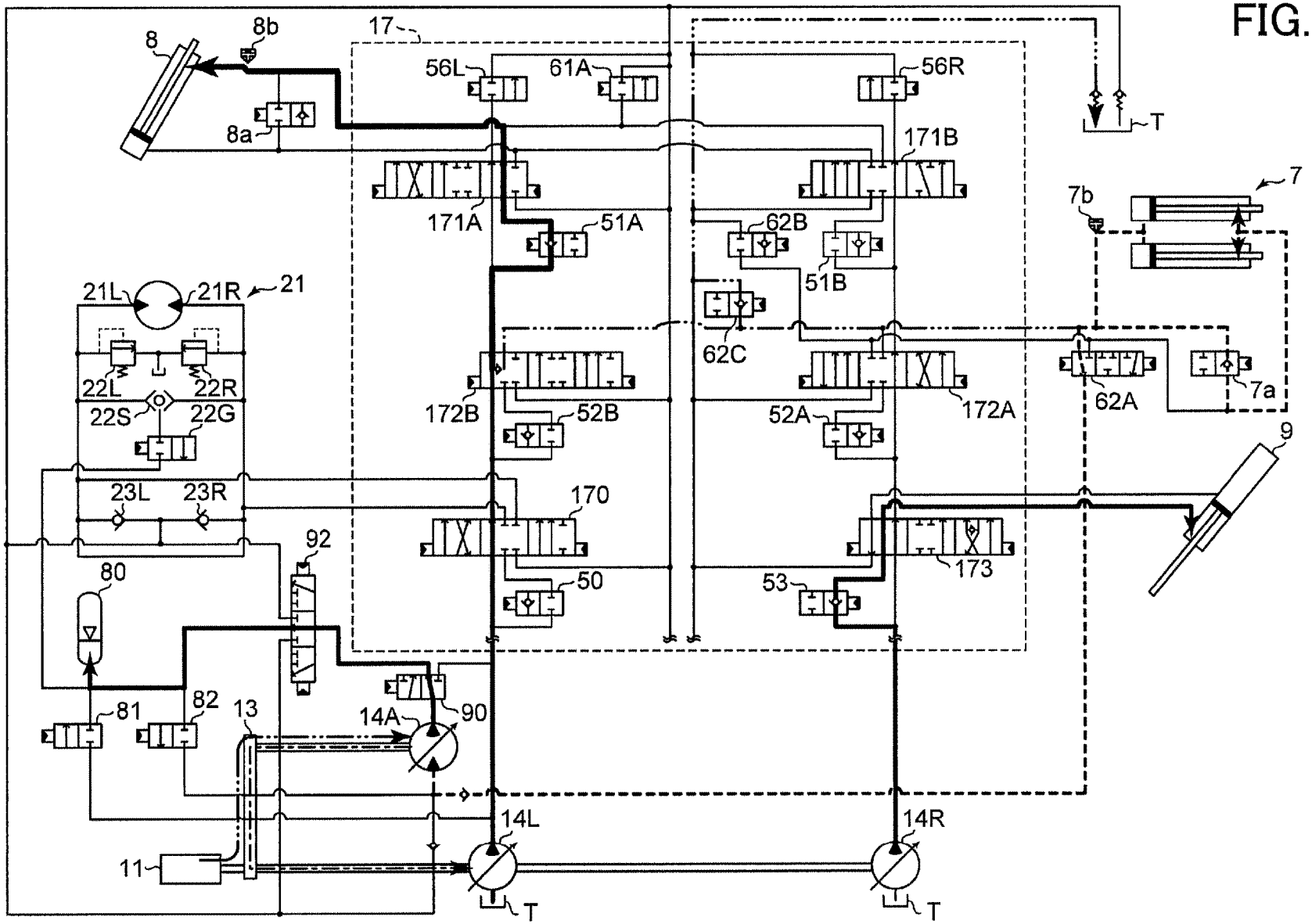
FIG. 19 shows a state of the hydraulic circuit in FIG. 3 when an earth removing movement is carried out along with an accumulation to an accumulator by a back-pressure regeneration.

Next, referring to FIG. 19, a state of the hydraulic circuit in FIG. 3 when an earth removing movement is carried out along with an accumulation to the accumulator 80 by a back-pressure regeneration is explained. FIG. 19 shows a state of the hydraulic circuit in FIG. 3 when an earth removing movement is carried out along with an accumulation to the accumulator 80 by a back-pressure regeneration. Thick solid lines in FIG. 19 depict flows of the hydraulic oil flowing into the hydraulic actuators. A width of the solid line increases with increase in flow rate. Thick dashed lines and thick dashed-three dotted lines in FIG. 19 depict flows of the hydraulic oil flowing out of the hydraulic actuators.

Specifically, when the controller 30 determines that the boom lowering operation has been carried out, the controller 30 causes the hydraulic oil flowing out of the bottom side hydraulic chamber of the boom cylinder 7 to flow into the rod side hydraulic chamber of the boom cylinder 7 by maximizing an opening area of the regeneration valve 7*a*.

Also, the controller 30 switches the selector valve 62A to the first position and directs the hydraulic oil flowing out of the bottom side hydraulic chamber of the boom cylinder 7 to the supply side of the pump/motor 14A. Also, the controller 30 shifts the flow rate control valve 172A to its neutral position by decreasing a pilot pressure acting on the right side pilot port of the flow rate control valve 172A by using a decompression valve independently of an amount of operation of the boom operating lever and thus blocks a flow of the hydraulic oil flowing from the bottom side hydraulic chamber of the boom cylinder 7 through the flow rate control valve 172A toward the hydraulic oil tank T. Also, the controller 30 switches the variable load check valve 52A to the second position and closes the communication between the second pump 14R and the flow rate control valve 172A.

Also, when the arm opening operation is carried out, the flow rate control valve 171A shifts to the right position in FIG. 19 in response to a pilot pressure generated depending on an amount of operation of the arm operating lever. Also, when the bucket opening operation is carried out, the flow rate control valve 173 shifts to the left position in FIG. 19 in response to a pilot pressure generated depending on an amount of operation of the bucket operating lever.

Also, when the controller 30 determines that the arm opening operation has been carried out, the controller 30 switches the variable load check valve 51A to the first position and opens the communication between the first pump 14L and the flow rate control valve 171A. Also, when the controller 30 determines that the bucket opening operation has been carried out, the controller 30 switches the variable load check valve 53 to the first position and opens the communication between the second pump 14R and the flow rate control valve 173.

Also, the controller 30 controls a discharge rate of the pump/motor 14A depending on an amount of operation of the boom operating lever and an opening area of the regeneration valve 7*a*. Specifically, when the accumulator pressure is higher than a desired back-pressure of the boom cylinder 7 (a pressure in the bottom side hydraulic chamber), the controller 30 actuates the pump/motor 14A as a hydraulic pump to increase a pressure of the hydraulic oil at the supply side (a pressure in the bottom side hydraulic chamber of the boom cylinder 7) up to the accumulator pressure. Also, when the accumulator pressure is lower than or equal to a desired back-pressure of the boom cylinder 7, the controller 30 actuates the pump/motor 14A as a hydraulic motor to decrease a pressure of the hydraulic oil at the supply side (a pressure in the rod side hydraulic chamber of the boom cylinder 7) down to the accumulator pressure. Then, the controller 30 controls a displacement volume of the pump/motor 14A by adjusting a swash plate tilting angle of the pump/motor 14A by using a corresponding regulator so that a pressure in the bottom side hydraulic chamber of the boom cylinder 7 may not change suddenly. For example, when the controller 30 rotates the pump/motor 14A at a constant speed, the controller 30 can decrease a flow rate of the hydraulic oil flowing out of the bottom side hydraulic chamber of the boom cylinder 7 with a decrease in the displacement volume, and can increase a pressure (a back-pressure) in the bottom side hydraulic chamber of the boom cylinder 7 with a decrease in the displacement volume. By using this relationship, the controller 30 can control the pump/motor 14A so that a pressure of the hydraulic oil at the discharge side of the pump/motor 14A may become the accumulator pressure and so that a pressure of the hydraulic oil at the supply side of the pump/motor 14A may become the desired back-pressure.

The pump/motor 14A acting as a hydraulic pump can accumulate hydraulic oil into the accumulator 80 with a pump load lower than that of a case where it pumps hydraulic oil from the hydraulic oil tank T and accumulates it into the accumulator 80. As a result, it can reduce a load of the engine 11 and can realize saving of energy. Also, the pump/motor 14A acting as a hydraulic motor can assist the engine 11 and can supply a part of a driving force for rotating the first pump 14L. As a result, the controller 30 can increase a horsepower consumed by the first pump 14L, or can reduce a load of the engine 11 and thus an amount of fuel injection when it does not increase the horsepower consumed by the first pump 14L. A dashed-two dotted line arrow in FIG. 19 depicts that the pump/motor 14A acting as a hydraulic pump uses a part of the output of the engine 11. A dashed-dotted line arrow in FIG. 19 depicts that the pump/motor 14A acting as a hydraulic motor assists the engine 11 and supplies a part of a driving force for the first pump 14L.

Also, the controller 30 maintains the variable load check valve 51B in the state of the second position so that the first hydraulic oil and the second hydraulic oil may not merge and thus so that respective movements of the arm cylinder 8 and the bucket cylinder 9 are independently controlled by separate hydraulic oil. In this case, a flow rate of the hydraulic oil flowing into the rod side hydraulic chamber of the arm cylinder 8 can be directly controlled by the first pump 14L. Thus, the flow rate does not need to be controlled by an aperture at the flow rate control valve 171A. Similarly, a flow rate of the hydraulic oil flowing into the rod side hydraulic chamber of the bucket cylinder 9 can be directly controlled by the second pump 14R. Thus, the flow rate does not need to be controlled by an aperture at the flow rate control valve 173. Therefore, as in the case of the flow rate control valve 172A corresponding to the boom cylinder 7, the controller 30 may cause an opening area of the flow rate control valves 171A to become maximum by increasing a pilot pressure acting on the right side pilot port of the flow rate control valve 171A by using a decompression valve, may cause an opening area of the flow rate control valves 173 to become maximum by increasing a pilot pressure acting on the left side pilot port of the flow rate control valve 173 by using a decompression valve, and thus may reduce the pressure loss at the flow rate control valves 171A, 173.

If the controller 30 cannot adjust an actuating speed of the boom cylinder 7 to a level corresponding to an amount of operation of the boom operating lever only by controlling the displacement volume of the pump/motor 14A, the controller 30 directs at least part of the hydraulic oil flowing out of the bottom side hydraulic chamber of the boom cylinder 7 to the hydraulic oil tank T. Specifically, the controller 30 causes at least part of the hydraulic oil flowing out of the bottom side hydraulic chamber of the boom cylinder 7 to flow to the hydraulic oil tank T by shifting the selector valve 62C to an intermediate position between the first position and the second position, or by completely switching the selector valve 62C to the first position.

Also, the controller 30 may shift the flow rate control valve 172B to the left position in FIG. 19 by increasing a pilot pressure acting on the left side pilot port of the flow rate control valve 172B by using a decompression valve independently of an amount of operation of the boom operating lever, and thus may merge the hydraulic oil flowing out of the bottom side hydraulic chamber of the boom cylinder 7 into the first hydraulic oil.

Thick dashed-three dotted lines in FIG. 19 depict that the hydraulic oil flowing out of the bottom side hydraulic chamber of the boom cylinder 7 is discharged into the hydraulic oil tank T when the selector valve 62C is shifted toward the first position, and that the hydraulic oil flowing out of the bottom side hydraulic chamber of the boom cylinder 7 merges into the first hydraulic oil at the flow rate control valve 172B when the flow rate control valve 172B is shifted to the left position.

As described above, the controller 30 additionally brings about following effects in addition to the effects described at [Earth removing movement along with an engine-assist by a back-pressure regeneration] and [Earth removing movement along with a hydraulic-actuator-assist by a back-pressure regeneration].

Specifically, the controller 30 decides whether to actuate the pump/motor 14A as a hydraulic pump or as a hydraulic motor, and varies a discharge pressure of the third hydraulic oil discharged from the pump/motor 14A by adjusting the displacement volume of the pump/motor 14A. Thus, independently of magnitude relationship between a pressure in the accumulator 80 as a supply destination of the third hydraulic oil and a desired back-pressure of the boom cylinder 7, it can cause the third hydraulic oil to flow into the accumulator 80. As a result, it can flexibly accumulate potential energy of the boom 4 to the accumulator 80 as hydraulic energy, and can allow the accumulated hydraulic energy to be effectively reused. Also, when the boom lowering operation has been carried out, and when there is no need to assist the engine 11 or when there is no need to increase an actuating speed of the arm cylinder 8, it can accumulate potential energy of the boom 4 to the accumulator 80 as hydraulic energy. Also, even if the potential energy of the boom 4 is small, it can accumulate the potential energy to the accumulator 80 as hydraulic energy.

[Boom-Lowering-Swing-Decelerating Movement Along with an Accumulation to an Accumulator]

Figure 20:
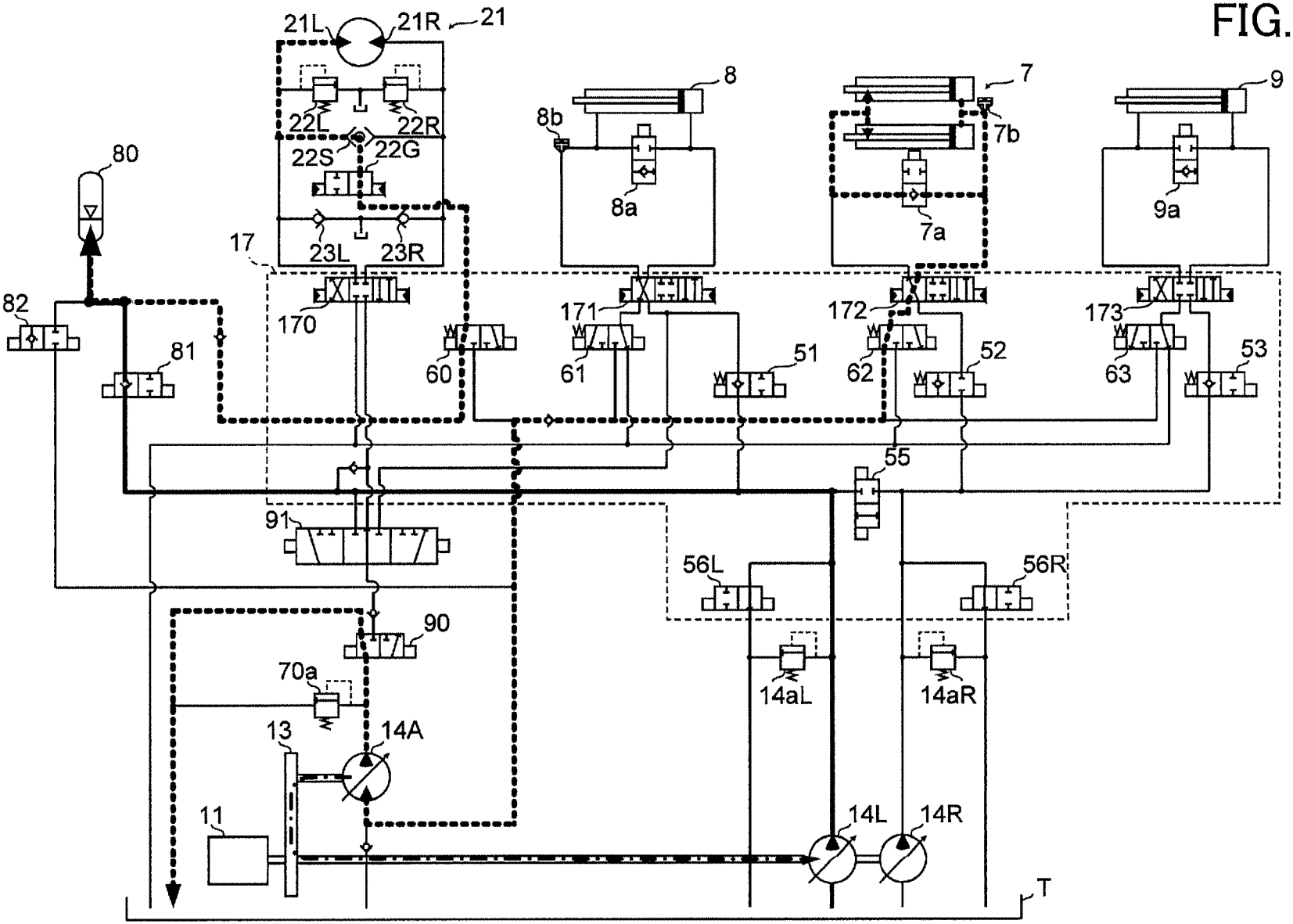
FIG. 20 shows a state of the hydraulic circuit in FIG. 2 when a boom-lowering-swing-decelerating movement is carried out along with an accumulation to an accumulator.

Next, referring to FIG. 20, a state of the hydraulic circuit in FIG. 2 when a boom-lowering-swing-decelerating movement is carried out along with an accumulation to the accumulator 80 is explained. FIG. 20 shows a state of the hydraulic circuit in FIG. 2 when a boom-lowering-swing-decelerating movement is carried out along with an accumulation to the accumulator 80. Thick solid lines in FIG. 20 depict a flow of the hydraulic oil flowing into the accumulator 80. Thick dotted lines in FIG. 20 depict flows of the hydraulic oil flowing out of the hydraulic actuators.

A boom-lowering-swing-decelerating movement is a movement including a boom lowering and a swing decelerating. The upper swing body 3 continues to swing by inertia, and deceleration of the upper swing body 3 is controlled by adjusting a pressure of the hydraulic oil at a discharge port side of the hydraulic swing motor 21. Specifically, the deceleration of the upper swing body 3 strengthens with increase in the pressure of the hydraulic oil at the discharge port side.

When a boom lowering operation is carried out, the flow rate control valve 172 shifts to the left position in FIG. 20 in response to a pilot pressure generated depending on an amount of operation of the boom operating lever.

Then, when the controller 30 determines that the boom lowering operation has been carried out, the controller 30 causes the hydraulic oil flowing out of the bottom side hydraulic chamber of the boom cylinder 7 to flow into the rod side hydraulic chamber of the boom cylinder 7 by maximizing an opening area of the regeneration valve 7*a* as shown by the thick dotted line.

Also, the controller 30 switches the selector valve 62 to the second position, and directs the hydraulic oil flowing out of the bottom side hydraulic chamber of the boom cylinder 7 to the supply side of the pump/motor 14A as shown by the thick dotted line. Also, the controller 30 causes an opening area of the flow rate control valve 172 to become maximum by increasing a pilot pressure acting on the left side pilot port of the flow rate control valve 172 by using a decompression valve independently of an amount of operation of the boom operating lever, and reduces the pressure loss at the flow rate control valve 172. Also, the controller 30 switches the variable load check valve 52 to the second position and closes the communication between the second pump 14R and the flow rate control valve 172.

Also, the controller 30 controls a discharge rate of the pump/motor 14A depending on an amount of operation of the boom operating lever and an opening area of the regeneration valve 7*a*. Specifically, the controller 30 actuates the pump/motor 14A as a hydraulic motor and controls a displacement volume of the pump/motor 14A by controlling a corresponding regulator so that a pressure in the bottom side hydraulic chamber of the boom cylinder 7 may not change suddenly. Then, the controller 30 causes the third hydraulic oil discharged from the pump/motor 14A to flow to the hydraulic oil tank T by switching the selector valve 90 to the second position.

The controller 30 may direct the third hydraulic oil discharged from the pump/motor 14A toward the accumulator 80 or toward a hydraulic actuator in motion. Specifically, when the accumulator pressure is higher than a desired back-pressure of the boom cylinder 7 (a pressure in the bottom side hydraulic chamber), the controller 30 actuates the pump/motor 14A as a hydraulic pump to increase a pressure of the hydraulic oil at the supply side (a pressure in the bottom side hydraulic chamber of the boom cylinder 7) up to the accumulator pressure. Also, when the accumulator pressure is lower than or equal to the desired back-pressure of the boom cylinder 7, the controller 30 actuates the pump/motor 14A as a hydraulic motor to decrease a pressure of the hydraulic oil at the supply side (a pressure in the rod side hydraulic chamber of the boom cylinder 7) down to the accumulator pressure. Then, the controller 30 controls a displacement volume of the pump/motor 14A by adjusting a swash plate tilting angle of the pump/motor 14A by using a corresponding regulator so that a pressure in the bottom side hydraulic chamber of the boom cylinder 7 may not change suddenly. Also, the controller 30 switches the selector valve 90 to the first position and directs the third hydraulic oil discharged from the pump/motor 14A toward the selector valve 91, and switches the selector valve 91 to the third position and directs the third hydraulic oil toward the accumulator 80. In this way, the controller 30 controls the pump/motor 14A so that a pressure of the hydraulic oil at the discharge side of the pump/motor 14A may become the accumulator pressure and so that a pressure of the hydraulic oil at the supply side of the pump/motor 14A may become the desired back-pressure. The same goes for a case where it directs the third hydraulic oil toward the hydraulic actuator in motion.

The pump/motor 14A acting as a hydraulic pump can discharge hydraulic oil with a pump load lower than that of a case where it pumps hydraulic oil from the hydraulic oil tank T. As a result, it can reduce a load of the engine 11 and can realize saving of energy. Also, the pump/motor 14A acting as a hydraulic motor can assist the engine 11 by generating a rotary torque and can supply a part of a driving force for rotating the first pump 14L. As a result, the controller 30 can increase a horsepower consumed by the first pump 14L, or can reduce a load of the engine 11 and thus an amount of fuel injection when it does not increase the horsepower consumed by the first pump 14L.

In the example of FIG. 20, when the controller 30 actuates the pump/motor 14A as a hydraulic motor and discharges the third hydraulic oil to the hydraulic oil tank T, the controller 30 causes the first hydraulic oil discharged from the first pump 14L actuated by the rotary torque of the pump/motor 14A to flow into the accumulator 80. In this case, the controller 30 controls a displacement volume of the first pump 14L by using a corresponding regulator so that a discharge pressure of the first pump 14L may become the accumulator pressure. Also, the controller 30 switches the selector valve 81 to the first position to open the communication between the first pump 14L and the accumulator 80. A dashed-dotted line arrow in FIG. 20 depicts that the rotary torque of the pump/motor 14A acting as a hydraulic motor actuates the first pump 14L, a thick solid line in FIG. 20 depicts that the first hydraulic oil of the first pump 14L actuated by the pump/motor 14A flows into the accumulator 80.

If the controller 30 cannot adjust an actuating speed of the boom cylinder 7 to a level corresponding to an amount of operation of the boom operating lever only by controlling the displacement volume of the pump/motor 14A, the controller 30 directs at least part of the hydraulic oil flowing out of the bottom side hydraulic chamber of the boom cylinder 7 to the hydraulic oil tank T. Specifically, the controller 30 causes at least part of the hydraulic oil flowing out of the bottom side hydraulic chamber of the boom cylinder 7 to flow to the hydraulic oil tank T by shifting the selector valve 62 to an intermediate position between the first position and the second position, or by completely switching the selector valve 62 to the first position.

Also, when a swing decelerating operation is carried out, the flow rate control valve 170 shifts to the neutral position in FIG. 20 because a pilot pressure decreases with decrease in an amount of operation of the swing operating lever.

Then, when the controller 30 determines that a swing decelerating operation has been carried out, the controller 30 opens the regeneration valve 22G and causes the hydraulic oil at the side of the discharge port 21L of the hydraulic swing motor 21 to flow toward the selector valve 60 as shown by the thick dotted line. Also, the controller 30 switches the selector valve 60 to the second position and causes the hydraulic oil flowing out of the hydraulic swing motor 21 to flow into the accumulator 80 as shown by the thick dotted line.

Also, the controller 30 adjusts an opening area of the regeneration valve 22G or an opening area of the selector valve 60 at the second position, depending on a pressure of the hydraulic oil at the side of the discharge port 21L of the hydraulic swing motor 21 and the accumulator pressure. Then, the controller 30 controls a pressure of the hydraulic oil at the side of the discharge port 21L so as to generate a desired decelerating torque to stop a swing of the upper swing body 3. The controller 30 detects a pressure of the hydraulic oil at each of two ports 21L, 21R of the hydraulic swing motor 21 based on an output of a swing pressure sensor (not shown).

Also, when the controller 30 determines that a swing decelerating operation has been carried out, it may switch the selector valve 60 to the first position and may cause the hydraulic oil flowing out of the hydraulic swing motor 21 to flow into the supply side of the pump/motor 14A. In this case, the controller 30 generates a brake pressure by rotating the pump/motor 14A. Thus, there is no need to meter a flow of the hydraulic oil flowing out of the hydraulic swing motor 21 by a metering valve, and thus the controller 30 does not generate pressure loss at a metering valve. Thus, it reduces or prevents inertial energy of the upper swing body 3 from being wasted as heat energy, and therefore reduces or prevents energy loss.

Figure 21:
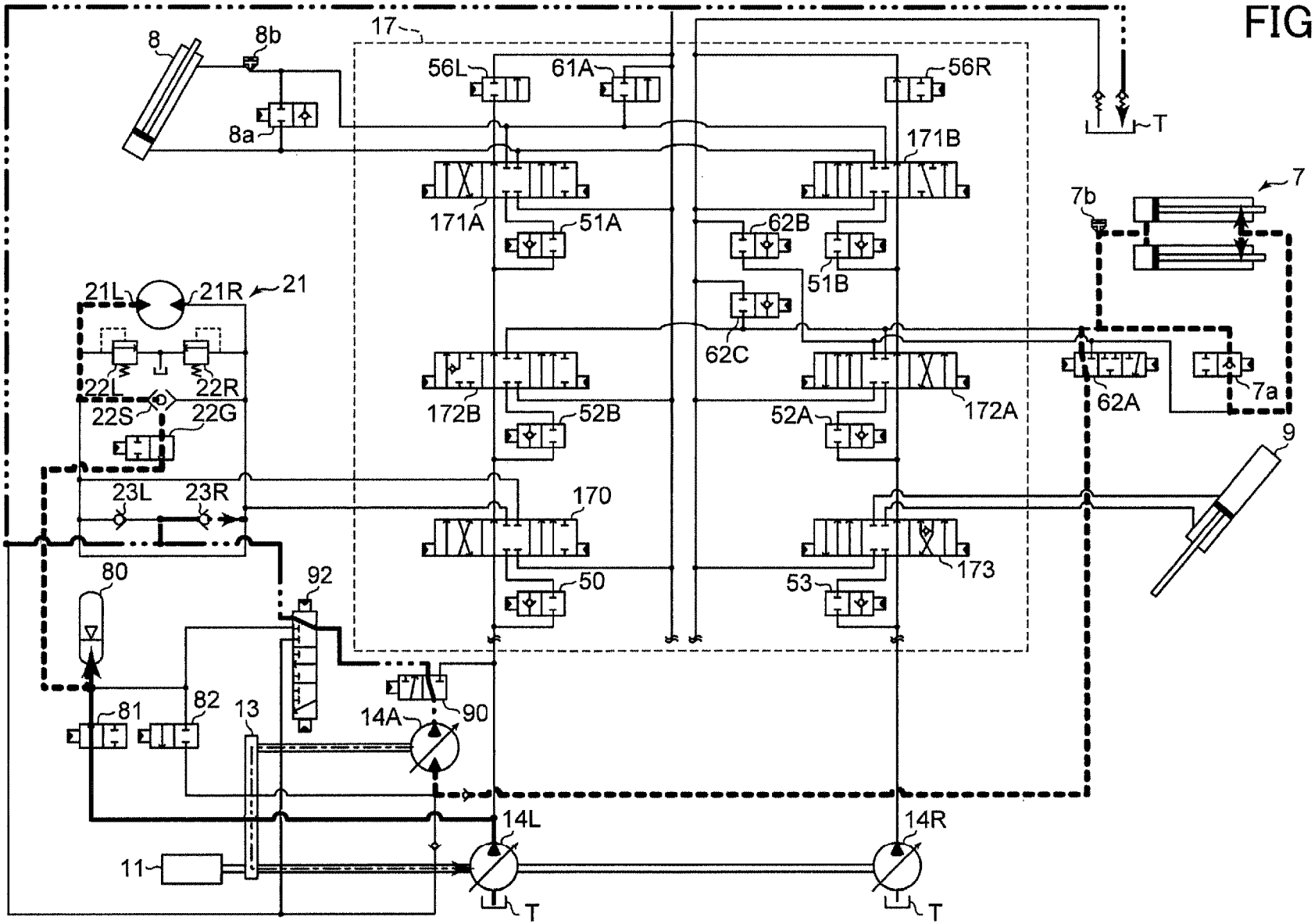
FIG. 21 shows a state of the hydraulic circuit in FIG. 3 when a boom-lowering-swing-decelerating movement is carried out along with an accumulation to an accumulator.

Next, referring to FIG. 21, a state of the hydraulic circuit in FIG. 3 when a boom-lowering-swing-decelerating movement is carried out along with an accumulation to the accumulator 80 is explained. FIG. 21 shows a state of the hydraulic circuit in FIG. 3 when a boom-lowering-swing-decelerating movement is carried out along with an accumulation to the accumulator 80. Thick solid lines in FIG. 21 depict a flow of the hydraulic oil flowing into the accumulator 80. Thick dotted lines in FIG. 21 depict flows of the hydraulic oil flowing out of the hydraulic actuators.

Specifically, when the controller 30 determines that the boom lowering operation has been carried out, the controller 30 causes the hydraulic oil flowing out of the bottom side hydraulic chamber of the boom cylinder 7 to flow into the rod side hydraulic chamber of the boom cylinder 7 by maximizing an opening area of the regeneration valve 7*a*.

Also, the controller 30 switches the selector valve 62A to the first position and directs the hydraulic oil flowing out of the bottom side hydraulic chamber of the boom cylinder 7 to the supply side of the pump/motor 14A. Also, the controller 30 shifts the flow rate control valve 172A to its neutral position by decreasing a pilot pressure acting on the right side pilot port of the flow rate control valve 172A by using a decompression valve independently of an amount of operation of the boom operating lever and thus blocks a flow of the hydraulic oil flowing from the bottom side hydraulic chamber of the boom cylinder 7 through the flow rate control valve 172A toward the hydraulic oil tank T. Also, the controller 30 switches the variable load check valve 52A to the second position and closes the communication between the second pump 14R and the flow rate control valve 172A.

Also, the controller 30 controls a discharge rate of the pump/motor 14A depending on an amount of operation of the boom operating lever and an opening area of the regeneration valve 7*a*. Specifically, the controller 30 actuates the pump/motor 14A as a hydraulic motor and controls a displacement volume of the pump/motor 14A by controlling a corresponding regulator so that a pressure in the bottom side hydraulic chamber of the boom cylinder 7 may not change suddenly. Then, the controller 30 directs the third hydraulic oil discharged from the pump/motor 14A toward the replenishing mechanism of the hydraulic swing motor 21 by switching the selector valve 90 to the second position and switching the selector valve 92 to the first position.

The controller 30 may direct the third hydraulic oil discharged from the pump/motor 14A toward the accumulator 80 or toward a hydraulic actuator in motion. Specifically, when the accumulator pressure is higher than a desired back-pressure of the boom cylinder 7 (a pressure in the bottom side hydraulic chamber), the controller 30 actuates the pump/motor 14A as a hydraulic pump to increase a pressure of the hydraulic oil at the supply side (a pressure in the bottom side hydraulic chamber of the boom cylinder 7) up to the accumulator pressure. Also, when the accumulator pressure is lower than or equal to the desired back-pressure of the boom cylinder 7, the controller 30 actuates the pump/motor 14A as a hydraulic motor to decrease a pressure of the hydraulic oil at the supply side (a pressure in the rod side hydraulic chamber of the boom cylinder 7) down to the accumulator pressure. Then, the controller 30 controls a displacement volume of the pump/motor 14A by adjusting a swash plate tilting angle of the pump/motor 14A by using a corresponding regulator so that a pressure in the bottom side hydraulic chamber of the boom cylinder 7 may not change suddenly. Also, the controller 30 switches the selector valve 90 to the first position, switches the selector valve 92 to the second position, and thus causes the third hydraulic oil discharged from the pump/motor 14A to flow into the accumulator 80. In this way, the controller 30 controls the pump/motor 14A so that a pressure of the hydraulic oil at the discharge side of the pump/motor 14A may become the accumulator pressure and so that a pressure of the hydraulic oil at the supply side of the pump/motor 14A may become the desired back-pressure. The same goes for a case where it directs the third hydraulic oil toward the hydraulic actuator in motion.

The pump/motor 14A acting as a hydraulic pump can discharge hydraulic oil with a pump load lower than that of a case where it pumps hydraulic oil from the hydraulic oil tank T. As a result, it can reduce a load of the engine 11 and can realize saving of energy. Also, the pump/motor 14A acting as a hydraulic motor can assist the engine 11 by generating a rotary torque and can supply a part of a driving force for rotating the first pump 14L. As a result, the controller 30 can increase a horsepower consumed by the first pump 14L, or can reduce a load of the engine 11 and thus an amount of fuel injection when it does not increase the horsepower consumed by the first pump 14L.

In the example of FIG. 21, when the controller 30 actuates the pump/motor 14A as a hydraulic motor and discharges the third hydraulic oil to the hydraulic oil tank T, the controller 30 causes the first hydraulic oil discharged from the first pump 14L actuated by the rotary torque of the pump/motor 14A to flow into the accumulator 80. In this case, the controller 30 controls a displacement volume of the first pump 14L by using a corresponding regulator so that a discharge pressure of the first pump 14L may become the accumulator pressure. Also, the controller 30 switches the selector valve 81 to the first position to open the communication between the first pump 14L and the accumulator 80. A dashed-dotted line arrow in FIG. 21 depicts that the rotary torque of the pump/motor 14A acting as a hydraulic motor actuates the first pump 14L, a thick solid line in FIG. 21 depicts that the first hydraulic oil of the first pump 14L actuated by the pump/motor 14A flows into the accumulator 80.

If the controller 30 cannot adjust an actuating speed of the boom cylinder 7 to a level corresponding to an amount of operation of the boom operating lever only by controlling the displacement volume of the pump/motor 14A, the controller 30 directs at least part of the hydraulic oil flowing out of the bottom side hydraulic chamber of the boom cylinder 7 to the hydraulic oil tank T. Specifically, the controller 30 causes at least part of the hydraulic oil flowing out of the bottom side hydraulic chamber of the boom cylinder 7 to flow to the hydraulic oil tank T by shifting the selector valve 62C to an intermediate position between the first position and the second position, or by completely switching the selector valve 62C to the first position.

Also, when a swing decelerating operation is carried out, the flow rate control valve 170 shifts to the neutral position in FIG. 21 because a pilot pressure decreases with decrease in an amount of operation of the swing operating lever.

Then, when the controller 30 determines that a swing decelerating operation has been carried out, the controller 30 opens the regeneration valve 22G and causes the hydraulic oil at the side of the discharge port 21L of the hydraulic swing motor 21 to flow into the accumulator 80 as shown by the thick dotted line.

Also, the controller 30 adjusts an opening area of the regeneration valve 22G depending on a pressure of the hydraulic oil at the side of the discharge port 21L of the hydraulic swing motor 21 and the accumulator pressure. Then, the controller 30 controls a pressure of the hydraulic oil at the side of the discharge port 21L so as to generate a desired decelerating torque to stop a swing of the upper 7 swing body 3.

In the example of FIG. 21, when a swing decelerating operation is carried out, a pressure of the hydraulic oil at the side of the suction port 21R becomes negative, and thus the check valve 23R in the replenishing mechanism supplies hydraulic oil to the side of the suction port 21R. In this case, the controller 30 switches the selector valve 90 to the second position and switches the selector valve 92 to the first position to direct the third hydraulic oil discharged from the pump/motor 14A toward the replenishing mechanism of the hydraulic swing motor 21. Thus, the check valve 23R can supply the third hydraulic oil discharged from the pump/motor 14A to the side of the suction port 21R as shown by the dashed-three dotted line. As a result, even if it becomes difficult to suck hydraulic oil up from the hydraulic oil tank T due to a decrease in an amount of hydraulic oil in the hydraulic oil tank T, the replenishing mechanism can supply hydraulic oil to the hydraulic swing motor 21 without generating cavitation. An amount of hydraulic oil in the hydraulic oil tank T decreases with increase in an amount of hydraulic oil accumulated in the accumulator 80.

As described above, the controller 30 additionally brings about following effects in addition to the effects described at [Earth removing movement along with an engine-assist by a back-pressure regeneration], [Earth removing movement along with a hydraulic-actuator-assist by a back-pressure regeneration], and [Earth removing movement along with an accumulation to an accumulator by a back-pressure regeneration].

Specifically, when a boom-lowering-swing-decelerating movement is carried out, the controller 30 causes the hydraulic oil flowing out of the hydraulic swing motor 21 to flow into the accumulator 80, and causes the hydraulic oil flowing out of the bottom side hydraulic chamber of the boom cylinder 7 to flow into the supply side of the pump/motor 14A. Thus, the shovel according to the present embodiment can accumulate hydraulic energy generated during a swing deceleration into the accumulator 80, and use hydraulic energy generated during a boom lowering for assisting the engine 11. Also, it can actuate the first pump 14L by assisting the engine 11 by using the hydraulic energy generated during a boom lowering, and can accumulate the hydraulic energy generated during a boom lowering into the accumulator 80 by causing the first hydraulic oil discharged from the first pump 14L to flow into the accumulator 80. As a result, even if the hydraulic energy generated during a boom lowering is large, it can regenerate all the hydraulic energy by increasing a discharge rate of the first pump 14L and thus increasing a horsepower consumed by the first pump 14L.

Although the above description explains eight states each of the hydraulic circuits in FIGS. 2 and 3 (four states during an excavating movement, three states during an earth removing movement, and one state during a boom-lowering-swing-decelerating movement), the controller 30 decides which states to realize based on an amount of operation of an operating lever corresponding to each of the hydraulic actuators, a load pressure of each of the hydraulic actuators, an accumulation state of the accumulator 80, and the like.

For example, the controller 30 may allow an excavating movement along with an accumulator assist to be carried out, when it determines that there is no need to generate a back-pressure in the rod side hydraulic chamber of the boom cylinder 7 during the excavating movement and that sufficient amounts of hydraulic oil are accumulated in the accumulator 80.

Also, the controller 30 may allow an excavating movement along with a hydraulic-actuator-assist by a back-pressure regeneration to be carried out, when it determines that there is a need to generate a back-pressure in the rod side hydraulic chamber of the boom cylinder 7 during the excavating movement and that there is a need to actuate the arm cylinder 8 rapidly.

Also, the controller 30 may allow an excavating movement along with an engine-assist by a back-pressure regeneration to be carried out, when it determines that there is a need to generate a back-pressure in the rod side hydraulic chamber of the boom cylinder 7 during the excavating movement and that there is no need to actuate the arm cylinder 8 rapidly.

Also, the controller 30 may allow an earth removing movement along with a hydraulic-actuator-assist by a back-pressure regeneration to be carried out, when it determines that there is a need to generate a back-pressure in the rod side hydraulic chamber of the boom cylinder 7 during the earth removing movement and that there is a need to actuate the arm cylinder 8 rapidly.

Also, the controller 30 may allow an earth removing movement along with an engine-assist by a back-pressure regeneration to be carried out, when it determines that there is a need to generate a back-pressure in the bottom side hydraulic chamber of the boom cylinder 7 during the earth removing movement, that there is no need to actuate the arm cylinder 8 rapidly, and that sufficient amounts of hydraulic oil are accumulated in the accumulator 80.

Also, the controller 30 may allow an earth removing movement along with an accumulation to an accumulator by a back-pressure regeneration to be carried out, when it determines that there is a need to generate a back-pressure in the bottom side hydraulic chamber of the boom cylinder 7 during the earth removing movement, that there is no need to actuate the arm cylinder 8 rapidly, and that sufficient amounts of hydraulic oil are not accumulated in the accumulator 80.

According to certain embodiments, it is possible to provide a shovel that mounts a hydraulic circuit that can more effectively actuate a plurality of hydraulic pumps and at least one hydraulic device serving as at least either of a hydraulic pump and a hydraulic motor.

It should be understood that the invention is not limited to the above-described embodiments, but may be modified into various forms on the basis of the spirit of the invention. Additionally, the modifications are included in the scope of the invention.

For example, in the above embodiments, the hydraulic actuators may include a left side hydraulic running motor (not shown) and a right side hydraulic running motor (not shown). In this case, the controller 30 may accumulate hydraulic energy generated during a travel deceleration into the accumulator 80. The hydraulic swing motor 21 may be an electric motor.

Also, the shovel according to the above embodiments may mount an electric motor-generator (not shown), an electric storage device (not shown) that accumulates electric power generated by the electric motor-generator and supplies electric power to the electric motor-generator, an inverter that controls the electric motor-generator, and the like.

Also, the pump/motor 14A may be actuated by the electric motor-generator, instead of being actuated by the engine 11. In this case, when the pump/motor 14A acts as a hydraulic motor, the pump/motor 14A may actuate the electric motor-generator as a generator by using generated rotary torque, and may then cause the generated electric power to be accumulated in the electric storage device. Also, the electric motor-generator may act as a electric motor by using the electric power accumulated in the electric storage device, and may then cause the pump/motor 14A to act as a hydraulic pump.

What is claimed is:

1. A shovel, comprising:

an engine;

a first pump connected to the engine and configured to discharge a first hydraulic oil;

a second pump connected to the engine and configured to discharge a second hydraulic oil;

a hydraulic device configured to operate as a hydraulic pump to discharge a third hydraulic oil;

a first hydraulic actuator configured to allow at least the first hydraulic oil, the second hydraulic oil, and the third hydraulic oil to flow into the first hydraulic actuator; and a second hydraulic actuator configured to allow at least the second hydraulic oil to flow into the second hydraulic actuator, wherein when the first hydraulic actuator and the second hydraulic actuator operate simultaneously, the first hydraulic actuator is actuated by the first hydraulic oil or the third hydraulic oil, and the second hydraulic actuator is actuated by the second hydraulic oil.

2. The shovel as claimed in claim 1, wherein the hydraulic device is configured to receive a hydraulic oil flowing out of the second hydraulic actuator to generate a back-pressure of the second hydraulic actuator and a rotary torque.

3. The shovel as claimed in claim 1, further comprising:

a confluence switching part configured to switch confluence/separation of the first hydraulic oil and the second hydraulic oil, wherein the confluence switching part is configured to block the confluence of the first hydraulic oil and the second hydraulic oil when the first hydraulic actuator and the second hydraulic actuator operate simultaneously.

4. The shovel as claimed in claim 1, wherein when the first hydraulic actuator and the second hydraulic actuator operate simultaneously, the first hydraulic actuator is actuated by at least the first hydraulic oil, the second hydraulic actuator is actuated by at least the second hydraulic oil, and the hydraulic device controls an actuation speed of the second hydraulic actuator by generating a back-pressure of the second hydraulic actuator.

5. The shovel as claimed in claim 1, further comprising:

an accumulator configured to receive the first hydraulic oil discharged from the first pump.

6. The shovel as claimed in claim 1, wherein the hydraulic device is configured to discharge the third hydraulic oil and pressurize an accumulator.

7. The shovel as claimed in claim 1, wherein when the first hydraulic actuator and the second hydraulic actuator operate simultaneously, a sum of a discharge rate of the second pump and a discharge rate of the hydraulic device is equal to the maximum discharge rate of the second pump.

8. The shovel as claimed in claim 5, wherein the hydraulic device is configured to increase a pressure of a hydraulic oil flowing out of the accumulator and discharge the hydraulic oil as the third hydraulic oil.

9. The shovel as claimed in claim 1, wherein the hydraulic device is configured to increase a pressure of a hydraulic oil flowing out of the second hydraulic actuator and discharge the hydraulic oil as the third hydraulic oil.

10. The shovel as claimed in claim 5, further comprising:

a confluence switching part configured to switch confluence/separation of the first hydraulic oil and the second hydraulic oil, wherein the first hydraulic actuator is a hydraulic swing motor, and when a swing decelerating movement is carried out, the confluence switching part blocks the confluence of the first hydraulic oil and the second hydraulic oil, and the accumulator receives a hydraulic oil flowing out of the hydraulic swing motor.

11. The shovel as claimed in claim 1, further comprising:

a valve configured to switch open/close of a communication between the second pump and the second hydraulic actuator, wherein the valve is configured to close the communication between the second pump and the second hydraulic actuator when a movement of the first hydraulic actuator and a movement of the second hydraulic actuator under a working element's own weight are carried out simultaneously.

12. The shovel as claimed in claim 1, further comprising:

a valve configured to switch whether or not to merge a hydraulic oil flowing out of the second hydraulic actuator to the first hydraulic oil, wherein the valve is configured to merge the hydraulic oil flowing out of the second hydraulic actuator to the first hydraulic oil when a movement of the first hydraulic actuator and a movement of the second hydraulic actuator under a working element's own weight are carried out simultaneously.

13. The shovel as claimed in claim 1, wherein the hydraulic device is a swash plate type variable displacement hydraulic pump, and is configured to increase a back-pressure of the second hydraulic actuator as a displacement volume decreases.

14. A shovel, comprising:

an engine;

a first pump connected to the engine and configured to discharge a first hydraulic oil;

a second pump connected to the engine and configured to discharge a second hydraulic oil;

a hydraulic device configured to operate as a hydraulic motor with a third hydraulic oil;

a first hydraulic actuator configured to allow at least the first hydraulic oil and the second hydraulic oil to flow into the first hydraulic actuator; and a second hydraulic actuator configured to allow at least the second hydraulic oil to flow into the second hydraulic actuator, wherein when the first hydraulic actuator and the second hydraulic actuator operate simultaneously, the first hydraulic actuator is actuated by the first hydraulic oil, the second hydraulic actuator is actuated by the second hydraulic oil, and the hydraulic device is actuated as the hydraulic motor by the third hydraulic oil discharged from the second hydraulic actuator to generate a back-pressure of the second hydraulic actuator and a rotary torque and increase a discharge rate of the first pump or assist the engine with the rotary torque.

15. The shovel as claimed in claim 14, further comprising:

a confluence switching part configured to switch confluence/separation of the first hydraulic oil and the second hydraulic oil, wherein the confluence switching part is configured to block the confluence of the first hydraulic oil and the second hydraulic oil when the first hydraulic actuator and the second hydraulic actuator operate simultaneously.

16. The shovel as claimed in claim 14, wherein when the first hydraulic actuator and the second hydraulic actuator operate simultaneously, the first hydraulic actuator is actuated by at least the first hydraulic oil, the second hydraulic actuator is actuated by at least the second hydraulic oil, and the hydraulic device controls an actuation speed of the second hydraulic actuator by generating the back-pressure of the second hydraulic actuator.

17. The shovel as claimed in claim 14, further comprising:

an accumulator configured to receive the first hydraulic oil discharged from the first pump.

18. The shovel as claimed in claim 17, further comprising:

a confluence switching part configured to switch confluence/separation of the first hydraulic oil and the second hydraulic oil, wherein the first hydraulic actuator is a hydraulic swing motor, and when a swing decelerating movement is carried out, the confluence switching part blocks the confluence of the first hydraulic oil and the second hydraulic oil, and the accumulator receives a hydraulic oil flowing out of the hydraulic swing motor.

19. The shovel as claimed in claim 14, wherein the hydraulic device is configured to discharge the third hydraulic oil and pressurize an accumulator.

20. The shovel as claimed in claim 14, wherein when the first hydraulic actuator and the second hydraulic actuator operate simultaneously, a sum of a discharge rate of the second pump and a discharge rate of the hydraulic device is equal to the maximum discharge rate of the second pump.

21. The shovel as claimed in claim 14, further comprising:

a valve configured to switch open/close of a communication between the second pump and the second hydraulic actuator, wherein the valve is configured to close the communication between the second pump and the second hydraulic actuator when a movement of the first hydraulic actuator and a movement of the second hydraulic actuator under a working element's own weight are carried out simultaneously.

22. The shovel as claimed in claim 14, further comprising:

a valve configured to switch whether or not to merge a hydraulic oil flowing out of the second hydraulic actuator to the first hydraulic oil, wherein the valve is configured to merge the hydraulic oil flowing out of the second hydraulic actuator to the first hydraulic oil when a movement of the first hydraulic actuator and a movement of the second hydraulic actuator under a working element's own weight are carried out simultaneously.

23. The shovel as claimed in claim 14, wherein the hydraulic device is a swash plate type variable displacement hydraulic motor, and is configured to increase the back-pressure of the second hydraulic actuator as a displacement volume decreases.

* * * * *